US007178196B2

(12) United States Patent
Morgan et al.

(10) Patent No.: US 7,178,196 B2
(45) Date of Patent: Feb. 20, 2007

(54) TANK ARRANGEMENT FOR A FLOOR CARE APPLIANCE

(75) Inventors: Jeffery A. Morgan, Cuyahoga Falls, OH (US); Charles A. Lang, Hartville, OH (US); Adam C. Sclafani, North Canton, OH (US); Kevin L. Thomas, North Canton, OH (US); Jeffrey S. Louis, Akron, OH (US); David L. O'Neal, Louisville, OH (US); Siu Wai Hui, Kowloon (CN)

(73) Assignee: The Hoover Company, North Canton, OH (US)

( * ) Notice: Subject to any disclaimer, the term of this patent is extended or adjusted under 35 U.S.C. 154(b) by 0 days.

(21) Appl. No.: 11/032,969

(22) Filed: Jan. 11, 2005

(65) Prior Publication Data

US 2005/0120508 A1 Jun. 9, 2005

Related U.S. Application Data

(63) Continuation of application No. 09/955,713, filed on Sep. 18, 2001, now Pat. No. 6,842,942.

(51) Int. Cl.
*A47L 7/32* (2006.01)

(52) U.S. Cl. ..... 15/320; 15/383

(58) Field of Classification Search ..... 15/320, 15/383; *A47L 7/32*
See application file for complete search history.

(56) References Cited

U.S. PATENT DOCUMENTS

| | | | | | |
|---|---|---|---|---|---|
| 4,559,665 | A * | 12/1985 | Fitzwater | ..... | 15/339 |
| 4,809,397 | A * | 3/1989 | Jacobs et al. | ..... | 15/320 |
| 5,465,456 | A * | 11/1995 | Fellhauer et al. | ..... | 15/320 |
| 5,477,578 | A * | 12/1995 | Duncan et al. | ..... | 15/320 |
| 5,887,313 | A * | 3/1999 | Hanold et al. | ..... | 15/320 |
| 5,983,442 | A * | 11/1999 | Louis et al. | ..... | 15/320 |
| 6,247,202 | B1 * | 6/2001 | Lesco et al. | ..... | 15/320 |
| 6,253,414 | B1 * | 7/2001 | Bradd et al. | ..... | 15/320 |
| 6,325,864 | B1 * | 12/2001 | Zahuranec et al. | ..... | 15/320 |
| 6,832,407 | B2 * | 12/2004 | Salem et al. | ..... | 15/320 |

FOREIGN PATENT DOCUMENTS

| | | | |
|---|---|---|---|
| EP | 1027855 | * | 8/2000 |

* cited by examiner

*Primary Examiner*—Theresa T. Snider
(74) *Attorney, Agent, or Firm*—A. Burgess Lowe, Esq.; Michael J. Corrigan, Esq.

(57) ABSTRACT

A floor care appliance is provided. The floor care appliance includes a base for movement along the surface attached to a housing. The floor care appliance has two liquid storage tanks located in the housing wherein one of the liquid storage tanks generally overlies the other liquid storage tank. In the preferred embodiment of the invention, the liquid storage tank located above the other liquid storage tank is a cleaning solution storage tank and the other liquid storage tank is a liquid recovery tank.

7 Claims, 56 Drawing Sheets

TANK ARRANGEMENT FOR A FLOOR CARE APPLIANCE

This application is a continuation of claiming priority to application Ser. No. 09/955,713 filed on Sep. 18, 2001 issued as U.S. Pat. No. 6,842,942 on Jan. 18, 2004.

BACKGROUND OF THE INVENTION

1. Field of the Invention

The present invention relates to floor care appliances. More particularly, the present application pertains to a floor care appliance having two liquid storage tanks with the first liquid storage tank located generally overlying the second liquid storage tank.

2. Background Information

In some floor cleaning units, a cleaning solution is distributed on the floor or cleaning surface and then removed, along with dirt entrained in the solution, by a suction nozzle assembly. Often, after several uses, dirt collects within the suction nozzle assembly thereby impeding the flow of dirt entrained in the solution in it resulting in loss of suction power. Cleaning the suction nozzle assembly is usually difficult, since the nozzle assembly is fixedly mounted to the unit, requiring manipulation of the whole unit to clean the inner portions of the nozzle assembly as well as the outer portion of the nozzle assembly. Also, several of these cleaners have brushes for scrubbing and cleaning the floor. Sometimes, it is desirable to remove the suction nozzle assembly and simply scrub the floor for cleaning or polishing without suction applied. However, this operation is difficult to do too, since the nozzle assembly is fixedly mounted to the unit.

Hence, it is an object of the present invention to provide a floor cleaning unit with a nozzle assembly that can be easily removed for service and cleaning.

It is another object of the present invention to provide a floor cleaning unit with a brush assembly which can be selectively used for just scrubbing the floor by removal of the suction nozzle assembly.

SUMMARY OF THE INVENTION

The foregoing and other objects of the present invention will be readily apparent from the following description and the attached drawings. In one embodiment of the present invention, an improved floor cleaning unit is provided. The floor cleaning unit comprises a base for movement along the surface. A nozzle assembly is removably attached to the base for pick up and removal of liquid and dirt. Such attachment is accomplished by providing the nozzle assembly with a slide latch that slidably engages a channel formed in the base.

BRIEF DESCRIPTION OF THE DRAWINGS

The invention will now be described, by way of example, with reference to the attached drawings, of which:

FIG. 29 is a sectional view taken along line 19A–29A of FIG. 1;

DETAILED DESCRIPTION OF THE INVENTION

Figure 1:
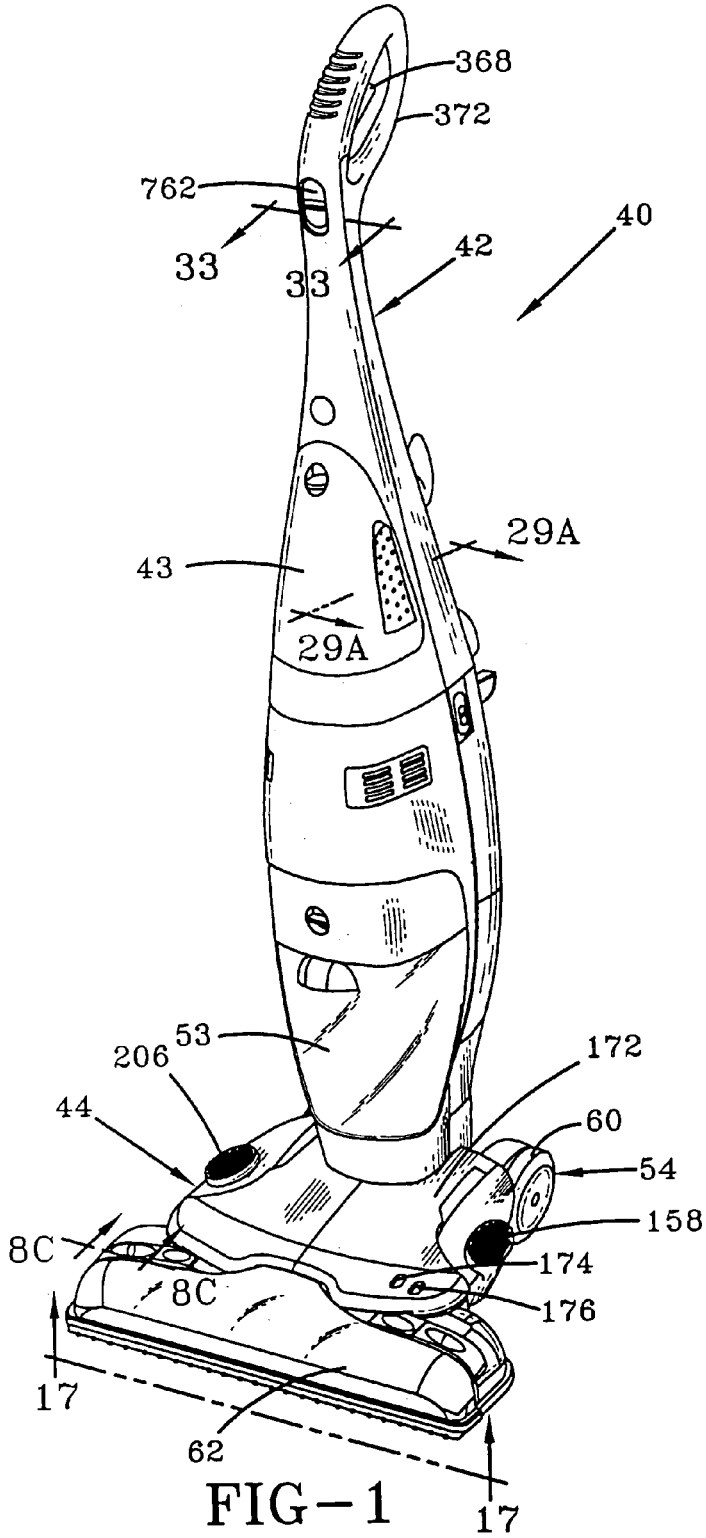
FIG. 1 is a perspective view of the hard floor cleaning unit of one embodiment according to the present invention.

Referring to the drawings, FIG. 1 depicts a perspective view of an upright hard floor-cleaning unit 40 of one embodiment of the present invention. The hard floor cleaning unit 40 comprises an upright handle assembly 42 pivotally connected to the rear portion of a base assembly 44 that moves and cleans along a surface. In particular, as shown in FIG. 2C, a pair of trunnions 46, laterally extending from respective right and left ears 48, 49 integrally formed on the lower end on the handle assembly 42, journal into caps 50 mounted on the rear of the frame 52 of the base assembly 44 to form the pivotal connection. Referring back to FIG. 1, the base assembly 44 includes a nozzle assembly 62 for recovery particles and/or fluid from the floor and a brush block assembly 216 (FIG. 2A) for scrubbing the floor. The handle assembly 42 includes a recovery tank 53 for collecting the particles and/or fluid picked up by the nozzle assembly 62 and a solution tank 43 containing cleaning solution for distribution on the floor.

Figure 18:
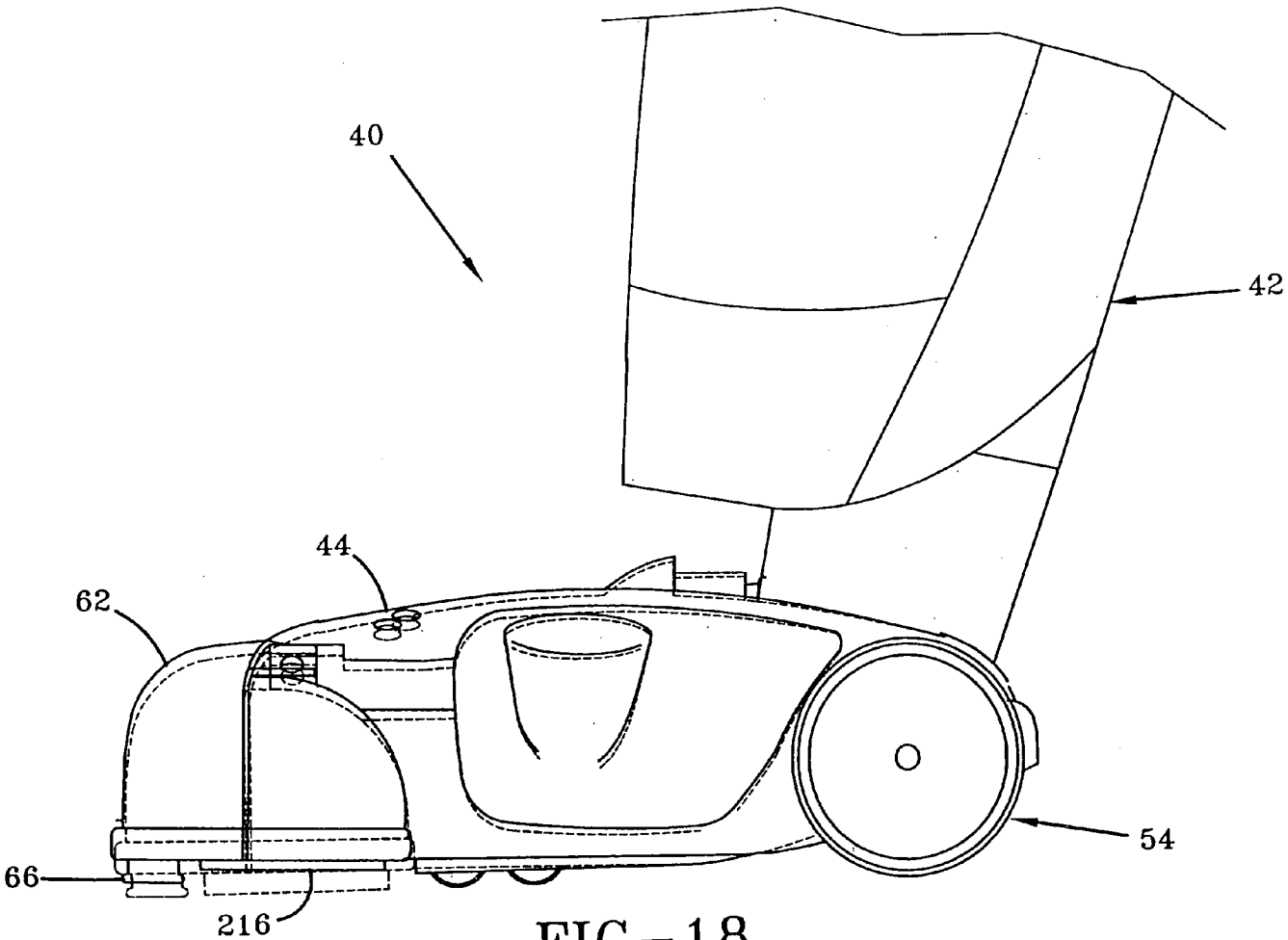
FIG. 18 is a side diagrammatic side view of the hard floor cleaning unit of FIG. 1.

Generally, the hard floor cleaning unit 40 can be used for two modes of cleaning, the dry and wet mode as best illustrated in FIG. 18. In the dry mode, the nozzle assembly 62 and brush block assembly 216 are raised to allow pick up of large loose particles. In the wet mode as shown by the phantom lines, the nozzle assembly 62 is lowered to collect the fluid and pick it up. Also, in the wet mode, the brush block assembly 216 can be lowered, if desired, to scrub the floor. Both the nozzle assembly 62 and brush block assembly 216 are removable from the base assembly 44. Further details of the cleaning unit 40 are discussed below.

Figure 2A:
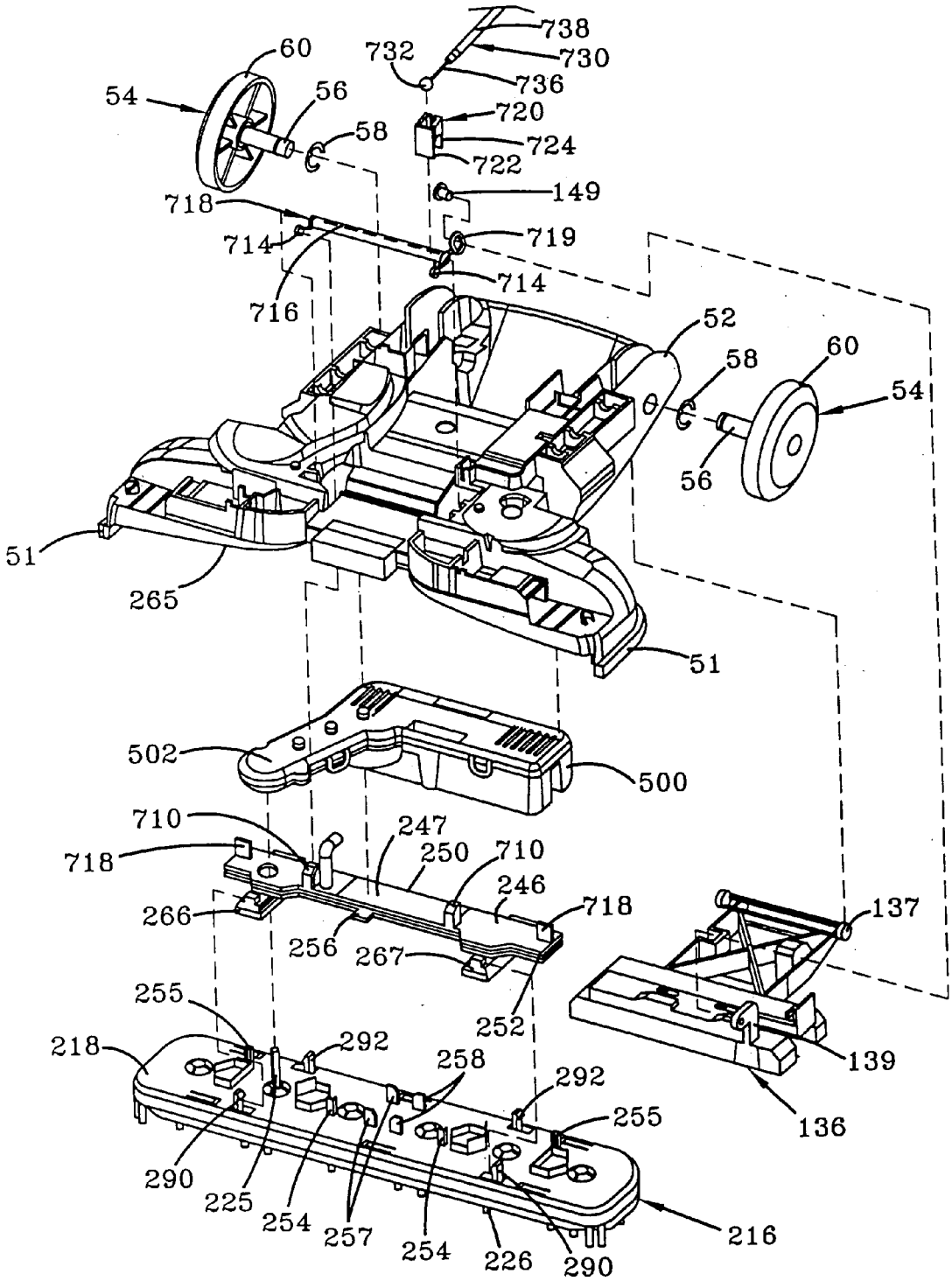
FIG. 2A is an exploded view of the bottom portion of the base assembly of the hard floor cleaning unit of FIG. 1.

Turning to the lower portion of the base assembly 44 as shown in FIG. 2A, the frame 52 is generally unitary molded and includes two laterally displaced rear wheels 54. Each wheel 54 is rotatably connected to a cantilevered axle 56 that is journaled into the frame 52 and retained therein by an e-ring 58 secured around the axle 56. Soft elastomeric tires 60 are molded over the wheels 54 to prevent the scratching on various floor surfaces. Elastomeric bumper strips 51 are overmolded on the lower edges of frame 52 surrounding the brush block assembly 216.

Figure 6:
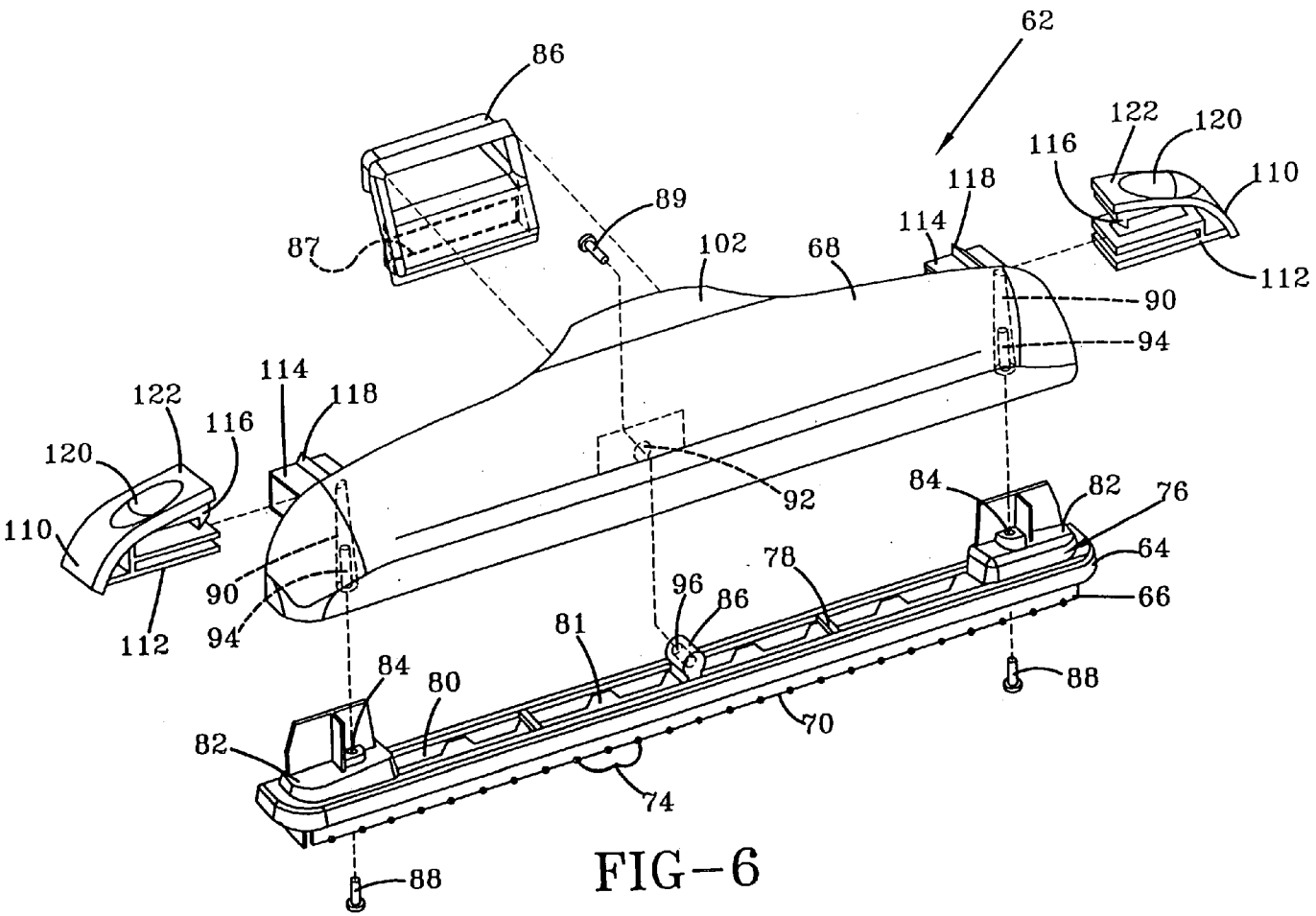
FIG. 6 is an exploded view of the nozzle assembly for the hard floor cleaning unit of FIG. 1.
Figure 7:
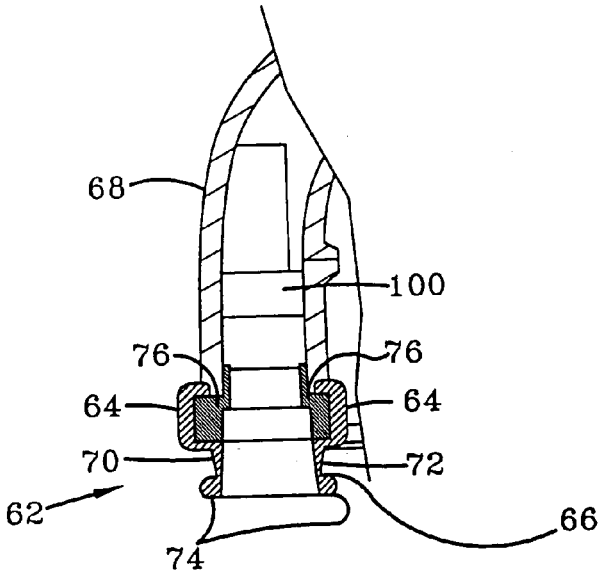
FIG. 7 is a sectional view of the nozzle assembly taken along line 7—7 of FIG. 2B.

As depicted in FIGS. 6 and 7, the nozzle assembly 62 includes an elastomeric squeegee 66 attached around a retainer 76 that is mounted to the bottom of the translucent nozzle body 68. The nozzle body 68 is composed of a rigid material such as, for example, plastic. The squeegee 66 includes front and rear integrally molded blades or lips 70, 72 (FIG. 7) that have bumps 74 along the outer surface of the bottom edges. The bumps 74 raise the leading squeegee lip to allow air and liquid to flow beneath the lip between the bumps. Yet, the trailing lip bends out and cleanly wipes the floor with its inside straight edge to keep liquid in the high suction area between the lips 70, 72. The bumps are formed only adjacent the bottom edges of the lips 70, 72, so that there is a relatively thin cross section of each of the lips 70, 72 between the bumps 74 and bottom edge of the nozzle body 68. This provides a highly flexible thin section in the bending area for good wiping action for the trailing lip and to insure the leading lip bends sufficiently to raise it on the bumps 74. Such a design is shown in U.S. Pat. No. 3,520,012; the disclosure of which is incorporated herein by reference. Integrally molded with the squeegee 66 is a bumper or furniture guard 64.

With continued reference to FIG. 6, the squeegee 66 is attached around the frame 80 of the elongated retainer 76 by over molding it there around. Integrally formed retaining tabs 81 are seated in slots formed in the frame 80 to provide added reinforcement. The retainer 76 includes a plurality of separator plates 78 integrally molded between the front and rear portions of the frame 80 of the retainer 76. A pair of mounting members 82 is integrally molded on opposite sides of the frame 80 at its upper side and have apertures 84 for receiving screws 88. A cylindrically shaped spacer 86 is integrally molded on the center separator plate 78 of the retainer 76. The nozzle body 68 has a pair of bosses 90 with inner longitudinal bores 94 extending downwardly from the underside of the nozzle body 68 on opposite sides. The retainer 76 and squeegee 66 are inserted into the underside of the nozzle body 68 such that the apertures 84 of the mounting members 82 register with the bores 94 in the bosses 90 and a rear central aperture 92 of the nozzle body 68 registers with a lateral aperture 96 of the spacer 86. Screws 88 are then inserted through the apertures 84 of the mounting members 82 and through the bores 94 in the bosses 90. A screw 89 is also inserted through the rear central aperture 92 of the nozzle body 68 and the lateral aperture 96 in the spacer 86 of the retainer 76. The spacer 86 and separator plates 78 maintain alignment and sealing of the squeegee 66 with the nozzle body 68 to insure proper airflow through them.

Figure 4:
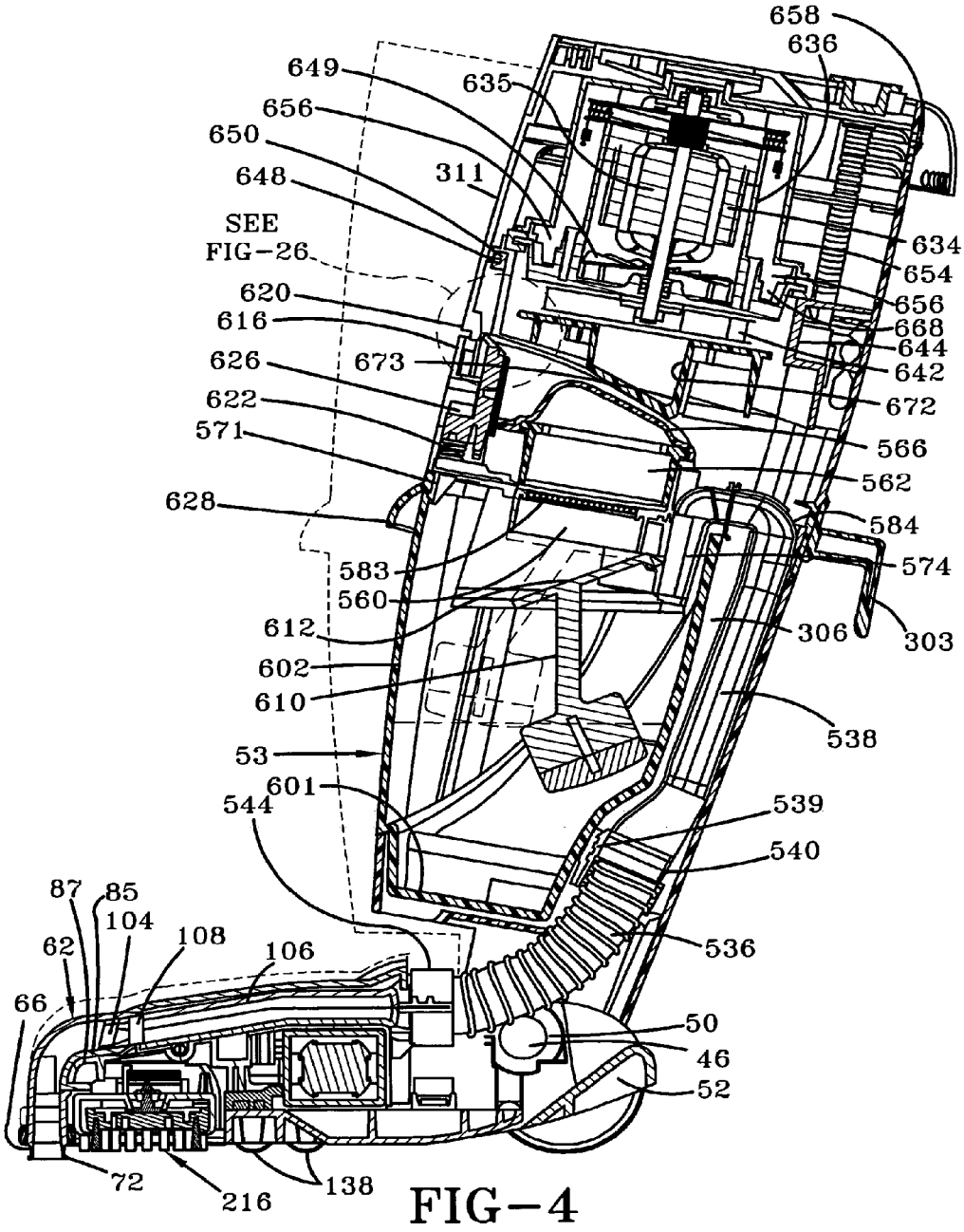
FIG. 4 is a side elevational cross sectional view taken vertically through the lower portion of the hard floor cleaning unit of FIG. 1.
Figure 17:
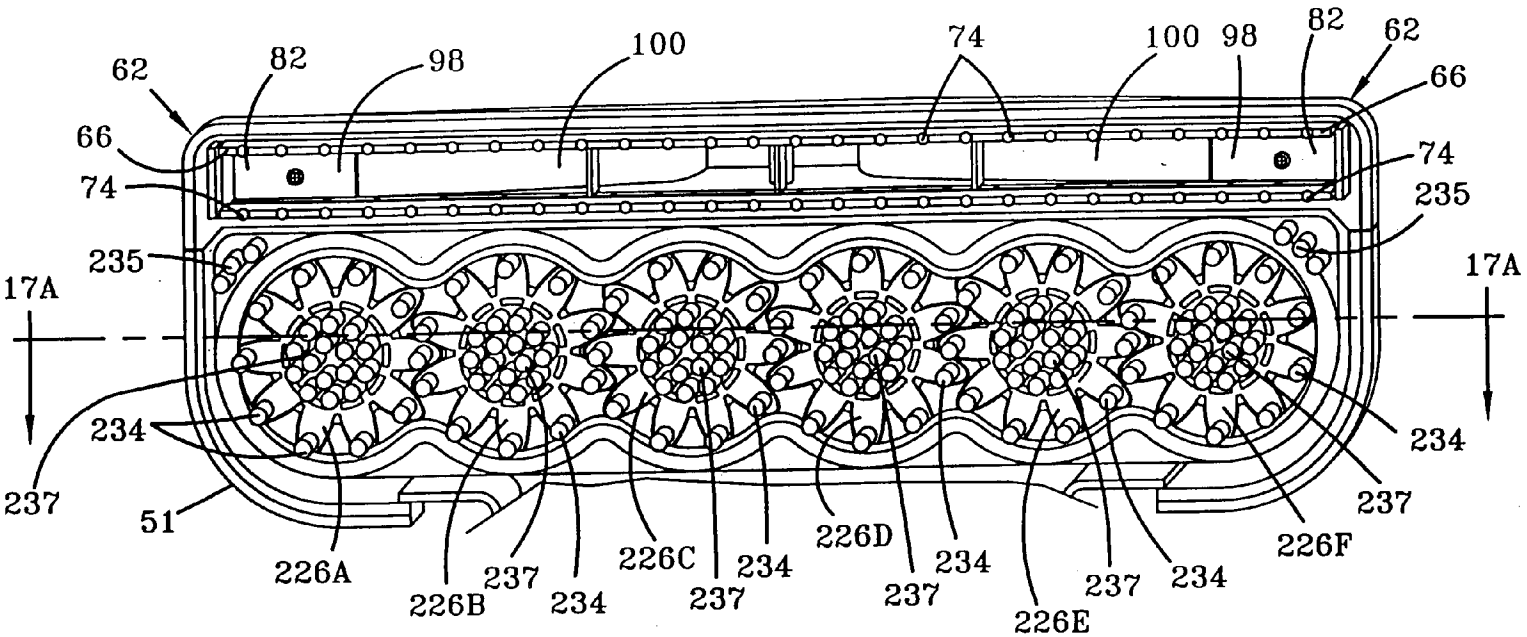
FIG. 17 is a fragmentary bottom view of the forward portion of the hard floor cleaning unit of FIG. 1 illustrating the nozzle assembly and brush block assembly.

As shown in FIG. 17, a channel 98 is formed on the underside of each mounting member 82 and is flushed or slightly below the nozzle channel 100, when the nozzle assembly 62 is placed on the floor, to direct the air and water flow through the nozzle channel 100. The nozzle channel 100 converges into a rear centrally located outlet 102 (FIG. 6). A spacer 86 is attached to the outlet 102 as seen in FIG. 6, and is fluidly connected to a rectangularly shaped translucent base duct or channel 106 as depicted in FIG. 4. The spacer 86 has a pocket portion 87 for engagement by a tongue 85 (also depicted in FIG. 2B) extending forwardly from the frame 52 for added support of the nozzle assembly 62.

Figure 2B:
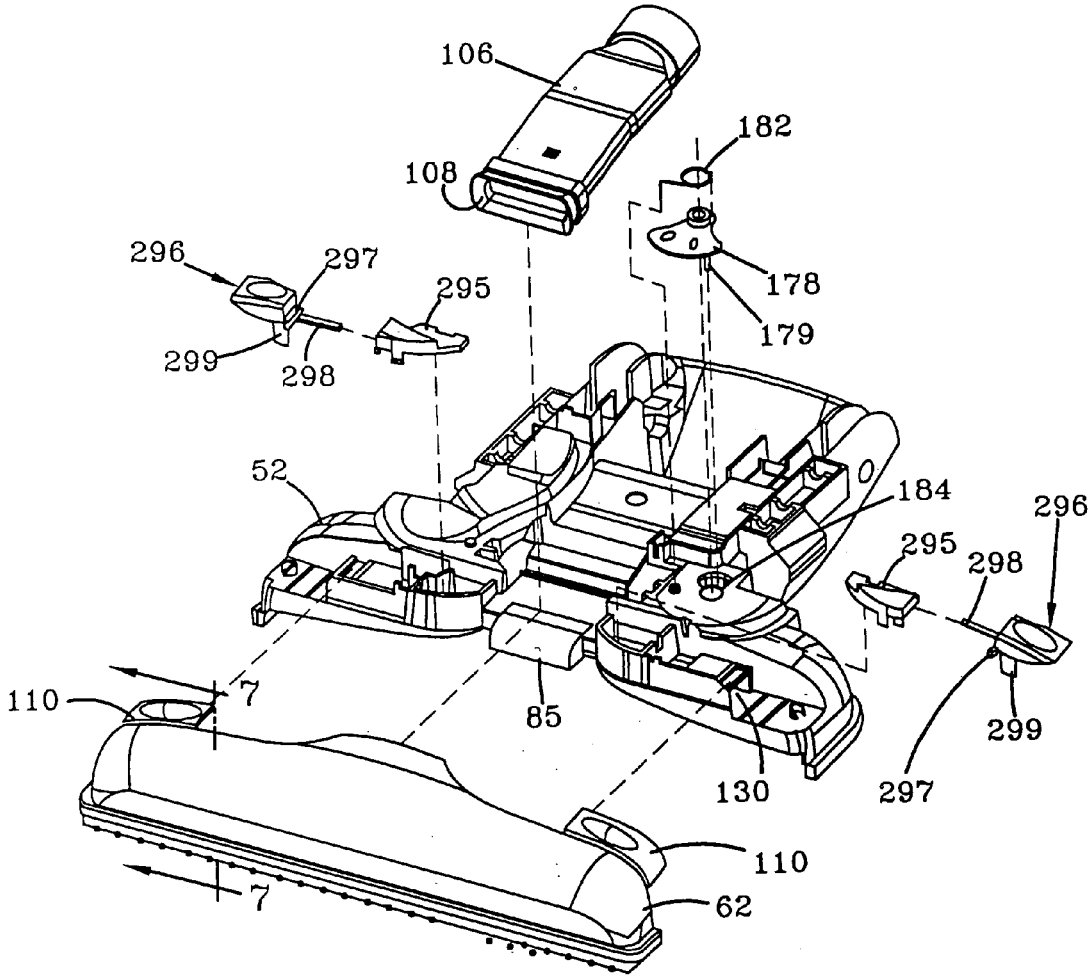
FIG. 2B is an exploded view of the front upper portion of the base assembly of the hardfloor cleaning unit of FIG. 1.
Figure 2C:
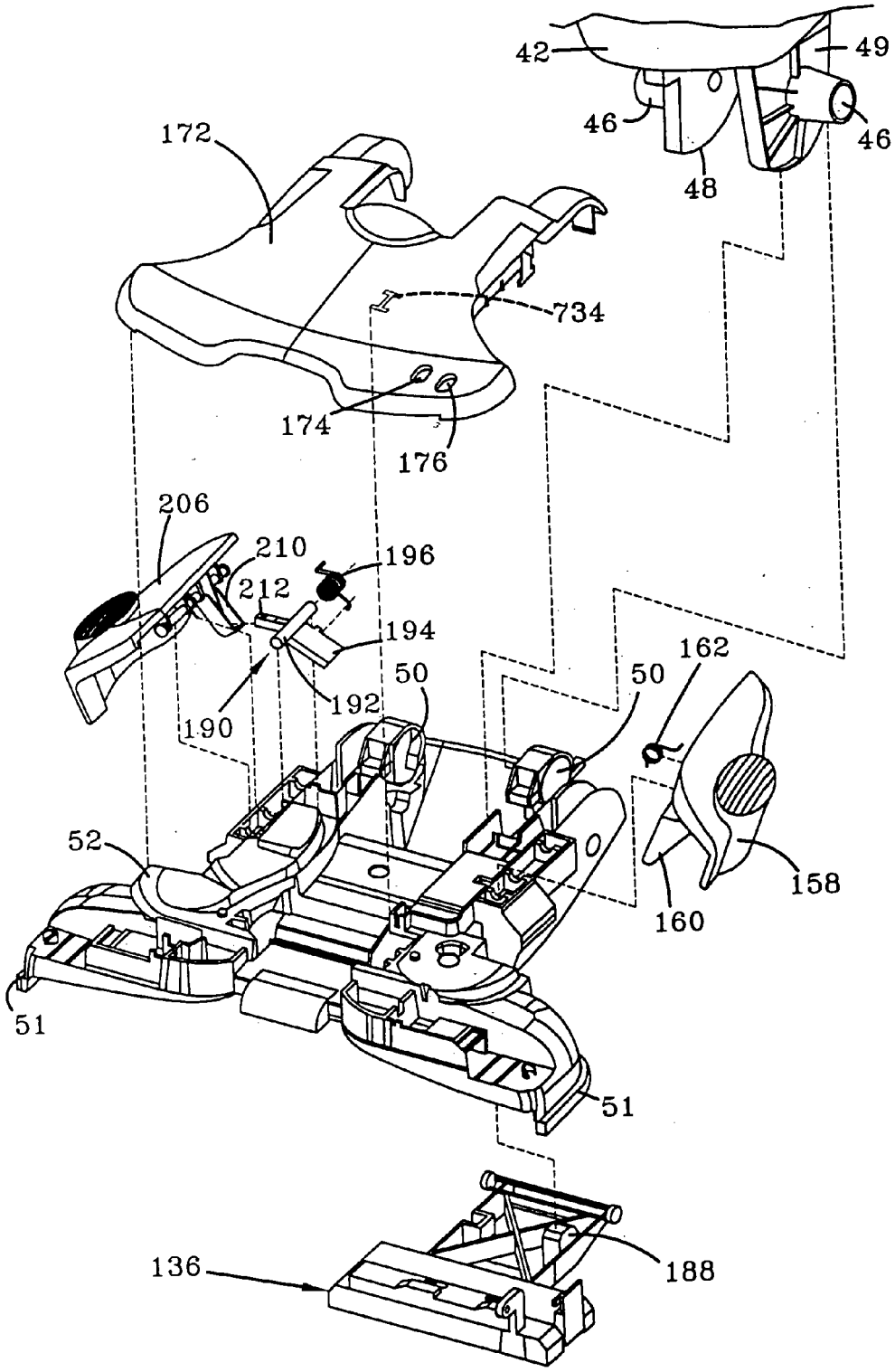
FIG. 2C is an exploded view of the rear upper portion of the base assembly of the hard floor cleaning unit of FIG. 1 with the carriage assembly included for illustrative purposes.

As best illustrated in FIGS. 2B and 4, the floor suction nozzle assembly 62 is removably attached to the frame 52 and fluidly connected to a base duct 106. The base duct 106 comprises upper and lower portions that are welded together. An elastic flexible grommet 108 for sealing is fitted around the front inlet of the base duct 106 to seal the passageway between the spacer 104 and base duct 106 when they are fluidly connected together.

Figure 8A:
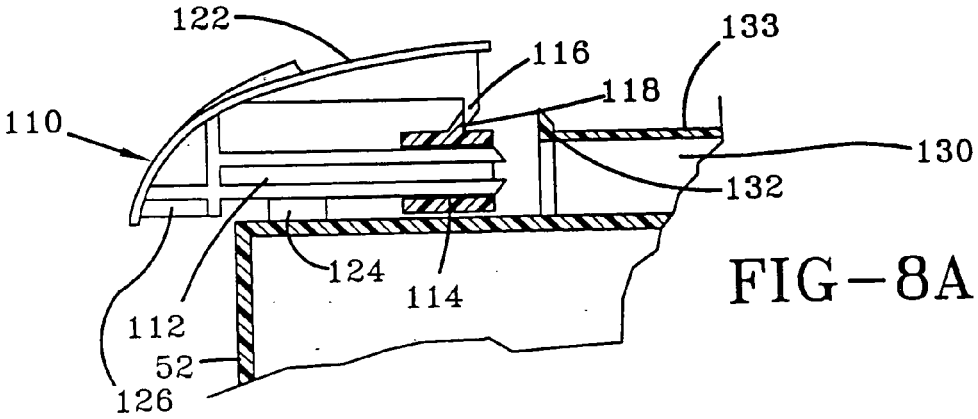
FIG. 8A is a partial sectional view of the base assembly of the hard floor cleaning unit taken along line 8C—8C of FIG. 1, but with the slide latches slid outwardly away from the channel of the frame.
Figure 8B:
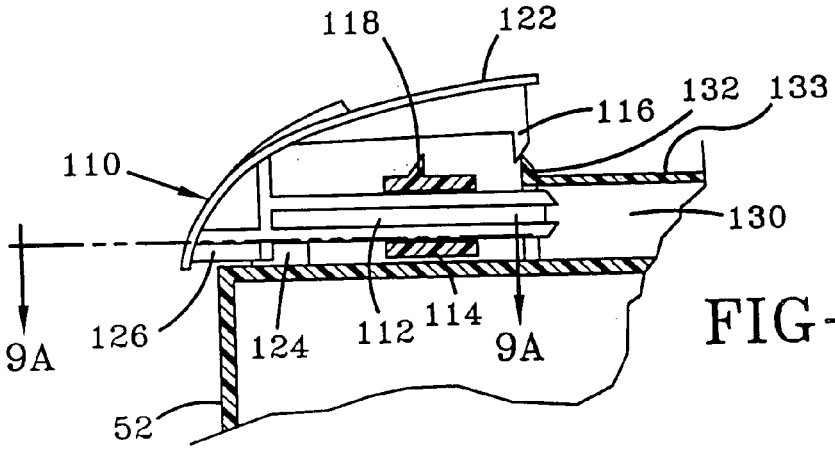
FIG. 8B is a partial sectional view similar to FIG. 8A, except that the slide latches are slide inwardly into the channel of the frame.
Figure 8C:
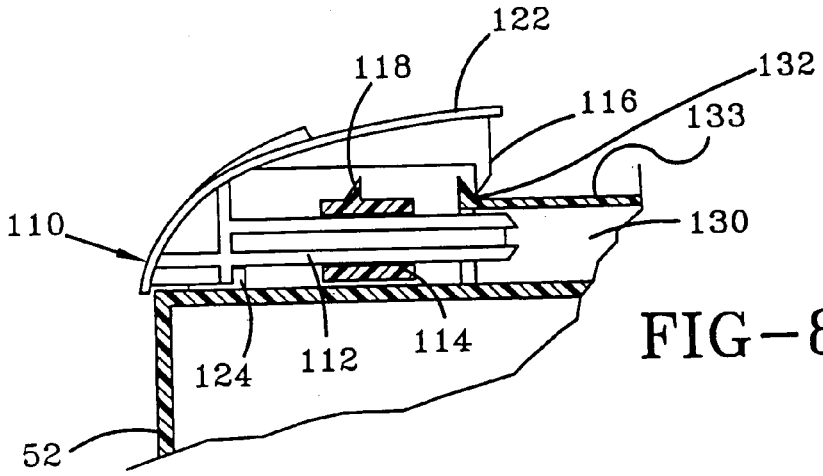
FIG. 8C is a partial sectional view taken of the base assembly of the hard floor cleaning unit taken along line 8C—8C of FIG. 1.
Figure 9A:
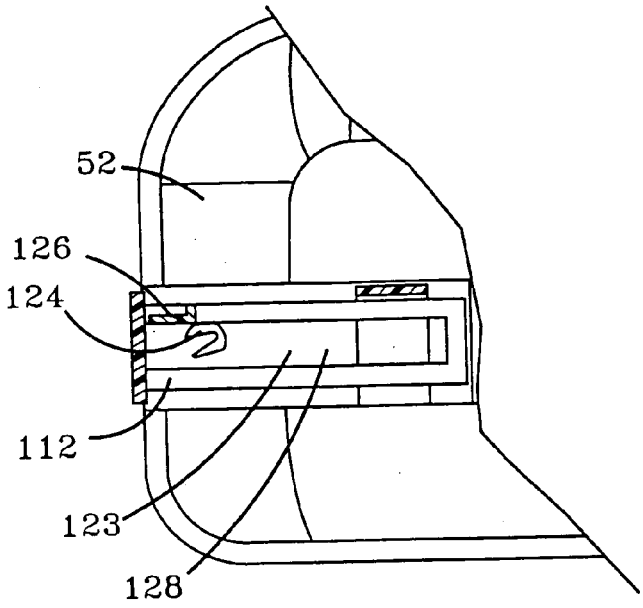
FIG. 9A is a sectional view of the base assembly taken along line 9A—9A of FIG. 8B.
Figure 9B:
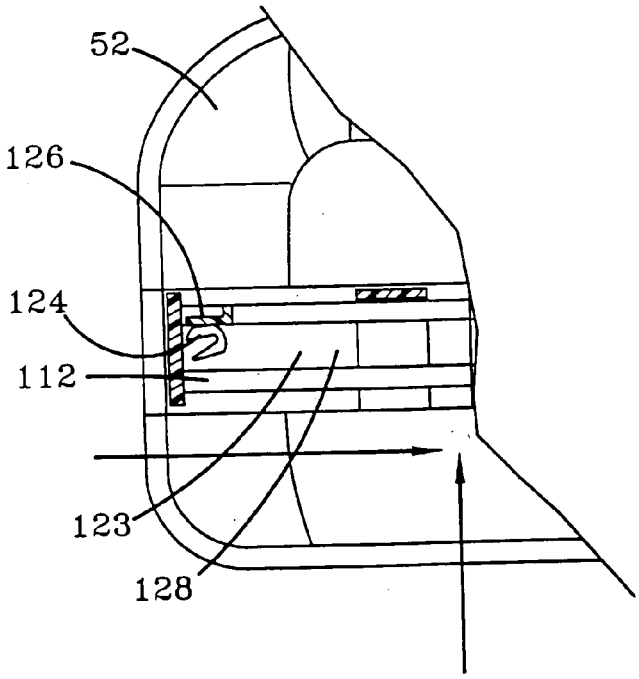
FIG. 9B is a sectional view similar to FIG. 9A except that the slide latch is slid inwardly to the position shown in FIG. 8C.

Referring back to FIG. 6, the nozzle assembly 62 includes a pair of slide latches 110 on opposite sides of the nozzle assembly 62 for removably securing the nozzle assembly 62 to the frame 52 (FIG. 2B). Specifically, each slide latch 110 includes a lateral tongue member 112 that is slidingly inserted into a holder 114 attached to the rear side of the nozzle body 68. The upper button portion 122 of the latch 110 includes a hook 116 depending downwardly therefrom that engages a stop member 118, projecting on the upper surface of the holder 114, to prevent the latch 110 from disengaging from the holder 114. An oval shaped recess 120 is formed in the top surface of the upper button portion 122 for engagement by a user. With reference to FIGS. 9A and 9B, the tongue member 112 includes a slot 128 formed therein for slidingly receiving a u-shaped protrusion 124 formed on the upper surface of a front step 123 of the frame 52. The tongue member 112 includes an L-shaped guide rib 126 integrally formed on its underside and extending inwardly from the outer end of the tongue member 112. When connecting the nozzle assembly 62 (FIG. 2B) to the frame 52, each slide latch 110 is first slid outwardly until the hook 116 engages the stop member 118 as best illustrated in FIG. 8A. The nozzle assembly 62 is then positioned so that the spacer 104 is aligned with the grommet 108 as previously mentioned. As seen in FIG. 8B, each latch 110 is then slid inwardly so that the tongue member 112 extends partially through a lateral channel 130 formed in the frame 52. As the slide latch 110 is slid further, the hook 116 cams against a beveled channel rib 132 on the top wall 133 of the channel 130, deflecting upwardly over the channel rib 132 and catching it as shown in FIG. 8C. Also, as depicted in FIGS. 9A and 9B, when each latch 110 is slid inwardly to lock the nozzle assembly 62 to the base 94, the rib 126 cams against the beveled protrusion 124 to guide or move the nozzle assembly 62 rearward, as depicted by the arrows in FIG. 9B, such that it forms a close fit to the frame 52, thereby sealingly engaging the spacer 104 to the grommet 108 as seen in FIG. 4.

Figure 10A:
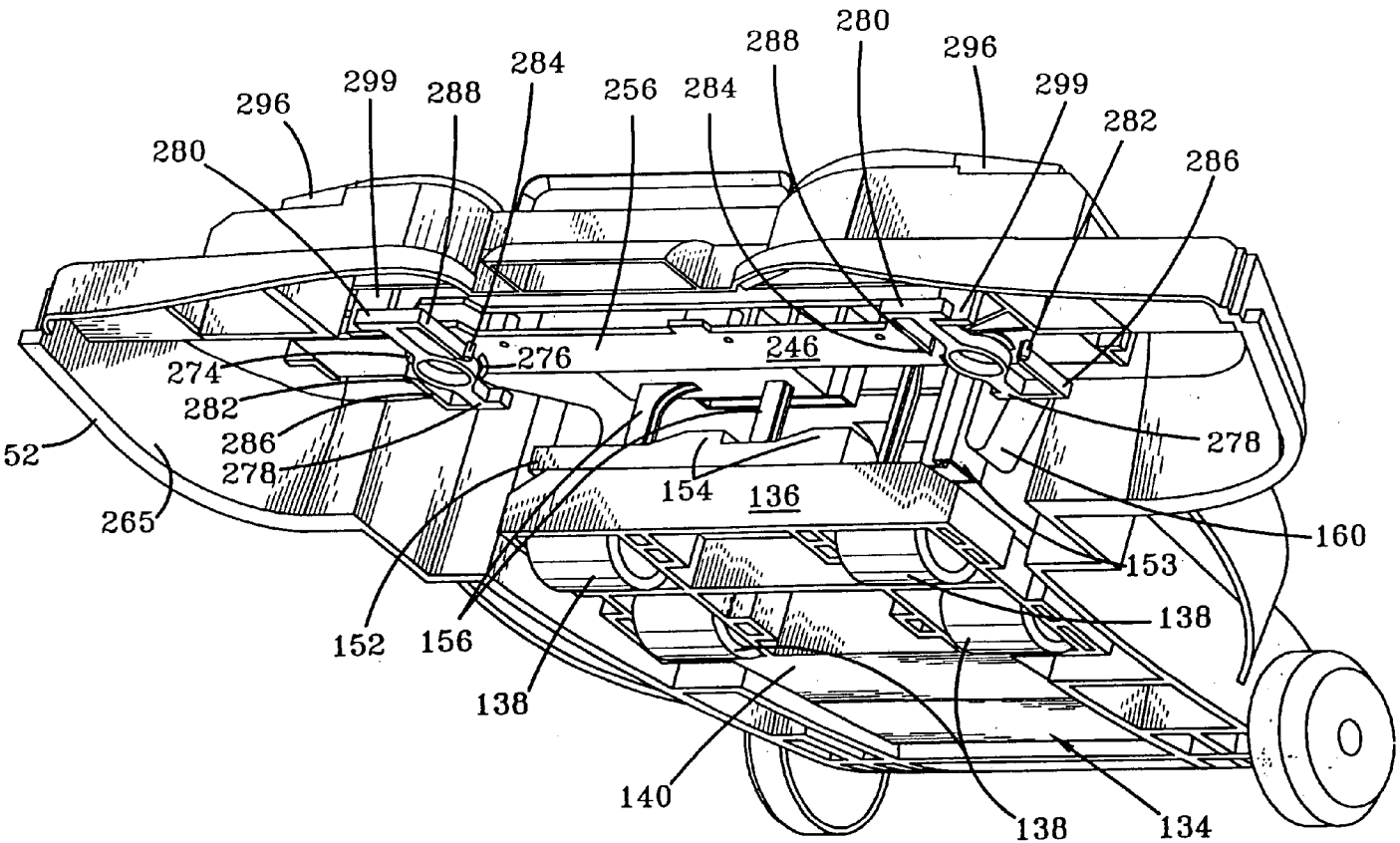
FIG. 10A is a bottom front perspective view of the base assembly of the floor cleaning unit of FIG. 1 with the nozzle assembly and brush block assembly removed for illustrated purposes.
Figure 10B:
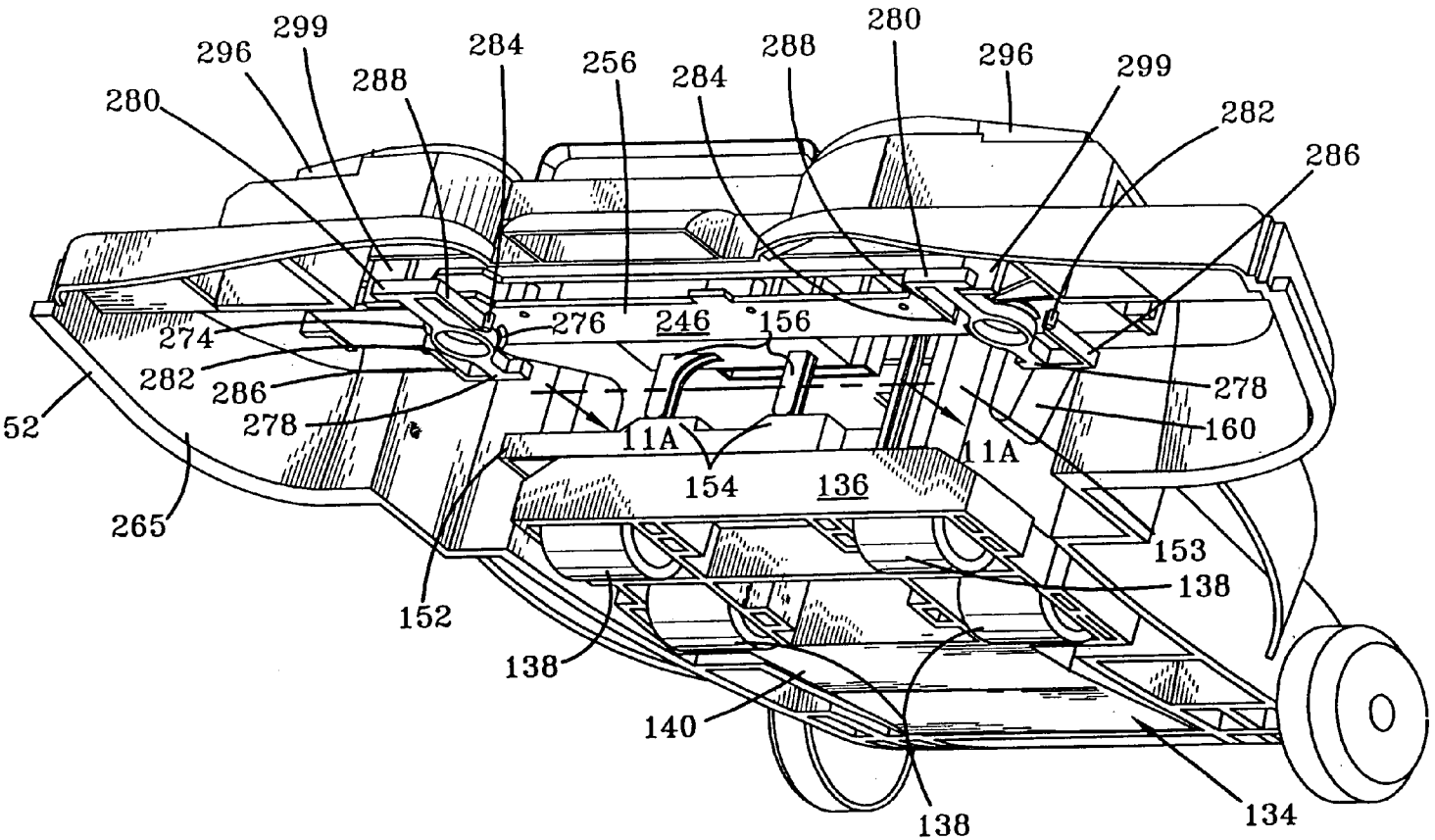
FIG. 10B is a view similar to FIG. 10A but with the wheel carriage pivoted in a position further away from the frame of the base assembly.
Figure 23:
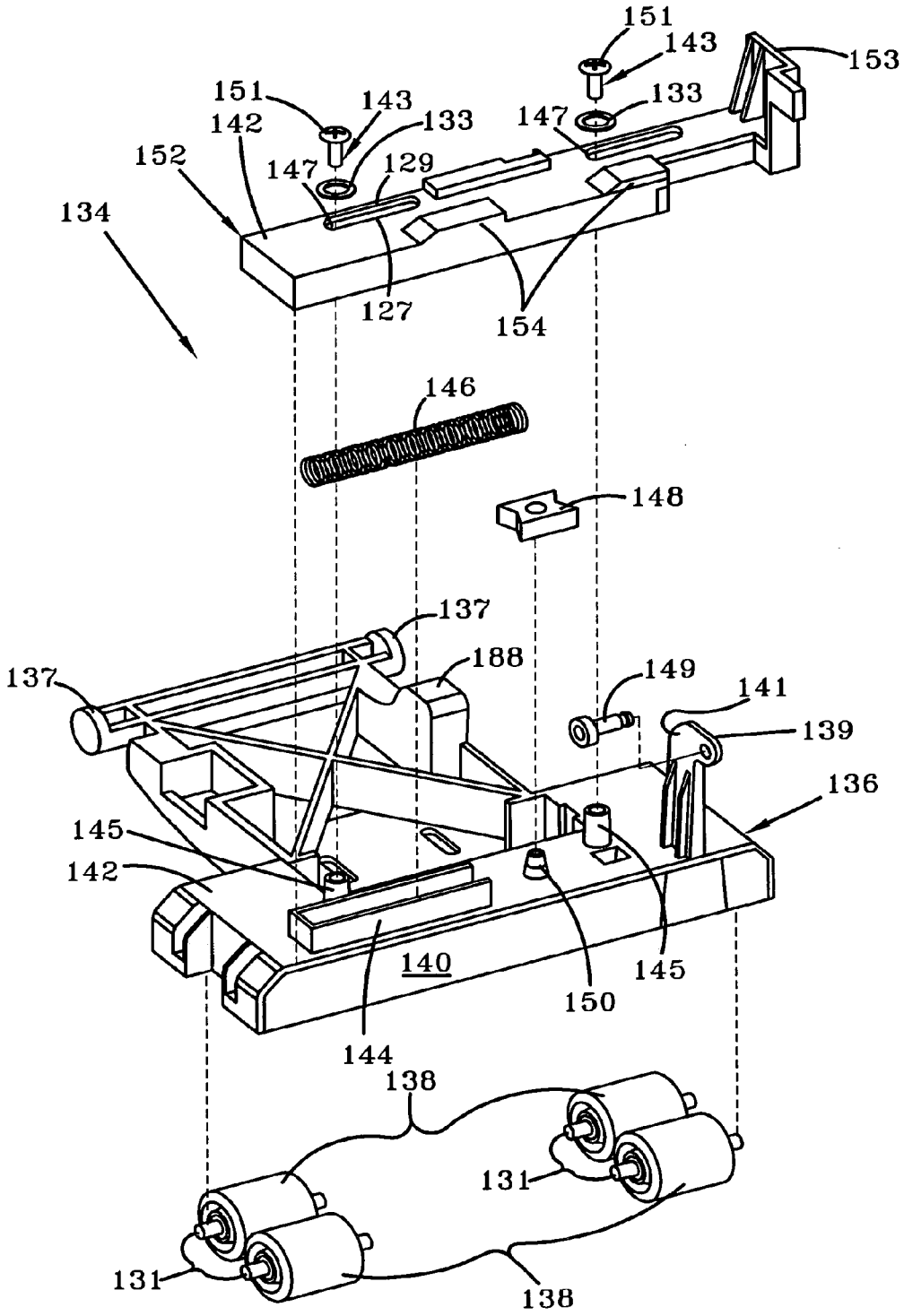
FIG. 23 is a an exploded view of the nozzle lifting assembly of the hard floor cleaning unit of FIG. 1.

Referring to FIGS. 10A, 10B, 11A–C, 13A–C and 23, a lifting mechanism 134 raises and lowers the nozzle assembly 62 (FIG. 6) for use in respective dry and wet modes. As depicted in FIGS. 10A and 10B, the lifting mechanism 134 includes a wheel carriage assembly 136 positioned in a complimentary recessed area formed in the bottom side of the frame 52 and pivotally connected at the rearward end of the recessed area by trunnions 137 (FIG. 23).

Referring to FIG. 23, the wheel carriage assembly 136 also includes two pairs of wheels 138 in contact with the floor with each pair riding on stainless steel axles 131 that are snapped into the bottom of the base 140 of the wheel carriage assembly 136 about a horizontal axis. The wheels 138 have soft over molded treads to prevent scratching on various floor surfaces. Further, adjacent front and rear wheels 138 are spaced from each other to keep the nozzle level when traveling over uneven portions of the floor such as grout lines. The top side 142 of the base 140 of the wheel carriage assembly 136 has a raised unshaped frame 144 for securely receiving a coiled compression spring 146. An arm is integrally formed with the top side 142 of the base 140 and extends upwardly. A rotor 148 is rotatably connected to the top side 142 of the base 140 through a boss or bearing 150.

A slide block 152 is slidably mounted to the top side 142 of the base 140 by screws 143 extending through a pair of elongated longitudinal slots 147 and threading into a pair of bosses 145. The screws 143 extend through washers 133, which are positioned between the slide block 152 and heads 151 of the screws 143. The washers 133 are secured to the screws 143 by suitable means such as, for example, welding. The washers 133 radially extend beyond the front and rear ends 127, 129 of the slots 147 to secure the slide block 152 to the top side 142 of the base 140. Thus, the slide block slides along the longitudinal axis of the slots 147, yet is secured to the base 140 of the wheel carriage 136. The slide block 152 is fitted over the rotor 148, spring 146 and frame 144 securing them thereto. A pair of ramp portions 154 is formed on the top side 142 of the slide block 152 for camming against a corresponding pair of cam followers 156 (FIGS. 10A and 10B), extending downwardly from the frame 144 of the base assembly 44, depending on the longitudinal position of the slide block 152.

Figure 12:
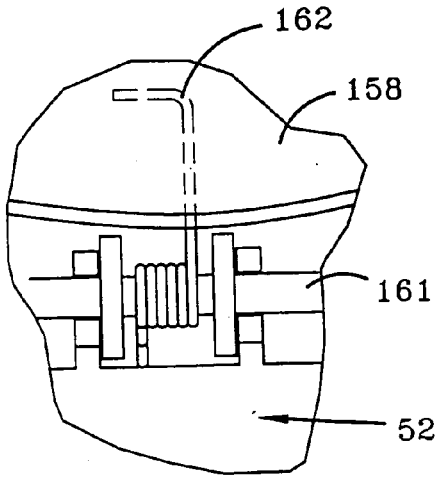
FIG. 12 is a partial sectional view of the left pedal taken along 12—12 of FIG. 11A.
Figure 11A:
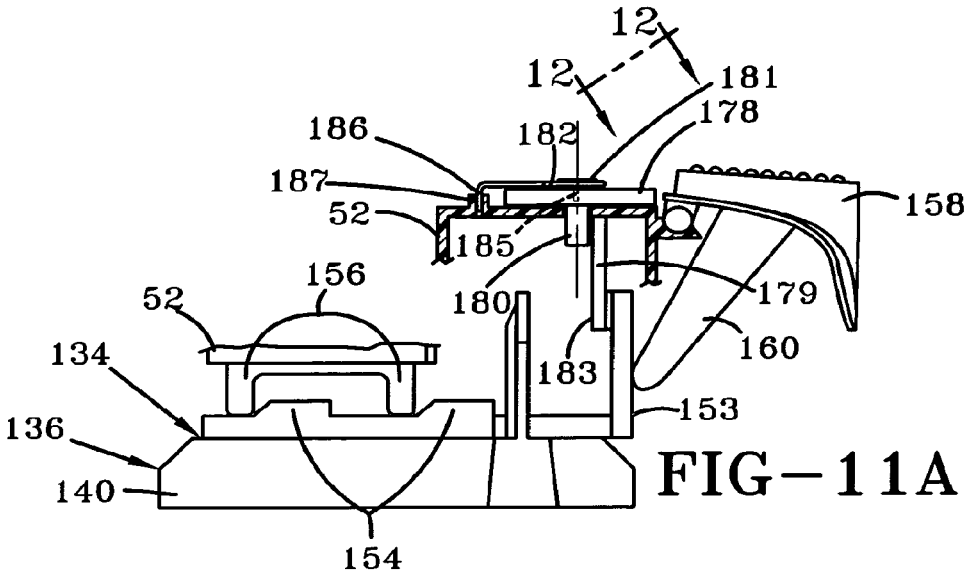
FIG. 11A is a partial sectional view taken along line 11A—11A of FIG. 10B, illustrating the principle elements used to raise and lower the nozzle assembly and brush block assembly of the hard floor cleaning unit of FIG. 1 and to indicate such positions.
Figure 11B:
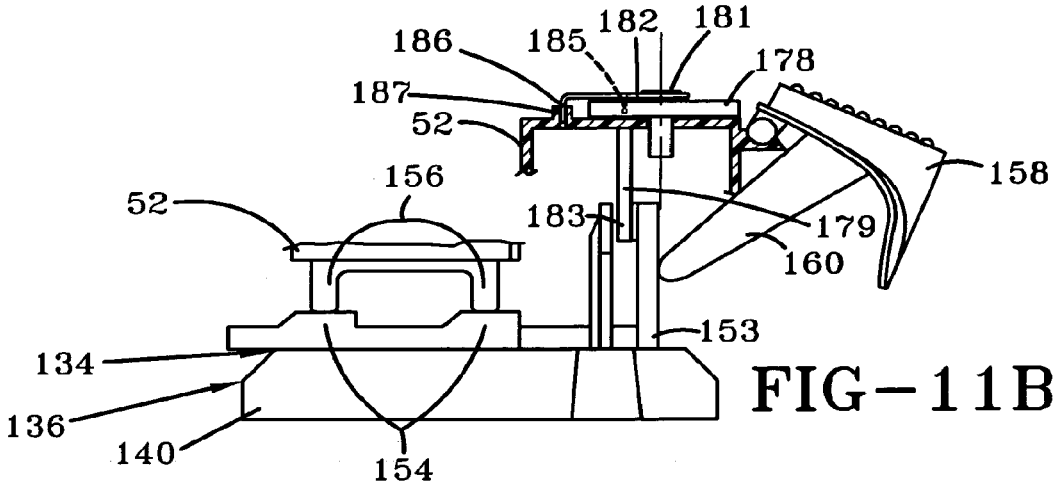
FIG. 11B is a view similar to FIG. 11A but with the left pedal depressed to move the slide block outwardly to raise the nozzle assembly and brush block assembly.
Figure 11C:
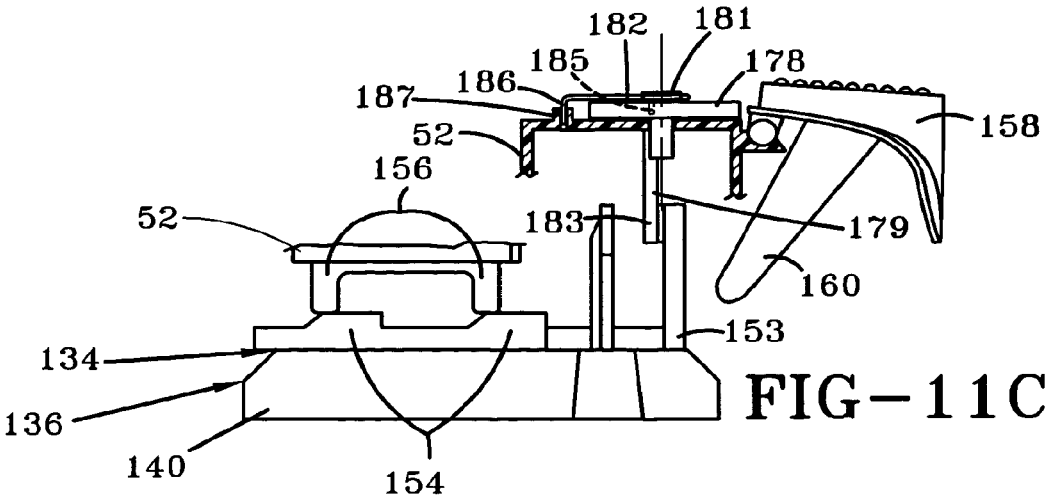
FIG. 11C is a view similar to FIG. 11B but with the left pedal released to allow the spring to move the slide block slightly outward.

As illustrated in FIG. 2C, a foot pedal 158 is hinged to the frame 52 of the base assembly 44 at its inner end and has a leg 160 depending downwardly from the bottom of the pedal 158. A torsion spring 162, secured between the inner end of the foot pedal 158 and frame 52, upwardly biases the foot pedal 158. In particular, as best illustrated in FIG. 12, the torsion spring 162 is inserted around a pin 161 integrally molded to the inner side of the pedal 158. Alternatively, the spring 162 could be seated into a recessed portion of the frame 52 as seen in FIG. 30D. The leg 160 terminates outwardly adjacent a strike member 153 depending upwardly on the left end of the slide block 152 as best illustrated in FIGS. 10A and 11A. Depressing the pedal 158 downwardly rotates the leg 160 to engage the strike member 153 and laterally push the sliding block 152 such that the ramp portions 154 engage the cam followers 156, which ride up the ramp portions 154 as best depicted in FIG. 11B. This action moves the frame 52 upwardly with respect to the wheel carriage assembly 136, pivoting at the rear end of the wheel carriage assembly 136 as depicted in FIG. 10B. Hence, the nozzle assembly 62 is raised off the floor as shown in FIG. 18. As depicted in FIG. 11C, the frame 52 remains in the raised position due to the rotor 148 position, after the pedal 158 is released and urged upwardly back by the torsion spring 162 (FIG. 12). Depressing the pedal 158 again permits the spring 146 (FIG. 23) to move the sliding block 152 back outwardly in the lateral direction so that the cam followers 156 ride down the ramp portions 154 and lower the frame 52 as seen in FIGS. 11A and 10B. Thus, the nozzle assembly 62 lowers on the floor as shown by the phantom lines of FIG. 18.

Figure 13A:
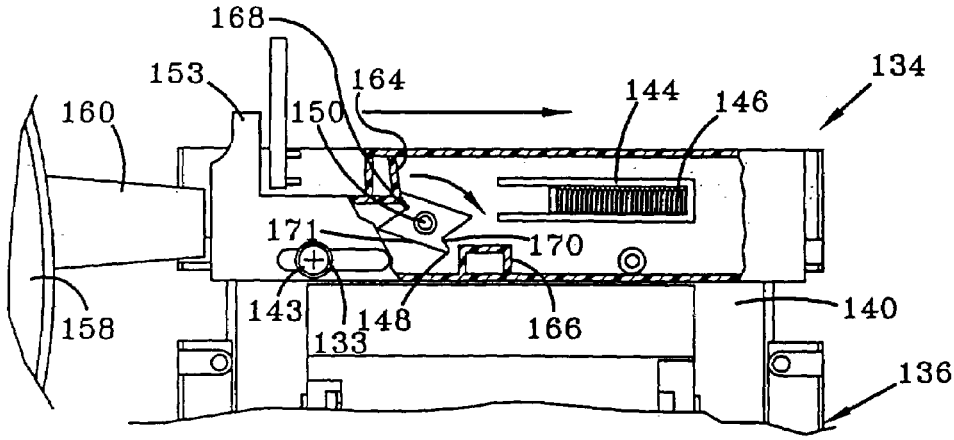
FIG. 13A is a partial sectional top view of the nozzle lifting assembly and left pedal taken horizontally through a portion of the slide block and illustrating the left pedal being depressed to move the slide block inwardly to raise the nozzle assembly.
Figure 13B:
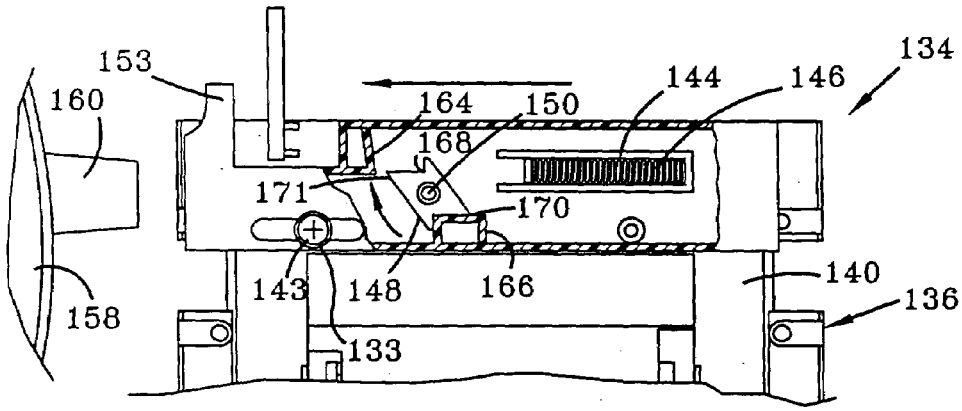
FIG. 13B is a view similar to FIG. 13A but with the left pedal released and the slide block, rotor, and spring in different positions illustrating the results from such action.
Figure 13C:
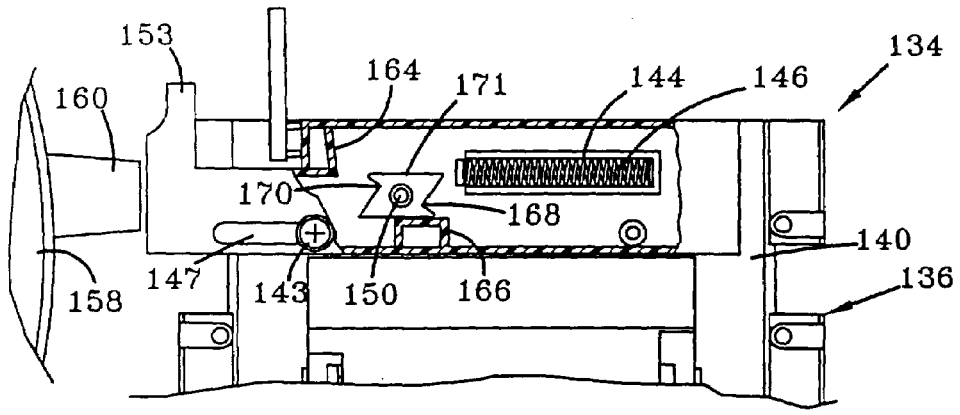
FIG. 13C is a view similar to FIG. 13A but with the slide block, rotor, and spring in different positions, indicative of the nozzle assembly being lowered.

In particular, as illustrated in FIGS. 13A, 13B, and 13C, the rotor 148 engages respective front and rear rib cages 164, 166 formed on the underside of the sliding block 152 to perform these actions. Specifically, as depicted in FIG. 13A, when the leg 160 of the pedal 158, upon being depressed, pushes the sliding block 152 laterally inward to raise the nozzle assembly 62 (FIG. 18), the front rib cage 164 will engage a first notch 168 on the rotor 148 to rotate the rotor 148. The rotor 148 is rotated until a second notch 170 of the rotor 148 engages the rear rib cage 166 as depicted in FIG. 13B. When the pedal 158 is released, which disengages the leg 160 from the strike member 153, the coiled compression spring 146 moves the slide block 152 back slightly so that the rear rib cage 166 rotates the rotor 148 so that the front rib cage 164 is aligned with the outer side 171 of the rotor 148 between the notches, 168, 170. In this position the engagement of the rear rib cage 166 with the second notch 170 prevents further rotation of rotor 148.

Depressing the pedal 158 again, moves the slide block 152 inwardly such that the rear rib cage 166 moves out of the way of the second notch 170 and the front rib cage 164 engages the outer side 171 of the rotor 148 rotating it such that the second notch 170 rotates past the rear rib cage 166. At this position as shown in FIG. 13C, there is no interference to prevent the slide block 152 from moving back to its original position. Thus, upon releasing the pedal 158, the coiled compression spring 146 moves the slide block 152 outward. This action lowers the nozzle assembly 62 as depicted by the phantom lines in FIG. 18. It should be apparent that upon depressing the pedal 158 again to raise the nozzle assembly 62, the front rib cage 164 now engages the second notch 170 and the first notch 168 engages the rear rib cage 166 but in all other aspects the raising and lowering operation will be similar, since the notches are similarly shaped. Alternatively, a pin index mechanism could be substituted for the rotor 148.

As depicted in FIGS. 1 and 2C, a hood or cover 172 snap fits onto the frame 52 and includes dry mode and wet mode openings or windows 174 and 176, respectively, for viewing a colored area on the top surface of an indicator plate 178 (FIG. 2B) to inform the user that the hard floor cleaner is in either the dry mode or wet mode. In particular as shown in FIG. 2B, the indicator plate 178 is spring loaded and rotatably connected on the frame via an integrally formed pin 180 (FIGS. 11A–C) extending downwardly through an aperture in the frame 52 near the left side of the frame 52 rearwardly adjacent the nozzle assembly 62. The indicator plate 178 further includes a downwardly depending leg 179 extending through a curved guide slot 184 formed in the frame 52. A torsion spring 182 is inserted around a raised hub portion 181 integrally molded on the top of the indicator plate 178.

Referring to FIGS. 11A–C, the spring has its front end 186 extending into a protrusion 187 formed on top of the frame 52 and its rear end 185 extending into a rear aperture in the indicator plate 178 of the spring. With this arrangement, the spring 182 urges the leg 179 of the indicator plate 178 inwardly against an upper inner offset portion 183 of the striking portion 153 on the left end of the slide block 152. In operation, when the slide block 152 moves laterally inward to raise the nozzle assembly 62 (FIG. 18), the leg 179, urged by the spring 182, slides inwardly along the curved guide slot 184 to the position shown in FIG. 11C. Hence, the indicator plate 178 rotates to the position shown in FIG. 30A such that the colored area of the indicator plate 178 is positioned under the dry mode opening 174 (FIG. 1). When the slide block 152 is moved laterally outward to lower the nozzle assembly 62 (FIG. 18), the leg 179, urged by the spring 182, slides outwardly along the curved guide slot 184 to the position shown in FIG. 11A thereby rotating the indicator plate 178 to the position shown in FIG. 30B such that the colored area of the indicator plate 178 is positioned under the wet mode opening 176. Alternatively, as depicted in FIG. 30D, a compression spring 182' with one end inserted round the hub portion 181 of indicator plate 178 and the other end inserted around the protrusion 187 could be used instead of the torsion spring 182.

Figure 16:
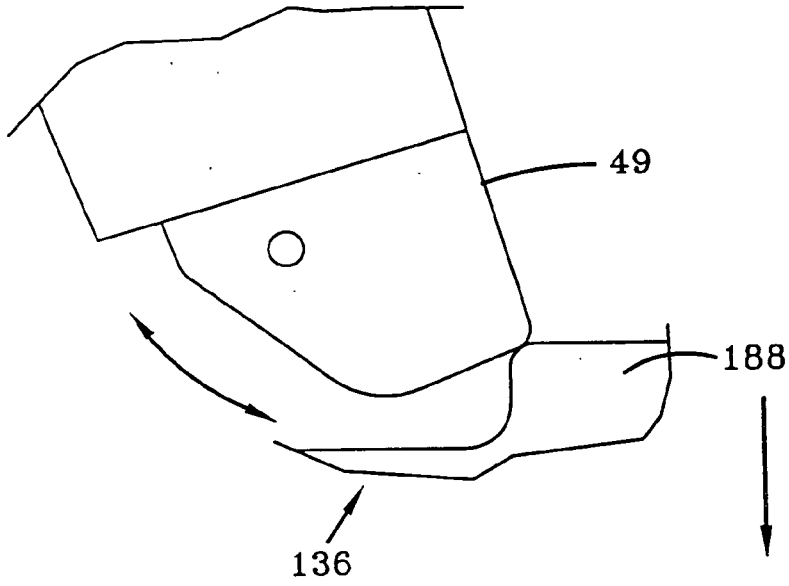
FIG. 16 is a an elevational view taken along line 16—16 of FIG. 14B.

Also, the nozzle assembly 62 is raised when the handle assembly 42 is pivoted in the upright position to prevent deformation of the squeegee 66 during storage as depicted by the phantom lines in FIG. 4. Specifically as depicted in FIG. 2C, the left ear 49 extending from the bottom of the handle assembly 42 interfaces with a raised left cam member 188 on the top of the wheel carriage assembly 136. In operation, as depicted in FIG. 16, when the handle assembly 42 is pivoted in the upright position, the ear 49 cams against the cam member 188 to raise the frame 52 (FIG. 2C) from the wheel carriage 136.

Figure 15A:
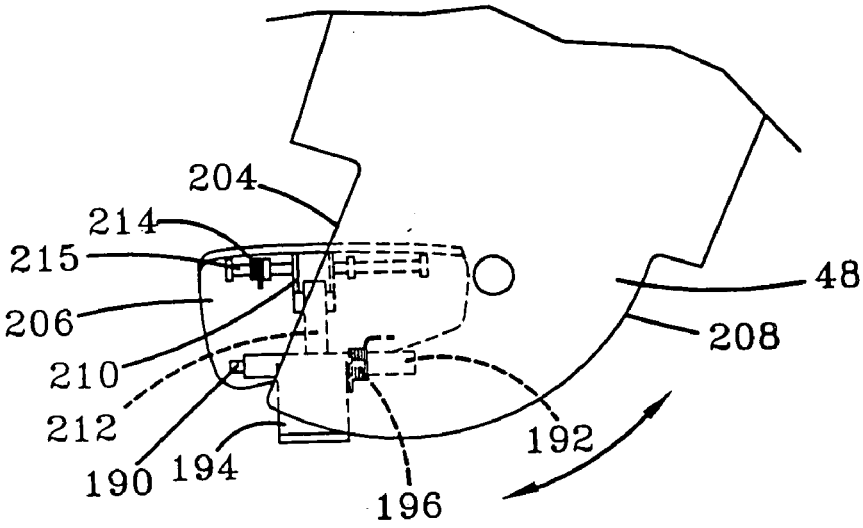
FIG. 15A is an elevational view taken along line 15A—15A of FIG. 14B.
Figure 15B:
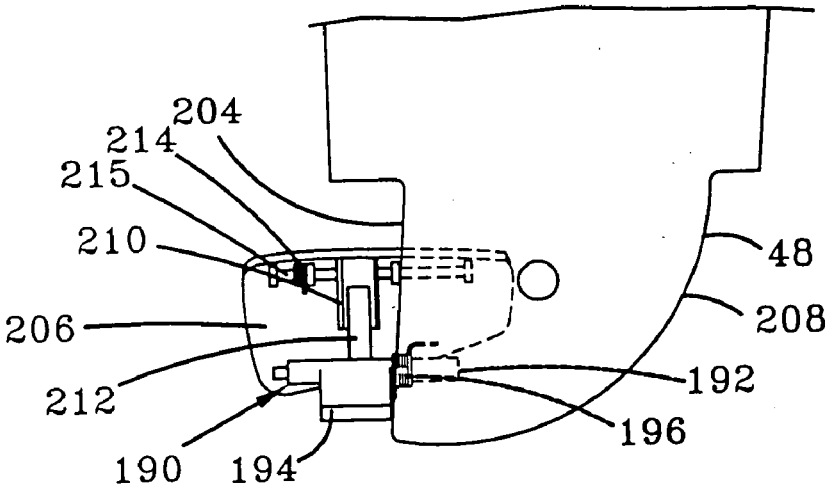
FIG. 15B is a view similar to 15A but with the handle assembly locked in the upright position.

As depicted in FIG. 2C, a lock plate 190 is pivotally connected to the frame 52 via a central lever 192 and includes an inwardly extending stop member 194 to prevent the handle assembly 42 from inadvertently pivoting back down. In particular, with reference to FIGS. 15A and 15B, a torsion spring 196, inserted around the lever 198, is secured between the frame 52 and lock plate 190 and biases the stop member 194 to extend inwardly and abut the right ear 48. As the handle assembly 42 is raised as shown in FIG. 15A, the curved portion 208 of the right ear 48 cams against the stop member 194 deflecting it downwardly until the stop member 194 catches the flat front side 204 of the right ear 48. At this position as shown in FIG. 15B, the stop member 194 is flexed back from the biasing force of the spring 196 and laterally abuts the straight front side 204 of the right ear 48, preventing the handle assembly 42 from moving back down. The front side of the lock plate 190 interfaces with the frame 52 providing a limit for twisting or deflection of the handle assembly 42. This places the lock plate 190 in compression.

Figure 14A:
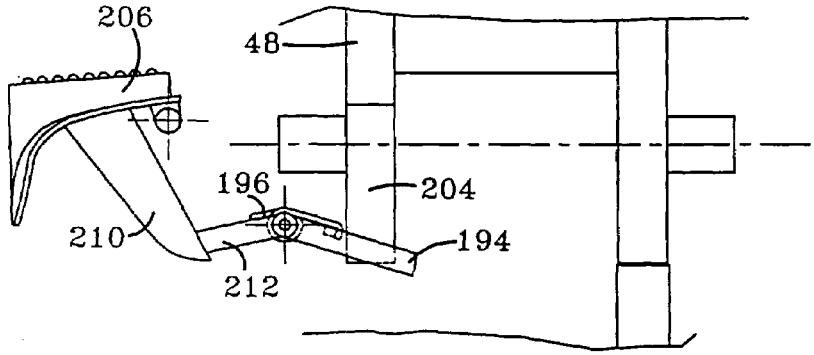
FIG. 14A is a partial front elevational view of the right handle release pedal, lock plate, lower portion of the handle assembly, and other elements of the hard floor cleaning unit of FIG. 1 used to releasably lock the handle assembly in the upright position.
Figure 14B:
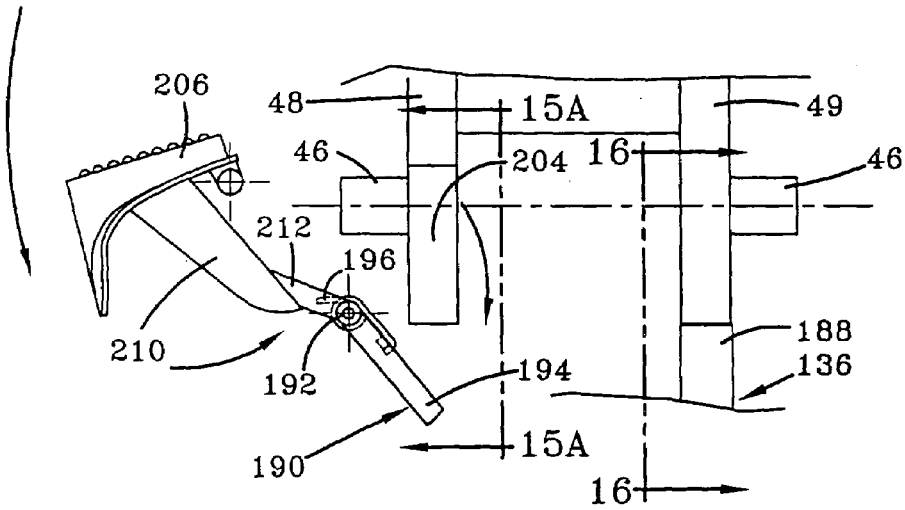
FIG. 14B is a view similar to 14A but with the right handle release pedal depressed to pivot the lock plate away from the right ear of the handle assembly.

As shown in FIG. 2C, a handle release pedal 206, hinged to the frame 52 at its inner end, is provided to move the stop member 194 out of the way of the right ear 48 to allow the handle assembly 42 to pivot downwardly. In particular, as best illustrated in FIGS. 14A and 14B, upon depressing the pedal 206, a downwardly depending leg 210 of the pedal 206 cams upwardly against an outwardly extending tongue member 212 of the lock plate 190, thereby pivoting the stop member 194 downwardly and outwardly away from the right ear 48. Thus, the handle assembly 42 is free to pivot downward and lower. A torsion spring 214, secured between the inner end of the foot pedal 206 and frame 52 (FIG. 2C), urges the handle release pedal 206 back up to its original position. In particular, as best illustrated in FIG. 15B, the torsion spring 214 is inserted around a pin 215 integrally molded to the inner side of the pedal 206. Alternatively, the spring 214 could be seated into a recessed portion of the frame 52.

Figure 19:
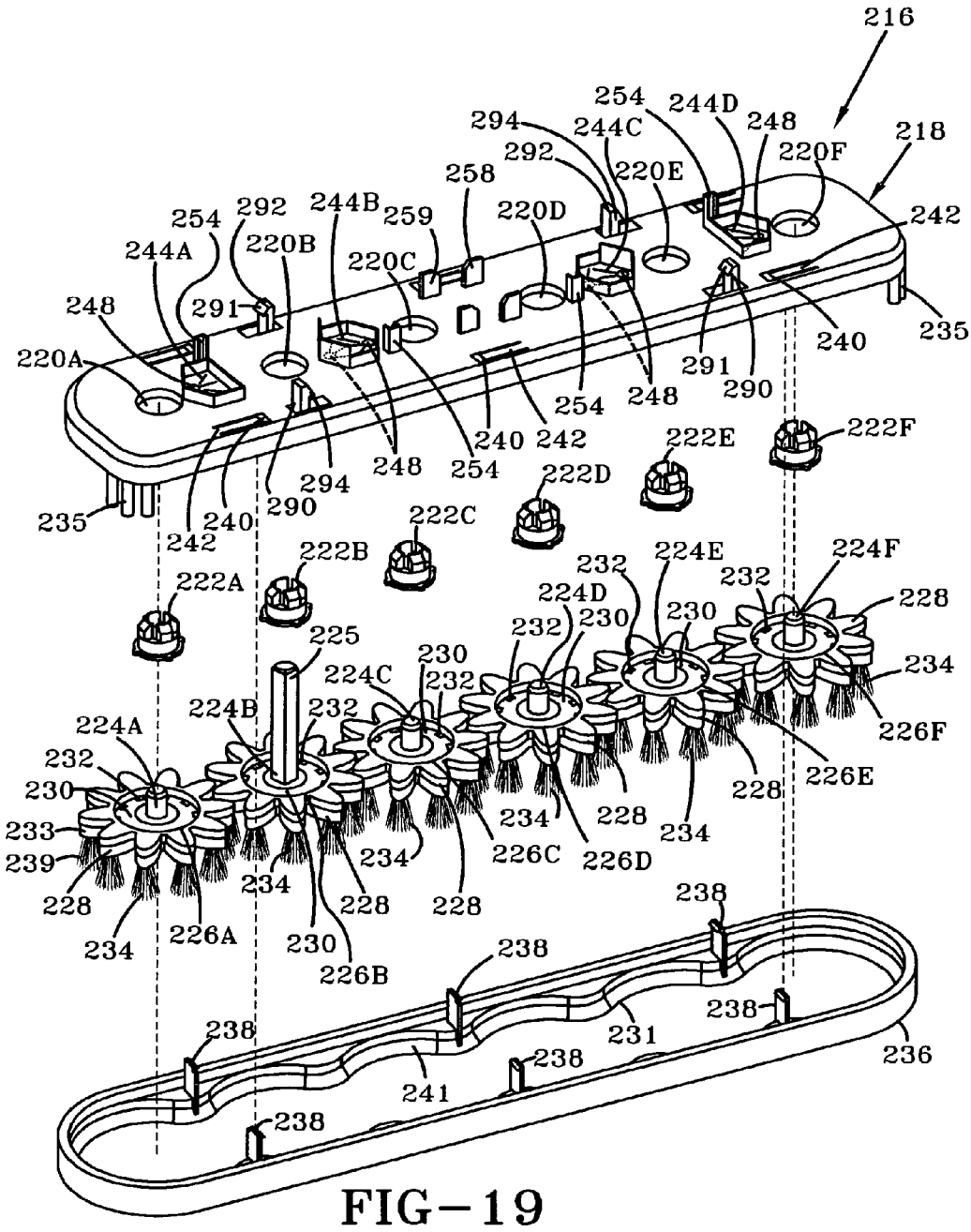
FIG. 19 is an exploded view of the brush block assembly of the hard floor cleaning unit of FIG. 1.

As depicted in FIG. 2A, a brush block assembly 216 is removably secured to the base assembly 44 for agitating the surface to be clean. In particular, as depicted in FIG. 19, the brush block assembly 216 comprises a brush support plate 218 having six spaced apart openings 220A, 220B, 220C, 220D, 220E, and 220F. Fixedly received within the openings 220 are bushings 222A, 222B, 222C, 222D, 222E, and 222F which in turn rotatingly receive axial shafts 224A, 224B, 224C, 224D, 224E, and 224F of gear brushes 226A, 226B, 226C, 226D, 226E, and 226F. The gear brushes 226A–F rotate on a vertical axis. A drive shaft 225 having a square cross section is welded to the axial shaft 224B of the gear brush 226B adjacent the right outer brush 226B. Each of the gear brushes 226 is basically configured as a spur gear having ten teeth 228 that intermesh such that when one gear brush 226 rotates, all other gear brushes 226 rotate accordingly. The center hub of gear brushes 226 forms a hollow downwardly projecting center cup 230 having a multiplicity of openings 232 circumscribing the bottom thereof.

During manufacturing of the brush assembly 216, the gear brush axial shafts 224 are first inserted into the appropriate bushing 222 and with gear brushes 226 in their uppermost position and, with gear teeth 228 intermeshed between the gears brushes 226. Each gear tooth 228 has a blind bore, extending to offset 233 into which bristle bundles 234 are compressively inserted. Bristle bundles 235 are also compressively inserted into the front corners of the brush support plate 218 for edge cleaning.

Further, as seen in FIG. 17, closely packed bristle bundles 237 are also compressively inserted into blind bores located in the center of each of the gear brushes 226 for added agitation and cleaning in the middle of the gear brush 226. Specifically, an outer ring of nine bristle bundles 237 concentrically surrounds an inner ring of five bristle bundles 237. The spacing of adjacent bristle bundles 237 located in the center of the gear is shorter than the bristle bundles 234 in the offset 233. The center bristle bundles 237 provide several features. They support the brush block assembly 216, preventing it from tilting, thereby promoting the application of even pressure on the floor from all of the bristle bundles 234, 235, and 237. Such support also significantly reduces the deflection or bending of the outer bristle bundles, thereby significant minimizing the spraying or splattering of the cleaning solution from them. They further add to the brush or bristle density of the brush block assembly 216, thereby providing more scrubbing on the floor. Each bristle 239 is crimped instead of straight so that when the bundles are formed, more scrubbing coverage is provided. Such crimping on the bristles in the bundles also reduces deflection of the bristles as they scrub, thereby minimizing the spraying or splattering of cleaning solution from the bristles.

Referring back to FIG. 19, a gear guard 236 snap fits into a brush support plate 218. Specifically, upwardly extending locking tabs 238 on the gear guard 236 catch onto steps 240 integrally molded to the lower surface of the brush support plate 218. During assembly of the gear guard 236 to the brush support plate 218, the locking tabs 238 deflect laterally extending cantilevered tangs 242 integrally formed in the brush support plate 218 to allow the locking tabs 238 to extend therethrough. The tangs 242 will then flex back to their initial position, closely adjacent the locking tabs 238, to prevent the locking tabs 238 from disengaging off of the steps 240.

With continue reference to FIG. 19, the brush support plate 218 includes a plurality of troughs 244A, 244B, 244C, 244D for receiving the cleaning solution that flows from a distributor 246 (FIG. 2A) positioned thereon. Cleaning solution received in the troughs 244 flows through openings 248 in them and into the center cups 230 of the brushes 226. Once deposited within the center cup 230, the cleaning solution flows outward toward the surface being cleaned through openings 232 in the bottom of the center cups 230. The center cups 230 contain the cleaning solution as the gear brushes 226 rotate and thus prevent solution from being sprayed outward over the top of the gear brush. The gear guard 236 is designed to withstand impact and prohibit cleaning solution from resting on its inner lip 231. In particular, the bottom surface 241 of the inner lip 231 inclines downwardly to the edge of the inner lip 231 to direct the flow of cleaning solution off the inner lip 231.

Figure 17A:
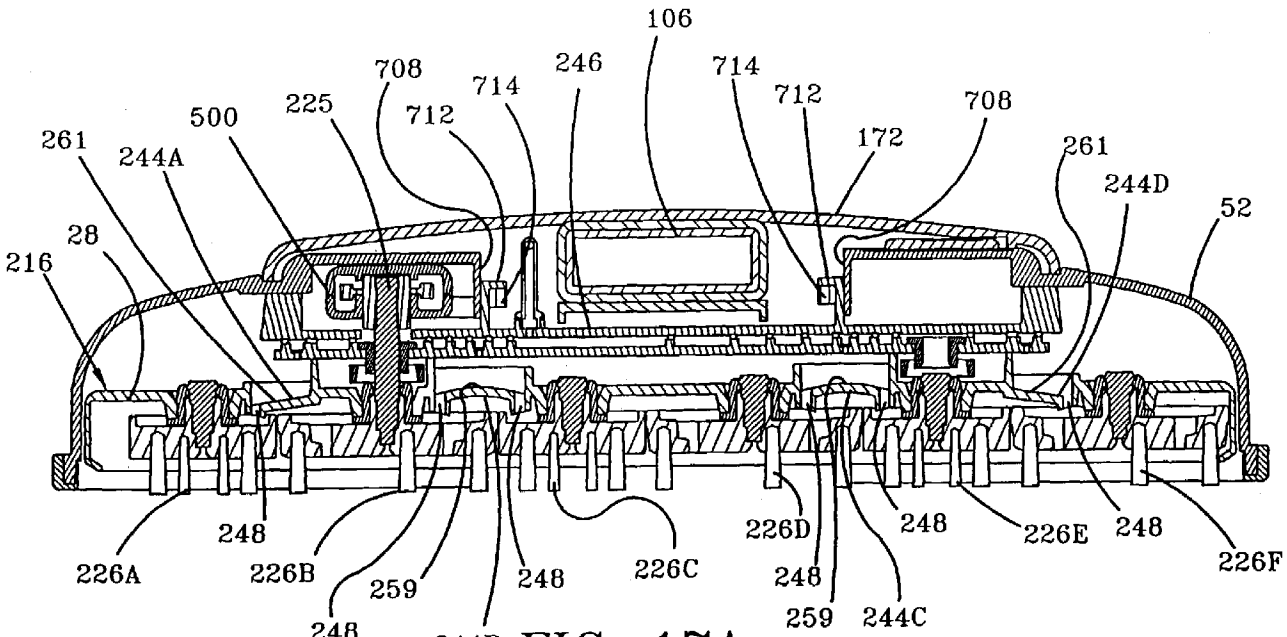
FIG. 17A is a sectional view taken along line 17A—17A of FIG. 17.

Further, as depicted in FIG. 17A, the bottom side 259 of each of the two inner troughs 244B, 244C is gabled or convexly curved from left to right to direct the flow of cleaning solution to the openings 248. The bottom side 261 of each of the outer troughs 244A, 244D is inclined downwardly to the opening 248 to also direct the flow of cleaning solution to the opening 248. As depicted in FIG. 2A, the distributor 246 is positioned on the brush support plate 218 and includes respective upper and lower plates 250, 252 sealingly secured to each other by, for example, hot plate welding them together. The brush support plate 218 includes respective front and rear stop members 254, 255 positioned closely adjacent the front and rear ends of the distributor 246 to limit the front and rear lateral movement of the brush block assembly 216 with respect to the distributor 246. Additionally, front and rear lateral extensions 256 (FIG. 22) of the lower plate 252 are seated between adjacent right and left center stop members 257, 258, respectively to aid in minimizing lateral movement of the brush block assembly 216 along its longitudinal axis with respect to the distributor 246.

Figure 21:
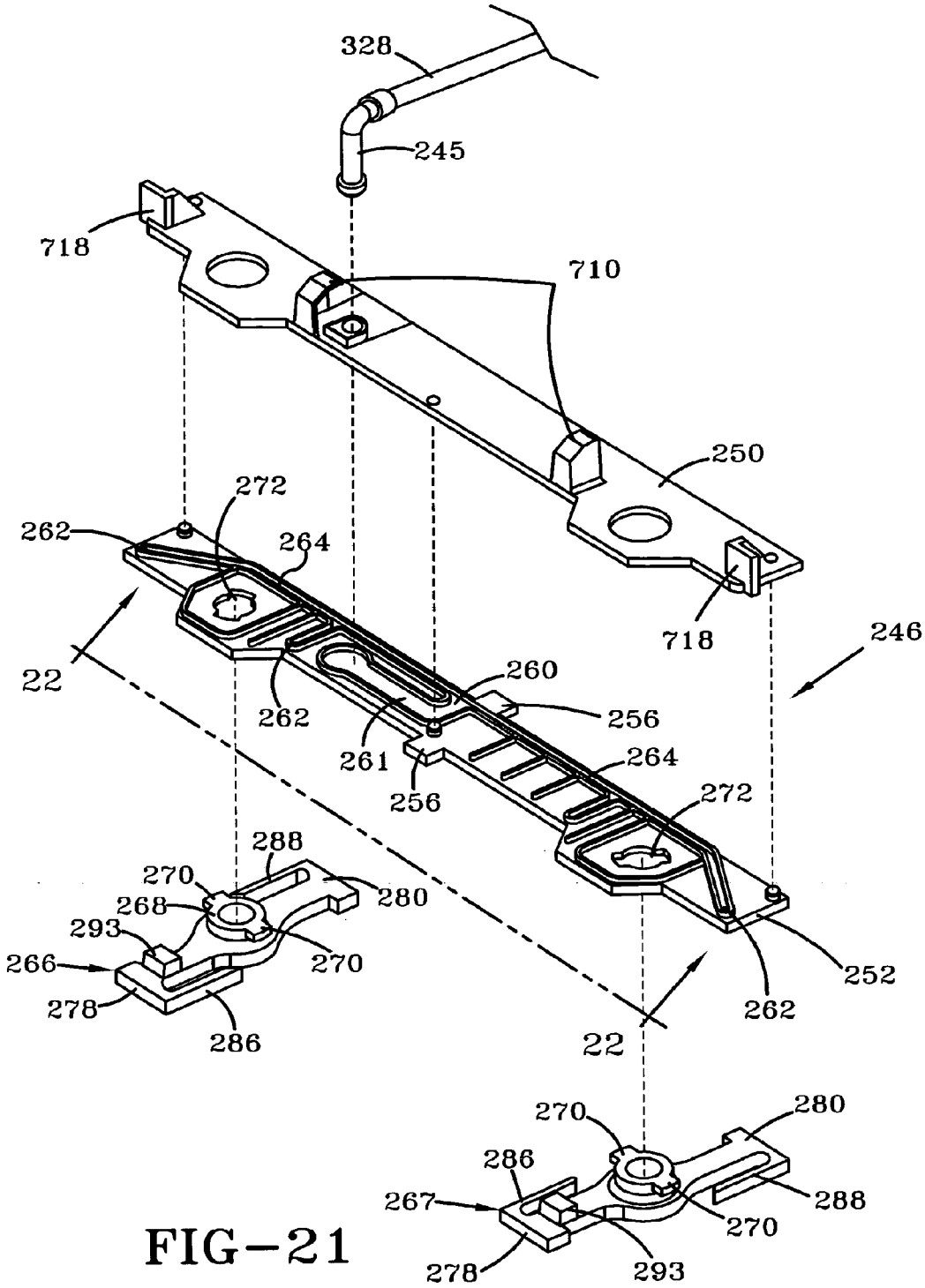
FIG. 21 is an exploded view of the distributor with latches of the hard floor cleaning unit of FIG. 1.

Referring to FIG. 21, the lower plate 252 of the distributor 246 has a channel 260 with orifices 262 formed therein. The orifices are aligned over the troughs 244 of the brush support plate 218. The upper plate 250 includes a tubular elbow connector 245 welded onto the upper surface of the upper plate 250. The elbow connector 245 is fluidly connected to the distributor supply hose 328. The outlet of the elbow connector 245 is aligned over a rear branch 261 of the channel of the lower plate 252. Cleaning solution flows from the supply hose 328 through the elbow connector 245 to a rear branch 264 of the channel 260 and then through the orifices 262 to the troughs 244 (FIG. 19). A pair of hooks 710 integrally molded with the upper plate 250 of the distributor 246 extends from its upper surface.

Figure 22:
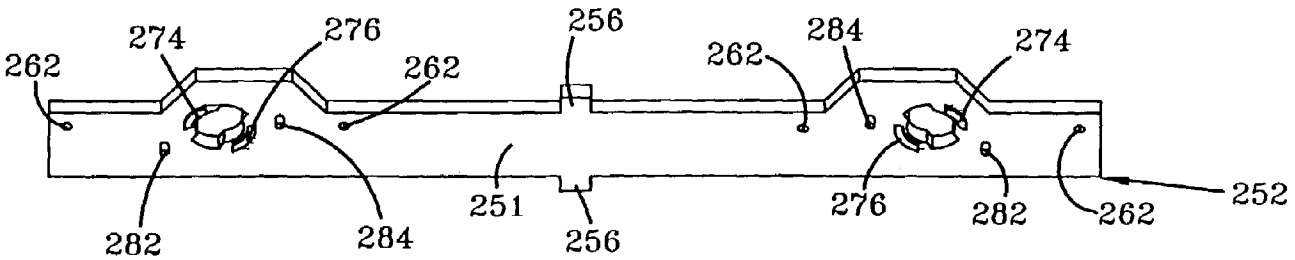
FIG. 22 is an elevational view taken along line 22—22 of FIG. 21.

As depicted in FIG. 2A, the brush block assembly 216 is removably connected to the distributor 246 and both are received in a complementary cavity 265 formed on the underside of the frame 52 rearwardly adjacent the nozzle assembly 62. The hooks 710 of the distributor 246 hang onto forwardly extending arms 714 of a brush lifting lever 718 which is positioned on the frame 52, thereby floatingly supporting the distributor 246 and brush block assembly 216 to the frame 52. The mechanism to remove the brush block assembly 216 is described as follows. A pair of latch members 266, 267 are rotatably connected to the lower plate 252. The latches are mirror images with respect to each other, but are similar in all other respects. Thus, similar reference numbers in them will be used to describe similar parts. Referring to FIG. 21, for ease of assembly, each latch member 266 comprises a center circular key portion 268 with opposite extensions 270 that are received in a complimentary slot 272 formed in the lower plate 252. As depicted in FIG. 22, the bottom surface 251 of the lower plate 252 has diagonally opposite front and rear ramps 274, 276 and diagonally opposite protrusions 282, 284 formed thereon.

As best illustrated in FIG. 21, when installed, the key portion 268 is aligned and inserted into slot 272, and the latch member 266 or 267 is turned flexing slightly outward from the lower plate 252 as its upper surface rides up on respective diagonally opposite front and rear ramps 274, 276 (FIG. 22). As depicted in FIGS. 10A and 10B, the latch member 266 or 267 is turned until radially extending opposite front and rear legs 278, 280, respectively, are seated between the vertical walls of their corresponding ramps 274, 276 and front and rear protrusions 282, 284 formed on the lower plate 252. As best illustrated in FIG. 21, the extensions 270 will extend over the lower surface of the lower plate 252 interlocking the latch member 266 or 267 to the lower plate 252 thereby preventing it from vertically separating from the lower plate 252 and riding up over the ramps 274, 276 (FIG. 22). Each of the front legs 278 has a nub 293 integrally molded on its upper surface. The front and rear legs 278, 280 also have respective front and rear elastic L-shaped fingers 286, 288 extending inwardly from the distal ends of the legs and located on diagonally opposite ends of the latch member 266 or 267. As seen in FIGS. 10A and 10B, the fingers 286, 288 abut the respective protrusions 282, 284 thereby providing a biasing force. Thus, the elasticity of the fingers 286, 288 will allow the latch member 266 or 267 to rotate when sufficient lateral force is applied to overcome the biasing force of the fingers 286, 288.

Figure 20A:
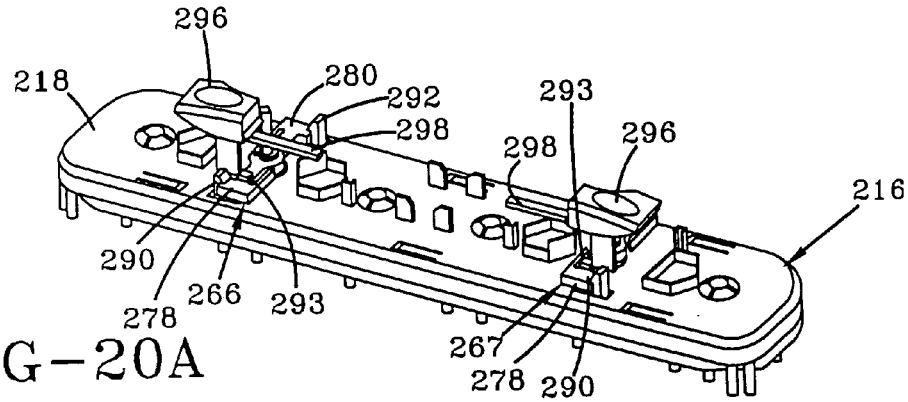
FIG. 20A is a front top perspective view of the brush block assembly with the latches and push buttons assembled for removing the brush block assembly.
Figure 20B:
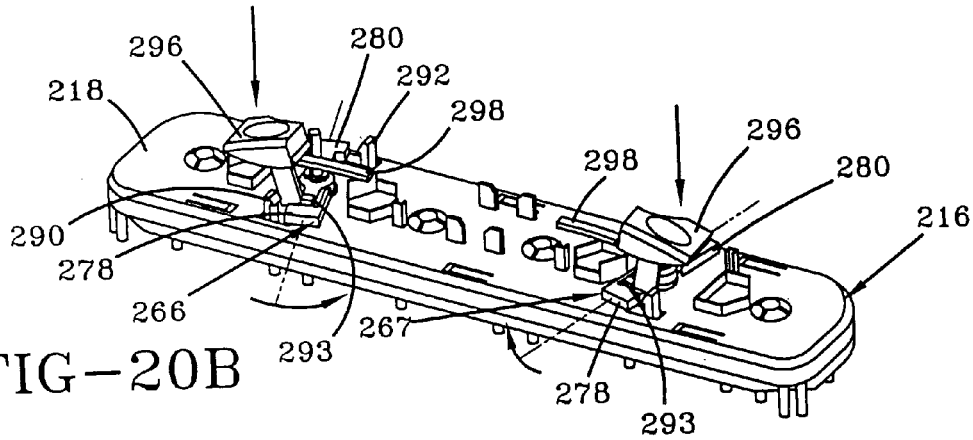
FIG. 20B is a view similar to FIG. 20A but with the push button depressed and the latches disengaged from the brush block assembly.
Figure 20C:
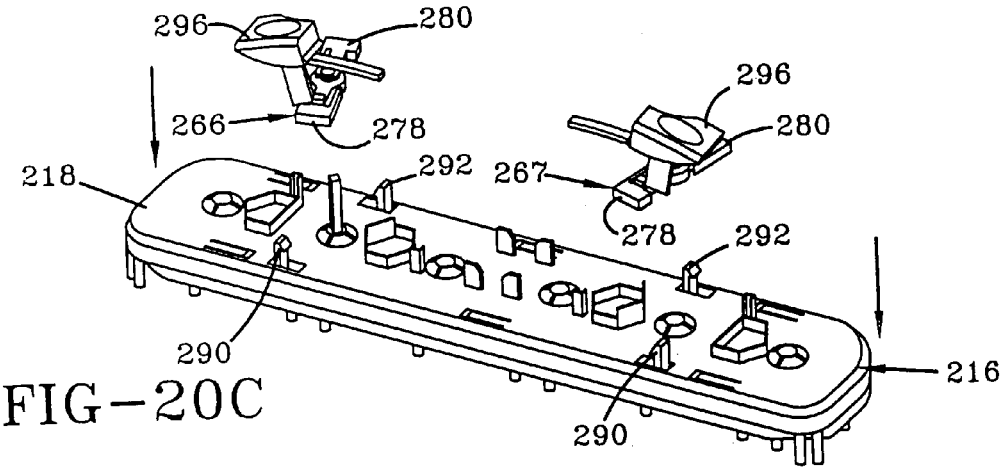
FIG. 20C is a view similar to FIG. 20B but with the brush block assembly separated from the latches.

As depicted in FIG. 19, the brush support plate 218 includes two pairs of integrally molded front and rear hook members 290, 292 extending upwardly from its upper surface. The nose 291 of the front hook member 290 is oriented inwardly and the nose 291 of the rear member 292 is oriented outwardly, opposite to that of the front hook member 290. As best illustrated in FIGS. 20A, 20B, and 20C, each pair is associated with a latch member 266 or 267. The front and rear hook members 290, 292 slidingly engage the upper surface of front and rear legs 278, 280, respectively. The front and rear hook members 290, 292 associated with each latch member 266 or 267 are also located diagonally across from each other.

Referring to FIG. 2B, a pair of push buttons 296 is used to disengage the hook members 290, 292 from the latch members 266, 267. In particular, each button 296 is hinged to the frame 52 by a pin 297 integrally molded on the inner end of the button 296 with respect to the frame 52. Each button 296 further includes an integrally molded cantilevered finger 298 extending laterally inward from the inner end. A cap 295 snap fits on the frame 52 over the finger 298 and pin 297 thereby securing the button 296 to the frame 52. The finger 298 biases the button 296 upwardly. The button 296 has a leg 299 depending downwardly with respect to the frame 52 from the underside of the button 296. As best depicted in FIGS. 20A and 20B, the leg 299 terminates adjacent the outer side of the nub 293 of the front leg 278 of the latch member 266 or 267. The nub 293 ensures that the leg 299 engages the latch member 266 or 267 when the button 296 is depressed. Thus, as shown in FIG. 20B, when each button 296 is depressed with sufficient force to overcome the biasing force of the finger 298 of the button 296, it pivots about the pin 297 and moves the leg 299 of the button 296 inwardly. The movement of leg 299 inwardly moves the latch member 266 or 267 to laterally rotate in a direction such that its front and rear legs 278, 280, respectively, slidingly disengage from their respective hooks, when sufficient lateral force is imparted to the front leg 278 of the latch member 266 or 267 to overcome the biasing force of the fingers 286, 288 (FIG. 21) of the latch member 266 or 267.

Thus, as illustrated in FIG. 20C, upon such disengagement, the brush block assembly 216 freely falls out of the cavity 265 (FIG. 2A) by gravity. When the buttons 296 are no longer depressed, the biasing force from the fingers 286, 288 of the latch members 266, 267 and fingers 298 of the buttons 296 cause the buttons 296 and latch members 266, 267 to return to their initial positions. As best illustrated in FIG. 2A, the brush block assembly 216 is reinstalled to the latch members 266, 267 by simply positioning the brush block assembly 216 in the cavity, aligning the drive shaft 225 with the gear opening of a brush motor assembly 500, and pushing the brush block assembly 216 upwardly until the hook members 290, 292 catch or engage the legs 278, 280 of the latch members 266, 267. In particular, each of the hook members 290, 292 includes an incline portion 291 (FIG. 19) on each of their noses 294 (FIG. 19) that rides along its corresponding leg 278 or 280, thereby rotating each of the legs 278, 280 away from the nose 294 allowing the nose 294 to pass through. After the nose 294 passes through, the biasing force of the fingers 286, 288 will rotate the latch so that the legs slidingly engage the hook members. 290, 292 underneath the nose 294.

Figure 24:
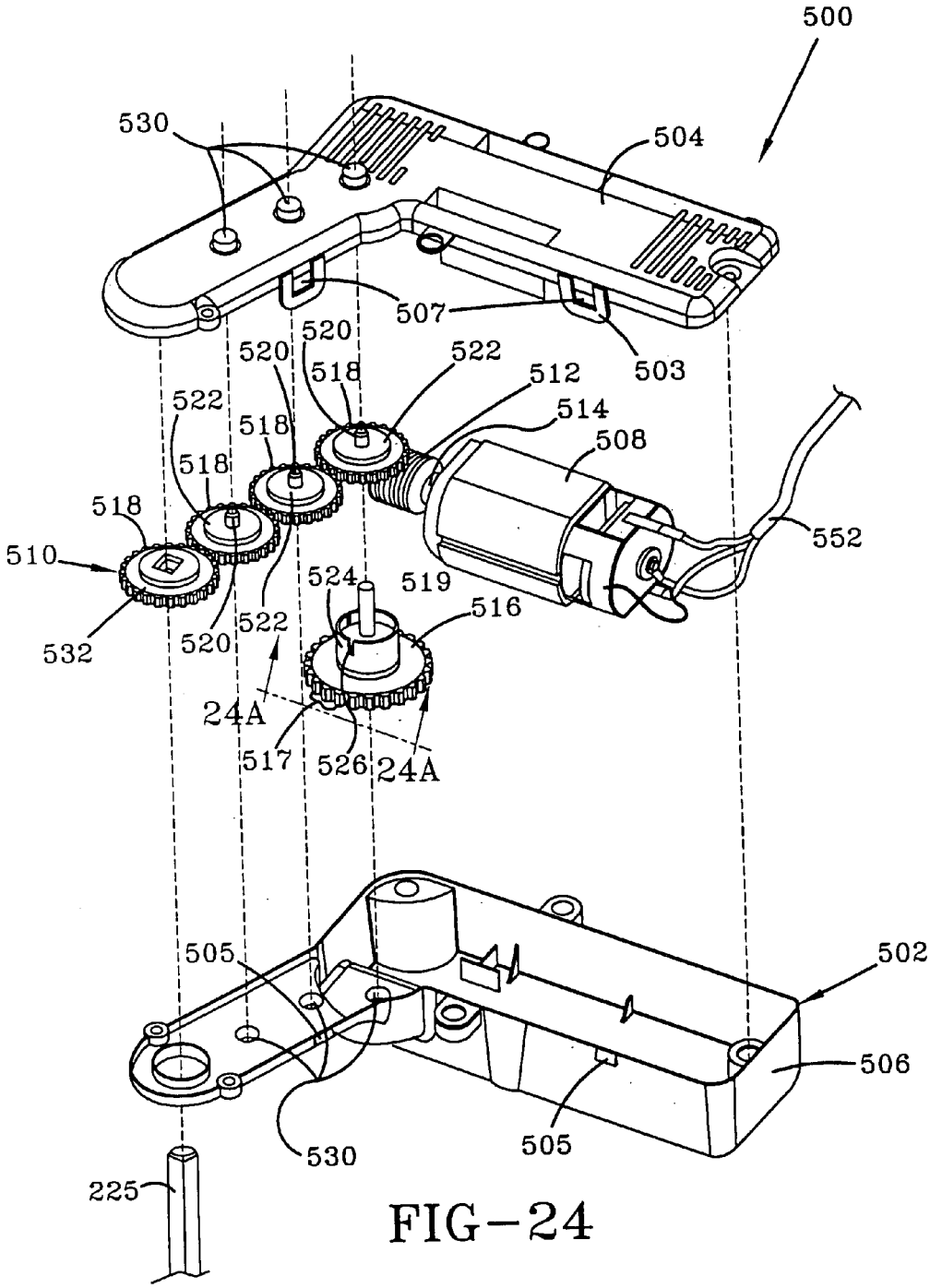
FIG. 24 is an exploded view of the brush motor assembly of the hard floor cleaning unit of FIG. 1.

As shown in FIG. 2A, the brush motor assembly 500 is mounted on the underside of the frame 52 directly above the wheel carriage assembly 136. Turning to FIG. 24, the brush motor assembly 500 comprises a generally L-shaped motor housing 502 that includes an upper cover 504 that is snap connected to the lower cover 506. In particular, u-shaped locking tabs 503 integrally formed on the upper cover 504 engage catches 505 formed on the lower cover 506. Screws (not shown) secure the brush motor assembly 500 to the frame 52. Seated within the housing 502 is a grounded, internally rectified DC motor 508 and a gear train 510. A worm 512 is press fitted onto the shaft 514 of the motor 508. A worm gear 516 having thirty teeth 518 is mounted on an axial shaft 519 and engages the worm 512. A spur gear 522 is also mounted on the axial shaft 519 above the worm gear 516.

Figure 24A:
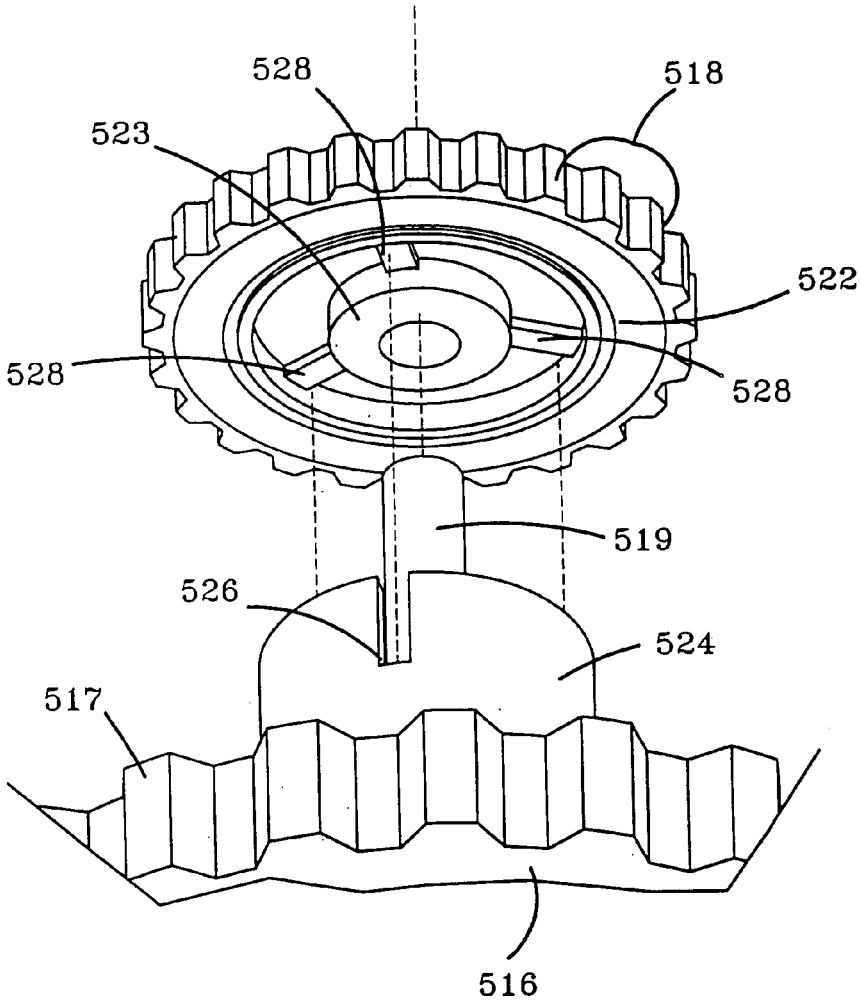
FIG. 24A is an exploded view taken along line 24A—24A of FIG. 24.

Referring to FIG. 24A, the central hub 524 of the worm gear 516 defines an upwardly extending hollow cylindrical portion that has three notches 526 formed at its distal end. The spur gear 522 has a hub portion 523 formed on its underside in which three integrally molded ribs 528 extend radially therefrom. The ribs 528 engage the notches 526 so that the worm gear 516 can rotate the spur gear 522. Turning back to FIG. 24, the axial shaft 520 is pressed into pockets 530 formed in the lower cover 506 and received in pockets 530 formed in the upper cover 504 to balance and minimize wobbling of the worm gear 516, thereby maintaining engagement of the teeth 517 with the worm 512 as the worm gear 516 rotates. The worm gear 516 generally has the largest diameter and the most teeth of the gears in the gear train 510 so as to provide speed reduction. Although the present worm gear 516 has thirty teeth 518, the diameter and number of teeth can be altered to provide the desired speed reduction. The teeth 518 of the spur gear 522 intermesh with teeth 518 of an adjacent spur gear 522 which in turn intermeshes with teeth 518 of an adjacent spur gear 522 which finally intermeshes with teeth 518 of the remaining spur gear 532. The middle spur gears 522 have axial shafts 520 which are also pressed into pockets 530 formed in the lower cover 506 and received in pockets 530 formed in the upper cover 504 to minimize wobbling and maintain engagement with their respective adjacent spur gears 522, 532. The last spur gear 532 in the gear train 519 has a square opening for receiving the drive shaft 225 of the gear brush 224 in the brush block assembly 216. A power cord 552 electrically connects the motor 508 through a microswitch 534 (FIG. 32) to a power source (not shown). Thus, when the motor 508 is energized, the worm 512 rotates the worm gear 516 and hence spur gears 522, 532 which in turn rotates the drive shaft 225. Rotation of the drive shaft 225 then rotates the gear brushes 226 in the brush block assembly 216 as seen in FIGS. 17A and 19.

Figure 3A:
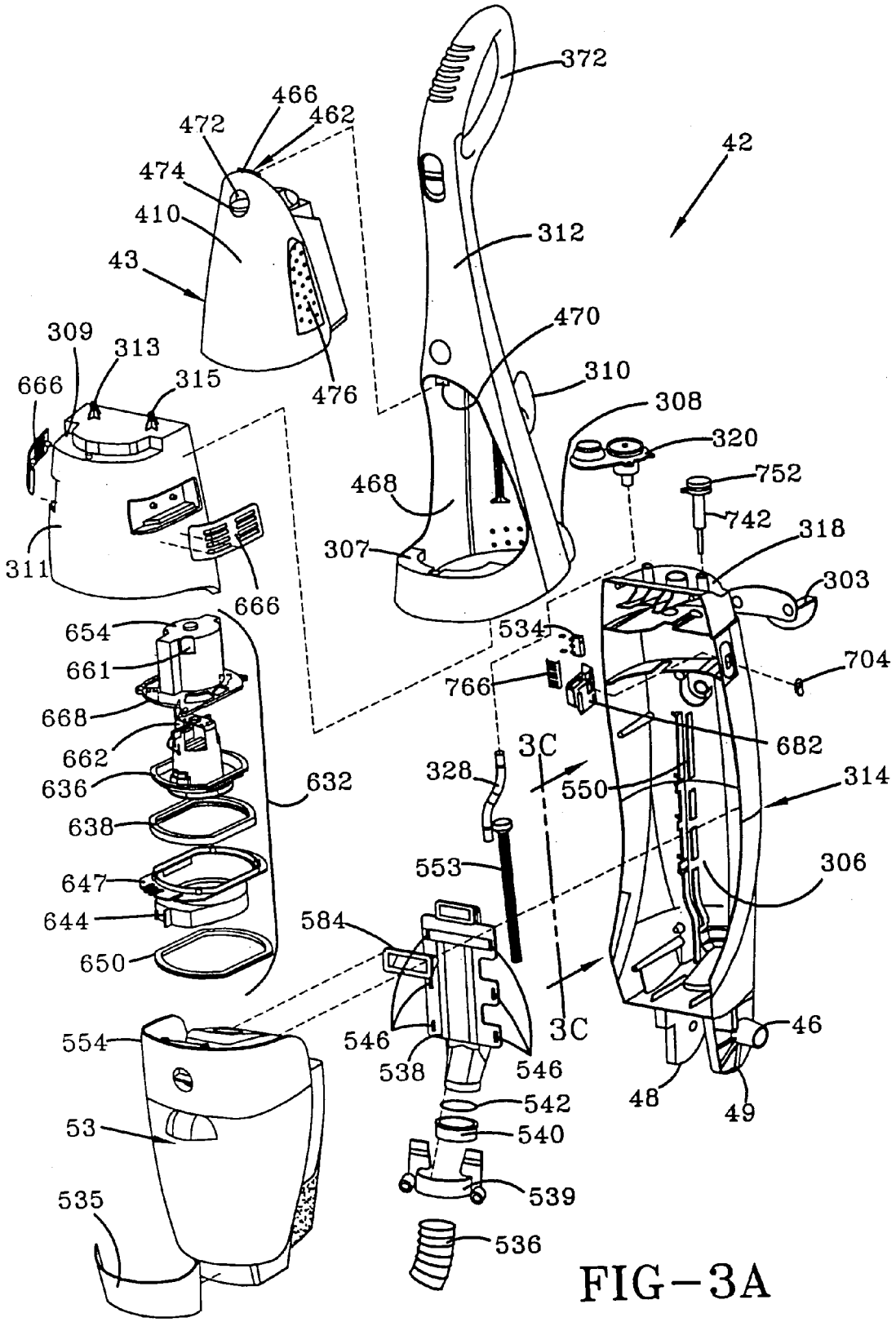
FIG. 3A is an exploded view of the handle assembly of the hard floor cleaning unit of FIG. 1.
Figure 5:
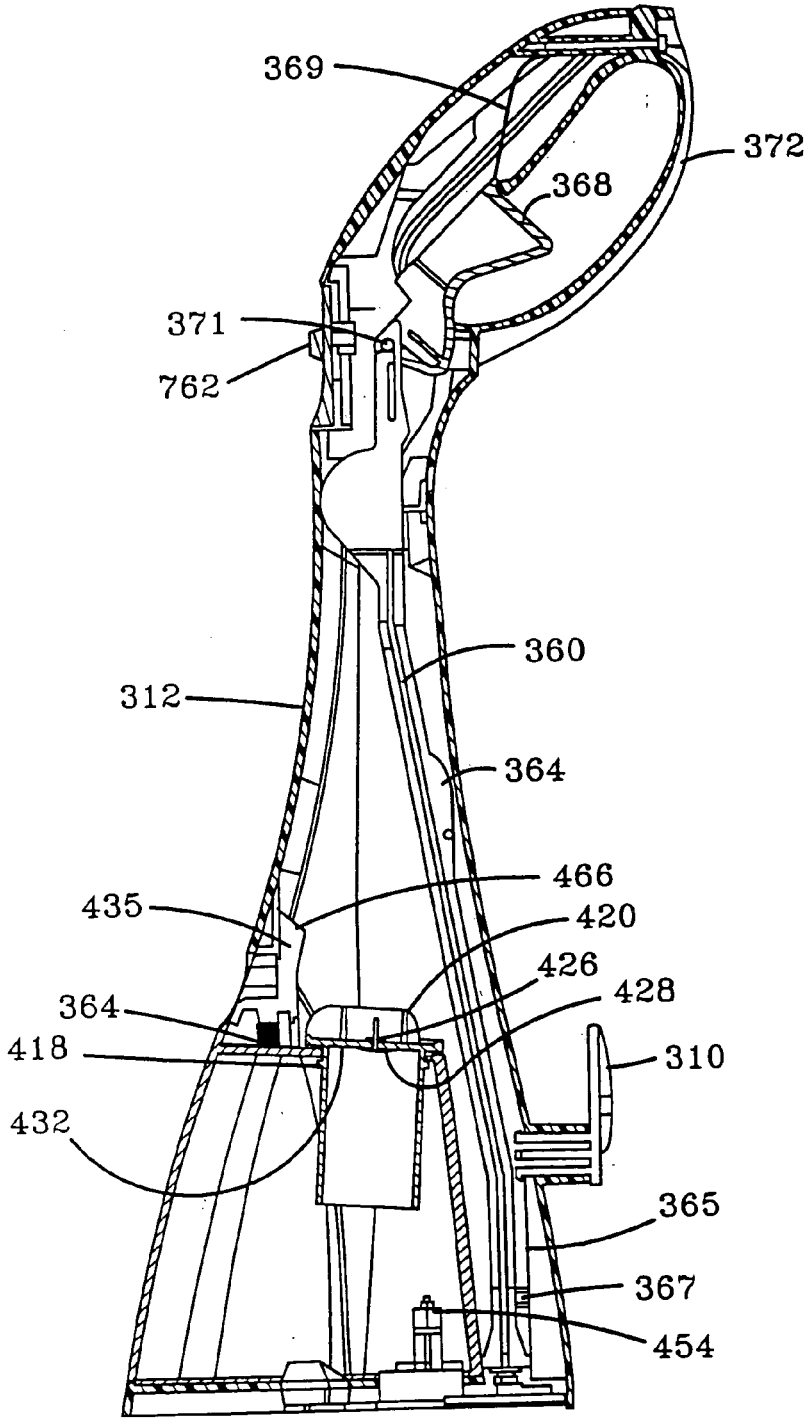
FIG. 5 is a side elevational cross sectional view taken vertically through the upper portion of the hard floor cleaning unit of FIG. 1.

Referring to FIG. 3A, handle assembly 42 basically comprises an upper handle portion 312, lower body shell 314. The upper handle portion 312 tapers upwardly into a narrow closed looped handgrip 372 at its upper end. A carrying handgrip 308 is also snap connected into the rear wall of the upper handle portion 312 to aid in carrying the hard floor cleaning unit 40. A front cover 311 is secured to the lower body shell 314. An upper cord holder 310 is snap connected into the rear wall of the upper handle portion 312 as also illustrated in FIG. 5. A lower cord holder 303 is screwed to the rear wall of the lower body shell 314.

A combined air/water separator and recovery tank 53 is removably seated within a cavity 306 of the lower body shell 314 upon the bottom side of the lower body shell 314. A bottom cover 535 of the recovery tank 53 screws into the lower body shell 314. As depicted in FIG. 4, positioned rearwardly of the recovery tank 53 is a corrugated translucent plastic hose 536 and recovery duct 538. The hose 536 is fluidly connected downstream to the translucent recovery duct 538 by a connector 540 and is sealed thereto by an O-ring 542 (FIG. 3A). A mounting bracket 539 (also shown in FIG. 3A) fits over the connector 540 and mounts the recovery duct 538 and hose 536 to the lower body shell 314. The hose 536 is fluidly connected upstream to the base duct 106 by a hose mounting bracket 544 mounted to the base duct 106. The hose 536 is flexible, yielding to permit pivoting of the handle assembly 42.

Referring to FIG. 3A, the recovery duct 538 has grooves 546 that snap connect onto locking tabs 548 (FIG. 3C) extending from the center of the rear inner side of the lower body shell 314. The recovery duct 538 is generally rectangular shaped and slightly flattened yet laterally elongated to provide additional room to accommodate the recovery tank 53 while allowing adequate flow of liquid and air therethrough. As depicted in FIG. 3C, raised channel portions 549, 550, 551 extend from the center of the rear inner side of the lower body shell 314 for securely receiving the supply tube 328, brush cable 730, and power cord 552, respectively. The translucent recovery duct 538 covers these elements for protection, yet provides visibility of these components for service.

Figure 25:
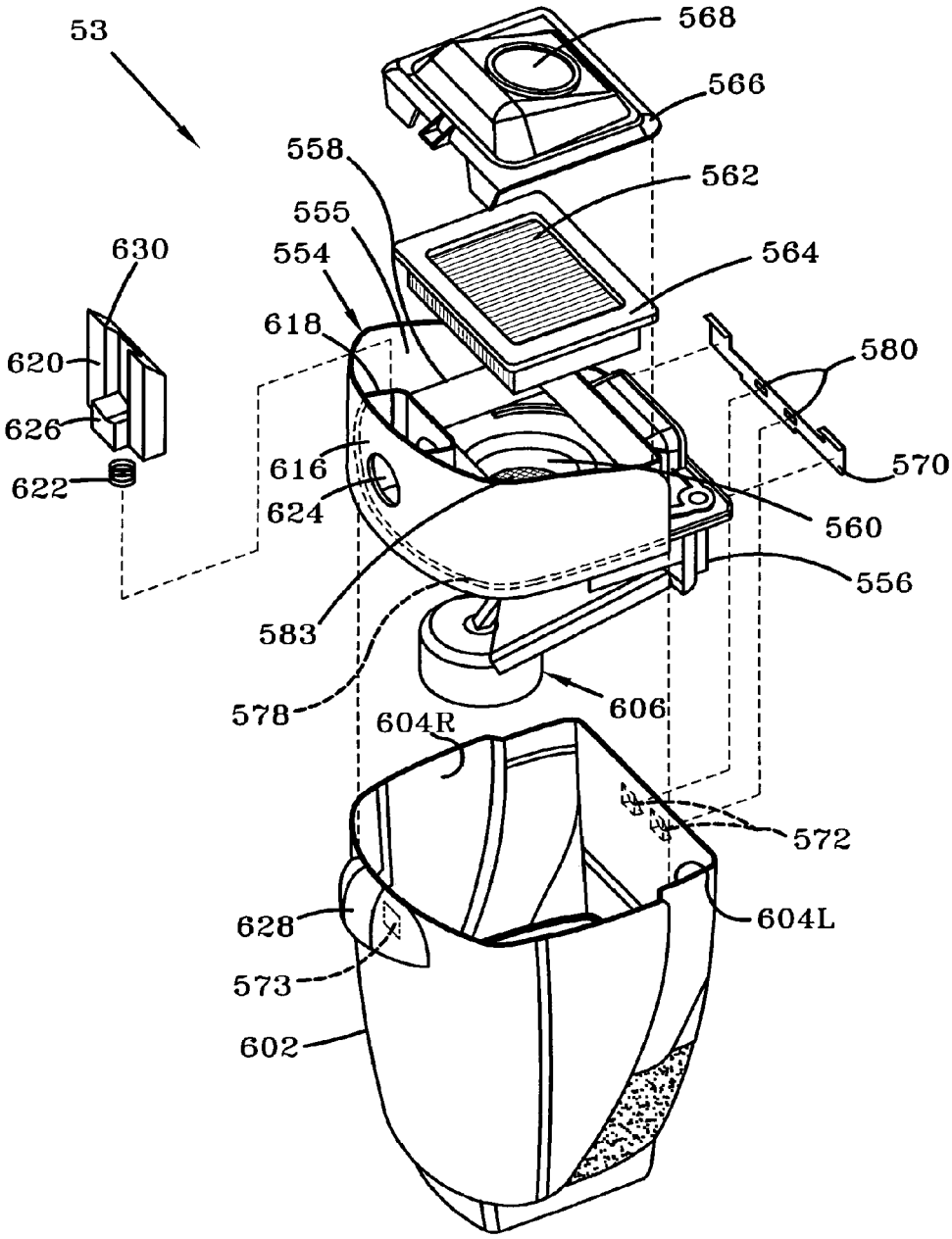
FIG. 25 is an exploded of the recovery tank of the hard floor cleaning unit of FIG. 1.
Figure 25A:
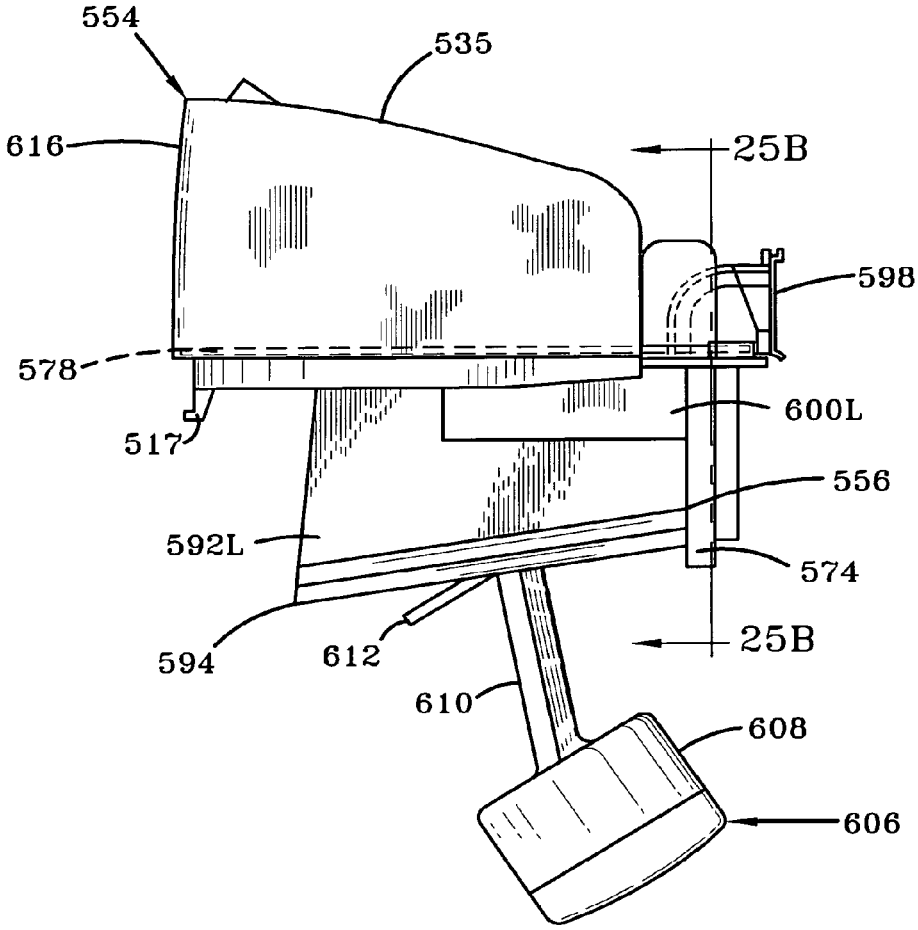
FIG. 25A is a side elevational view of the lid of the recovery tank of the hard floor cleaning unit of FIG. 1.

Referring to FIG. 25, the recovery tank 53 includes an inverted cup shaped handle 628 integrally molded to its front wall 602. The recovery tank 53 further includes a lid 554 located above the handle 628. The lid 554 includes an upper portion 555 mounted to a lower portion 556 with a rope seal 578 there between as also seen in FIG. 25A. A rectangular shaped retainer 558 is integrally formed on the top surface of the upper portion 555 of the lid 554 and surrounds the center tank exhaust opening 560. An integrally molded screen 582 covers the exhaust opening 560. A pleated filter 562 integrally molded to a seal 564 is seated in the retainer 558. A cover 566 with an outlet opening 568 formed therein covers the seal 564 and filter 562. The lid 554 is secured to the recovery tank 53 by a lid locking plate 570 and an integrally molded locking tang 571 (FIGS. 4 and 25A). The lid locking plate 570 is hingedly snap connected to the lid 554 and has two smaller slots 580 for securely receiving locking tabs 572 projecting from the recovery tank 53 by a snap connection. As best illustrated in FIG. 4, the locking tang 571 engages a groove 593 (FIG. 25) formed on the inner side of the front wall recovery tank 53. Referring to FIG. 25C, a rear recovery channel 574 having right and left outlets 576, 577 is formed in the lower portion 556 of the lid 554. The channel 574 is in fluid communication with the recovery tube inlet 584 that is formed at the top side of the lid 554. The inlet 584 is fluidly connected through a seal 598 (FIG. 25A) to the recovery duct 538 as depicted in FIG. 4.

Figure 25B:
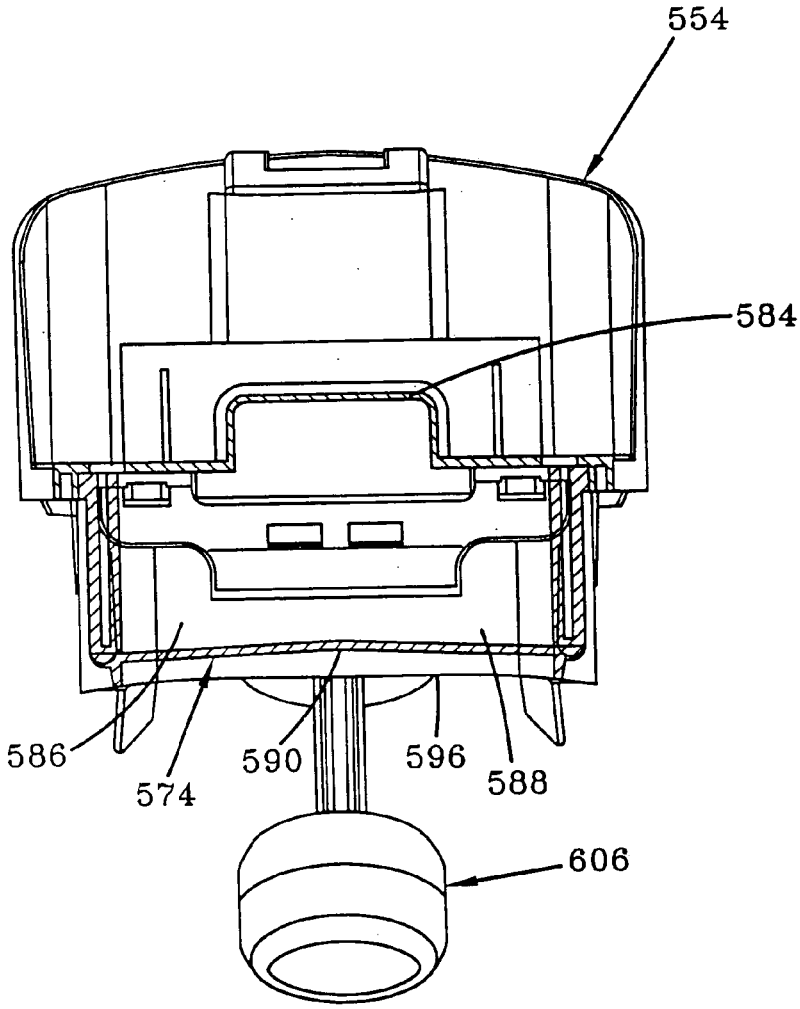
FIG. 25B is a partial sectional view taken along line 25B—25B of FIG. 25A.
Figure 25C:
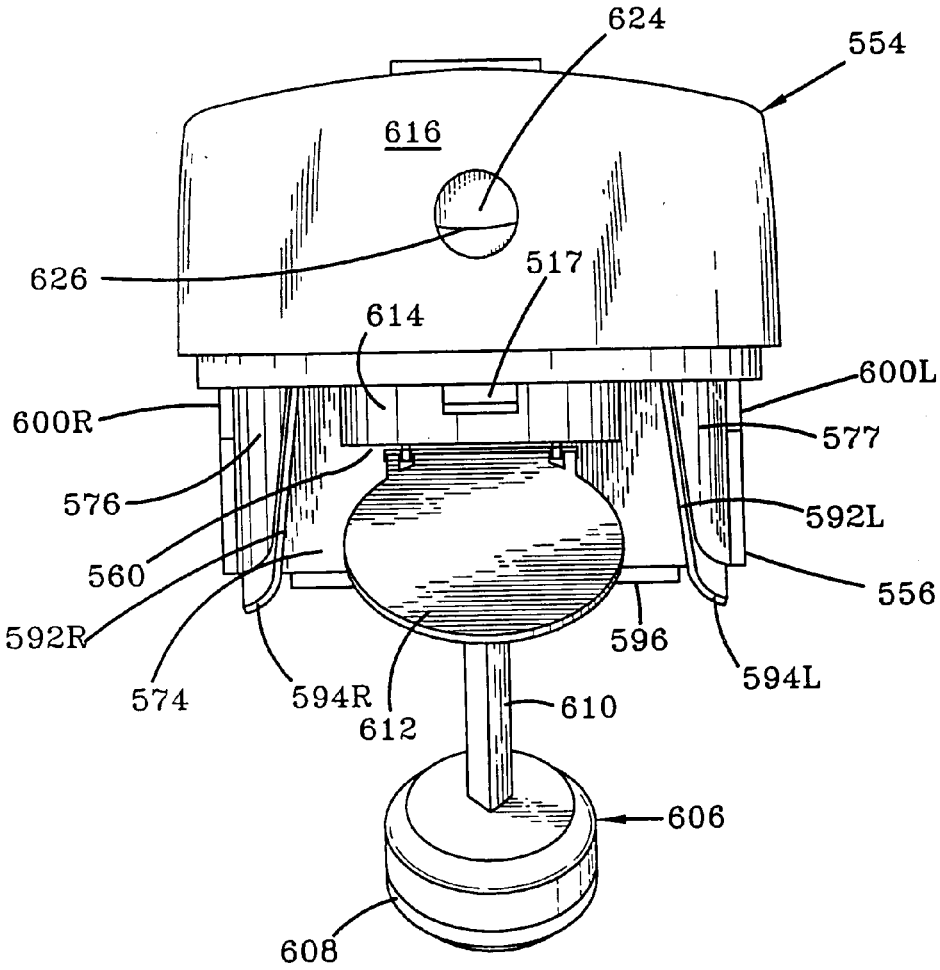
FIG. 25C is front elevational view of the lid of the recovery tank.

As best illustrated in FIG. 25B, when the hard floor cleaner unit 40 is used in the wet mode, the extracted soiled cleaning liquid enters the inlet 584 and travels downward impinging upon the bottom 590 and inner sides of the channel 574 as it moves along the right and left branches 586, 588 of the channel 574 to slow down its velocity for air/water separation. The bottom 590 of the channel 574 is slightly gabled to aid in directing the liquid to the right and left outlets 576, 577 (FIG. 25C). The cross sectional areas of the branches, 586, 588 increase downstream to further slow down the liquid and help separation. Referring to FIG. 25C, a pair of downwardly depending shields 592R, 592L extends forwardly from the front wall of the channel 574. As depicted in FIG. 25C, each shield 592 is slightly angled outward and also includes more pronounced outwardly angled drip edges 594R, 594L on the bottom ends. An additional drip edge 596 runs along the rear bottom side of the channel 574. The shields 592R, 592L and drip edges 594R, 594L, and 596 aid in separation of the liquid and minimize the amount of liquid entering the exhaust opening 560. Adjacent the outlets 576, 577 of the channel 574 are upper deflectors 600R, 600L extending forwardly therefrom.

As best illustrated in FIG. 4, these deflectors 600R, 600L (FIG. 25C) in combination with the shields 592R, 592L direct a portion of the liquid to impinge onto the inner surface of the front wall 602 of the recovery tank 53 and collect down on the bottom 601 of the recovery tank 53, thereby separating the liquid form the air and thus, minimizing the amount of water near the exhaust opening 560. The remaining portion of the liquid exits the duct through the outlets 576, 577 (FIG. 25C) and is impinged onto their associated inner sidewalls 604R, 604L (FIG. 25) of the recovery tank 53 and also collects down on the bottom 601 of the recovery tank 53. Air separated from the liquid flows through the exhaust opening 560, is filtered by the screen 582 and pleated filter 562, and exits through the outlet opening 568 (FIG. 25) in the cover 566.

Referring to FIGS. 4 and 25C, a float assembly 606 comprises a bottom float 608 connected by a stem 610 to an upper portion defining a seal 612. The seal 612 is pivotally connected to the underside of the lid 554 (FIG. 25C) and drops down to open the exhaust opening 560. This design prevents water from traveling from the float 608 to the seal 612. When the liquid level in the recovery tank 53 reaches a full level, the float 608 will move upward thereby pivotally moving the seal 612 upward to cover the neck 614 of the exhaust opening 560 as shown in the phantom lines of FIG. 4. In this position, the seal 612 closes the exhaust opening 560 to prevent the liquid from entering the motor area. When the hard floor cleaning unit 40 is used in the dry mode, the large objects drawn into the recovery tank 53 by the suction motor assembly 632 collect on the bottom 601 and small objects or particles such as dust are filtered out by the screen 582 and pleated filter 562 and prevented from entering the motor area.

Figure 26:
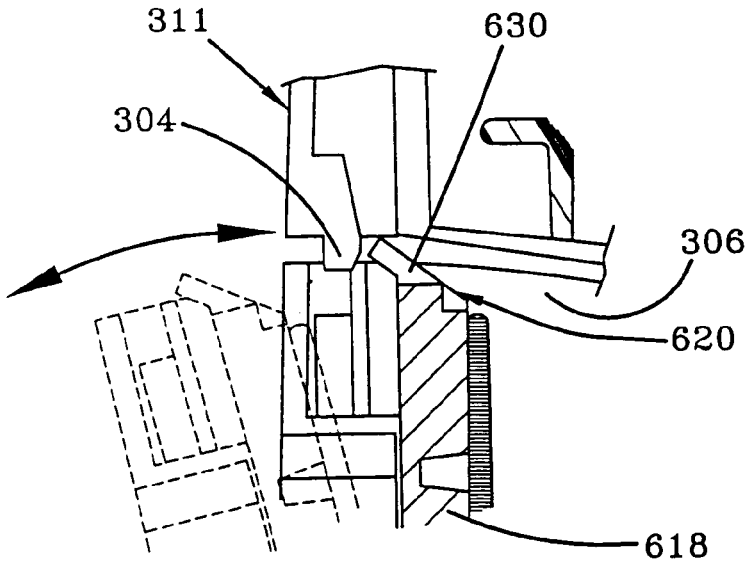
FIG. 26 is an enlarged sectional view of the latch of the recovery tank identified in FIG. 4.

As previously mentioned, the recovery tank 53 removably securely seats into the cavity 306 of the lower body shell 314 as depicted in FIG. 4. In particular, this is accomplished as follows. Referring to FIG. 25, a U-shaped vertically extending shield 616 is integrally molded on the top surface of the upper portion 555 of the lid 554. A retaining housing or slot 618 is integrally molded to the rear inner side of the shield 616 for receiving a spring-loaded latch 620. A coiled spring 622 is positioned between the top side of the lid 554 and latch 620 to bias the latch 620 upwardly. A lateral opening 624 in the shield 616 allows access to an arcuate lateral ledge 626 formed on the front of the latch 620. As depicted in FIG. 25C, the ledge 626 is positioned near the center of the opening for placement of a thumb or finger of a user. As best illustrated in FIG. 26, the upper end 630 of the latch 620 is beveled and cams against the lower edge 304 of the front cover 311 of the lower body shell to urge the latch downward as illustrated by the phantom lines, upon placing the recovery tank (FIG. 4) into the cavity 306. Once past the lower edge 304, the biasing force in the coiled spring 622 will urge the latch 620 upwardly behind the lower edge 304. This allows the recovery tank 53 to seat into the cavity 306 as shown in FIG. 4. Alternatively, instead of the coiled spring 622, an integrally molded elastic member extending downwardly from the bottom end of the latch 620 could also bias the latch 620 upwardly.

Referring to FIG. 4, to remove the recovery tank 53 from the cavity 306 in the lower body shell 314, a user grasps the handle 628 with his fingers and pushes down on the lateral ledge 626 of the latch 620 with his thumb until the upper end of the latch 620 moves below the lower edge 304 (FIG. 26) of the front cover 311 to unlock the recovery tank 53 therefrom. Using the handle 628, the user then pulls the recovery tank 53 out of the cavity 306. Referring to FIG. 25, to empty the recovered liquid from the recovery tank 53, a user lifts the lid locking plate 570 outward to unsnap it from the locking tabs 572 thereby unlocking the lid 554 from the recovery tank 53, and then simply removes the lid 554 and empties the recovered liquid from the recovery tank 53.

As shown in FIG. 3A suction source in the form of a bypass suction motor assembly 632 is received within the lower body shell 314 and covered by the front cover 311. In particular with reference to FIGS. 4 and 27, the suction motor assembly 632 generally comprises a motor/fan mechanism 634 that is positioned in a fan housing 636. An elastomeric vibration mounting O-ring 638 fits around a flange 640 of the fan housing 636. An impeller 642 is rotatably connected to the bottom of the fan housing 636 and extends into an impeller housing 644. The O-ring 638 of the fan housing 636 rests upon a support step 637 (FIG. 27) of the lower impeller housing 644. A gasket 650 is secured around the impeller housing 644 just below a flange portion 647. As depicted in FIG. 4, the gasket 650 has an annular groove 652 (FIG. 27) that cooperates with a support ledge 648 integrally formed on the inner side of the front cover 311 and lower housing 314 to support the motor/fan mechanism 634.

Figure 27:
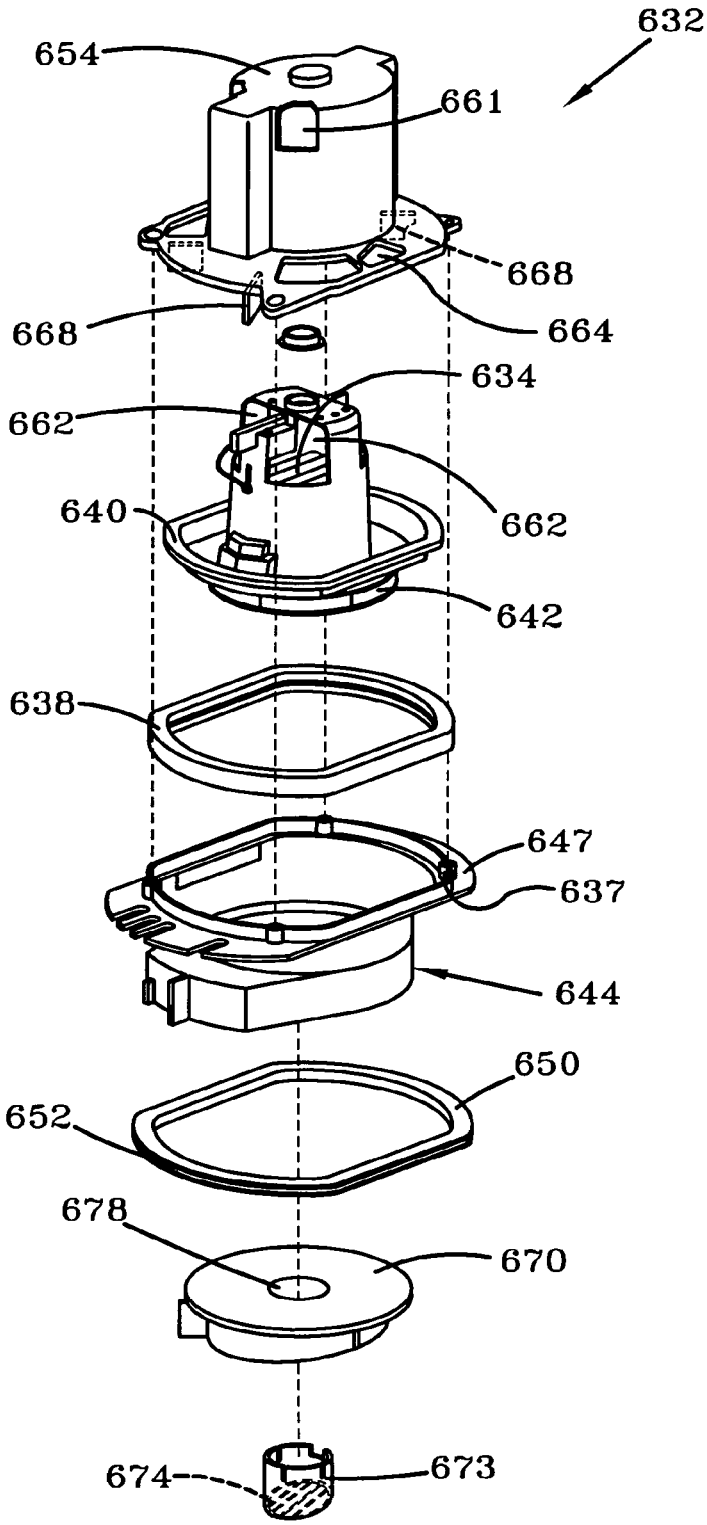
FIG. 27 is an exploded view of the suction motor assembly of the hard floor cleaning unit of FIG. 1.

As depicted in FIG. 4, a motor cover 654 surrounds the motor/fan mechanism 634 and is mounted to the mounting flange 644 of the impeller housing 644 thereby defining motor cooling exhaust manifolds 656 around the bottom of the fan housing 636. Motor cooling air is drawn through a rear vent 658 in the lower body shell 314 to air inlets 661 (FIG. 27) of the motor cover and air inlets 662 (FIG. 27) in the fan housing 636 by a cooling fan 649 of the motor/fan mechanism 634. The air cools the motor/fan mechanism 634 and exhausts into the exhaust manifolds 656. Referring to FIG. 3A, the heated air then exits upwardly through exhaust air outlets 664 (FIG. 27) in the motor cover 654 and then through exhaust vents 666 mounted on the front cover 311 of the lower body shell 314. The exhaust vents 666 are oriented to direct the air upwardly away from the floor and thereby prohibit any moisture from entering the motor/fan mechanism 634. Turning to FIG. 27, the motor cover 654 includes vertical sealing plates 668 positioned adjacent the ends of the manifolds 656 that prevent the exhaust air from entering back up into the inlets 662 of the fan housing 636.

With continued reference to FIG. 27, the impeller housing 644 includes a bottom portion 670 mounted thereto and which includes an opening 678 and an air inlet port 672 aligned over the eye of the impeller 642. A molded in grilled guard 674 on the bottom of the opening 678 (shown separated for illustrative purposes) restricts large objects from entering the eye of the impeller 642. Referring to FIG. 4, the air inlet port 672 extends downwardly to the opening 568 (FIG. 25) in the lid cover 566 of the pleated filter 562. The bottom of the inlet port 672 is beveled to register with the cover 566 of the filter 562. A gasket 673 is fitted around the inlet port 672 to seal it to the cover 566. The impeller 642 draws clean air filtered by the pleated filter 562 into the inlet port 672, where it then exhausts through the side of the impeller 642 and bottom slit in the impeller housing 644, where it is then directed downward exiting between the recovery tank 53 and the lower body shell 314.

Figure 28:
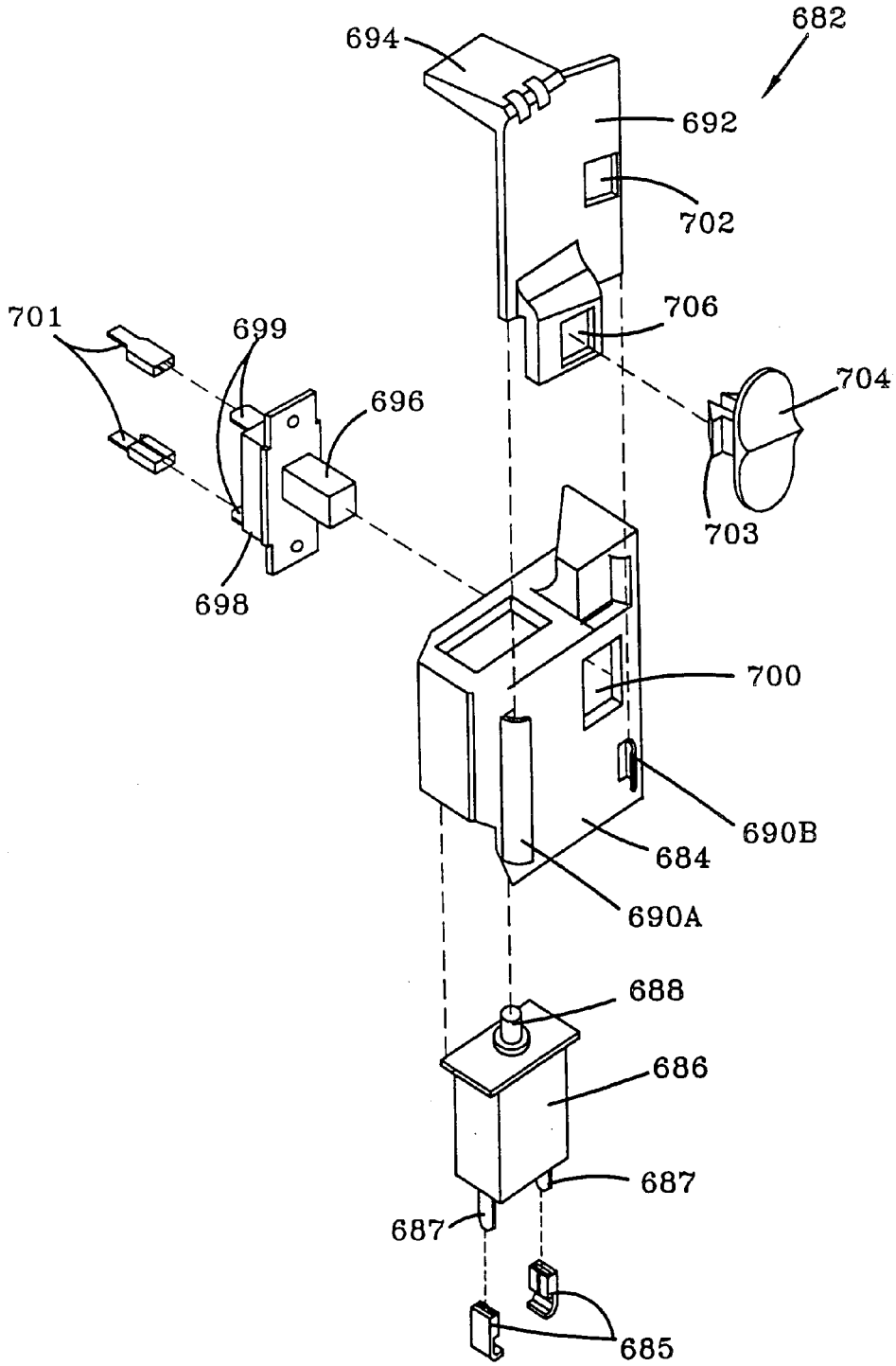
FIG. 28 is an exploded view of the power switch assembly of the hard floor-cleaning unit of FIG. 1.

As depicted in FIG. 3A main power switch assembly 682 is electrically connected to the suction motor assembly 632 and power supply (not shown) and thus, is used to turn on and off the suction motor assembly 632. The switch assembly 682 includes a mounting plate 684 (FIG. 28) mounted to the lower body shell 314 adjacent the motor assembly 632. Referring to FIG. 28, a circuit breaker 686 secured to the mounting plate 684 includes a reset button 688 extending up through an opening in the top of the mounting plate 684. Receptacles 685 are attached to prongs 687 extending downward from the bottom of the circuit breaker 686. Guide channels 690A, 690B formed on the mounting plate 684 slidably receives a switch lever 692. The lever 692 has a flap 694 extending over the reset button 688 of the circuit breaker 686. The switch button 696 from a switch body 698 extends through an aperture 700 in the lever 692 and aperture 702 in the mounting plate 684. A slide button 704 located on the exterior side of the lower body shell 314 snap fits into a second aperture 706 formed in the lever 692.

Thus, movement of the slide button 704 longitudinally with respect to the handle assembly 42 will correspondingly move the switch button 696 longitudinally turning it on and off, and also reset the circuit breaker 686 when slid down. Thus, when the slide button 704 is slid up to the on position, the motor 635 in the motor/fan assembly 634 is energized, and when the slide button 704 is slid down to the off position, the motor 635 is denergized and the flap 694 engages the reset button 688, resetting the circuit breaker 686 when tripped.

As generally illustrated in FIG. 3A, the lower body shell 314 has integrally molded therein a top support shelf 318 that has mounted thereto a cleaning solution reservoir assembly 320. Reservoir 320 receives and holds a quantity of cleaning solution from a supply tank 43 for distribution to the supply tube 328 as further described below. The handle assembly 42 is completed by fixedly attaching the upper handle 312 to the lower body shell 314 by telescopingly sliding upper handle 312 downward such that its lower lip 307 fits into a recess area 309 of the front cover 311.

Figure 29:
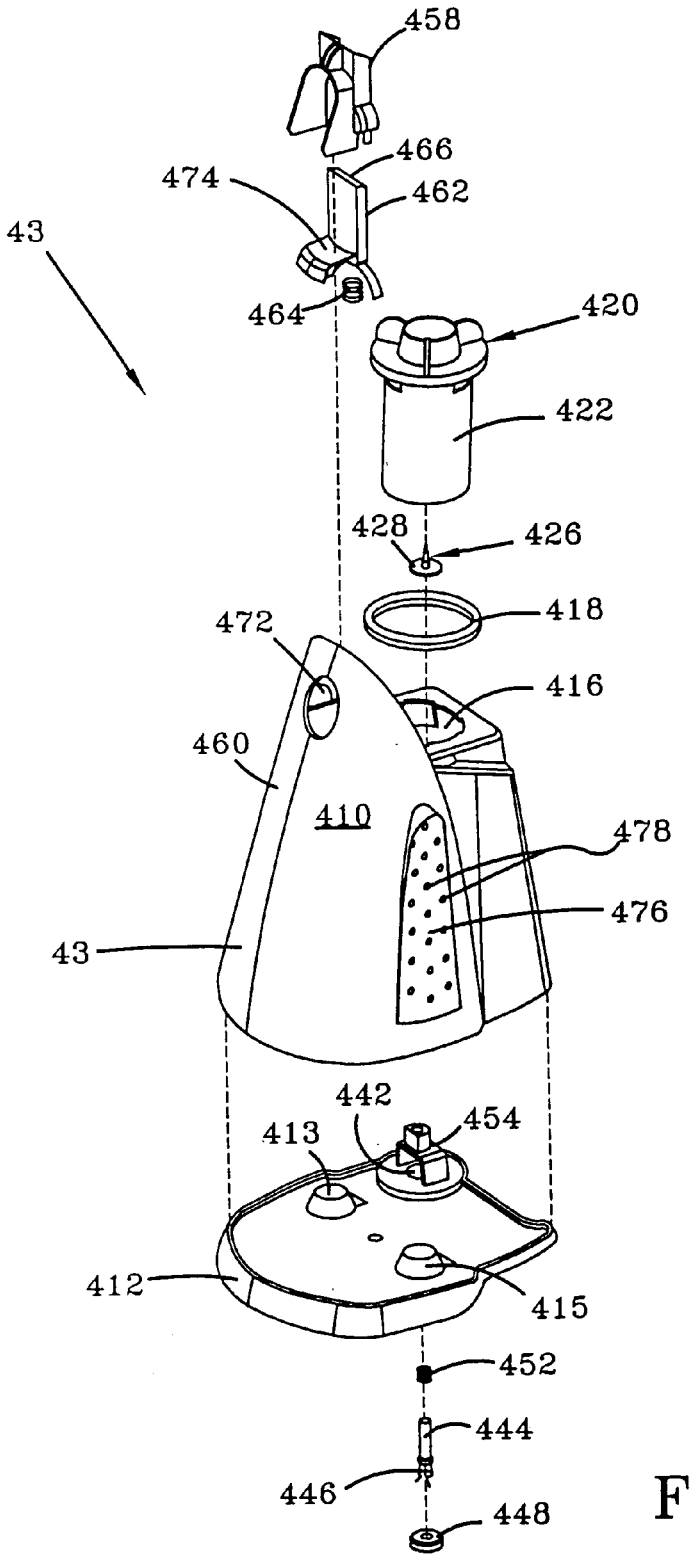
FIG. 29 is an exploded view of the supply tank of the of the hard floor cleaning unit of FIG. 1.
Figure 29A:
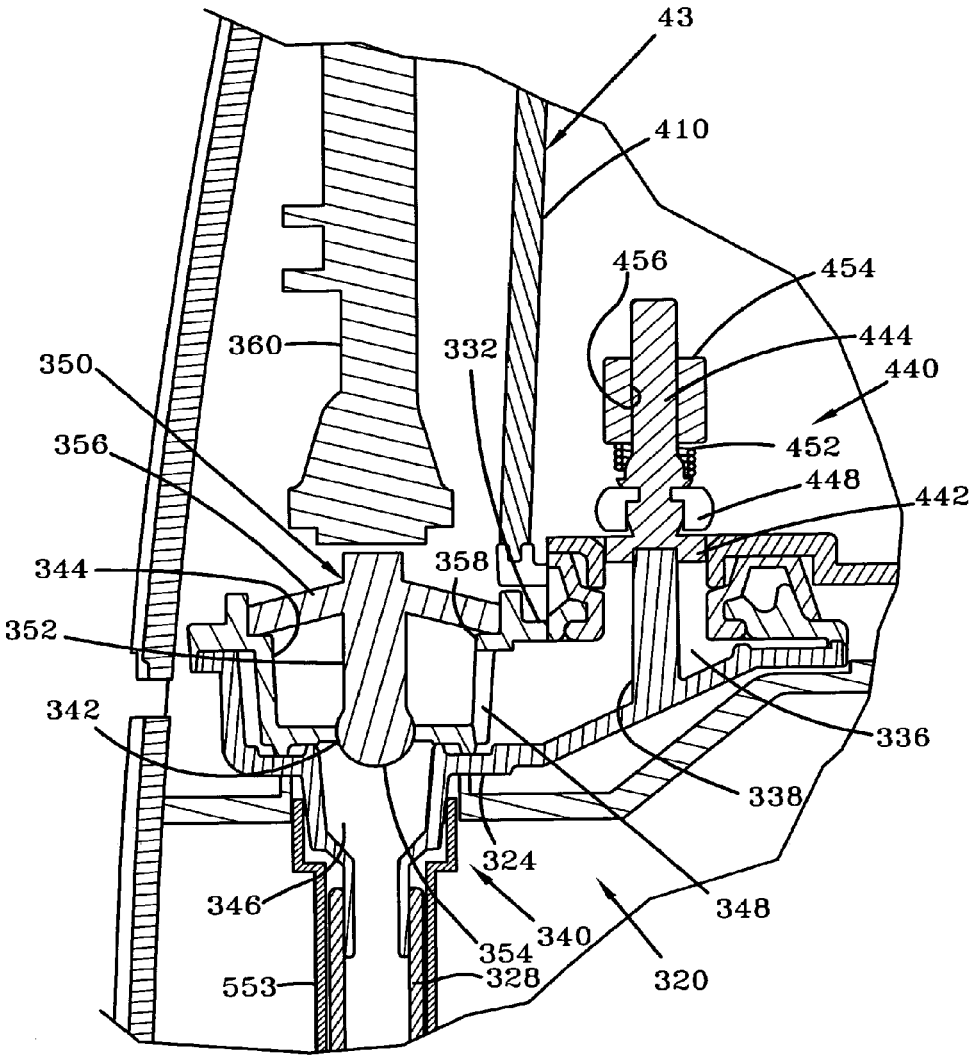

Referring now to FIG. 29A, cleaning solution reservoir assembly 320 includes a bottom concave lower basin 324 having a supply tube 328 exiting therefrom. Supply tube 328 provides a valved release of cleaning solution from the reservoir volume 334 and the supply tank 43 to the cleaning solution distributor 246. As shown in FIGS. 3A and 29A, the supply tube 328 is covered with a jacket 553 within the area of the motor assembly 632 (FIG. 3A) to ensure that no leakage from a possible rupture of the tube will enter the area.

As depicted in FIG. 29A, a cover plate 332 is sealingly mounted to lower basin 324 thereby forming reservoir volume 334 which supply tank 43 floods with cleaning solution through inlet port 336. Extending axially upward through inlet port 336 is pin 338 which acts to open the supply valve 440 of the supply tank 43 as the tank 43 is placed upon the support shelf 318 and secured in place. The structure and operation of the supply valve 440 is described further below.

Cleaning solution is released, upon operator demand, into tube 328 through solution release valve 340 which comprises valve seat 342 positioned in basin 324 of bowl 344 integrally formed with top cover 332. The basin 324 of bowl 344 extends across discharge port 346 such that valve seat 342 is aligned to open thereinto. An opening 348, within the wall of bowl 344, permits the free flow of cleaning solution from reservoir 334 into bowl 344. An elastomeric valve member 350 comprises an elongate piston 352 extending through valve seat 342 having a bulbous nose 354 at the distal end thereof within discharge port 346. The valve member 350 is preferably made of an elastomeric material. The opposite end of piston 352 includes a downwardly sloped circular flange 356, the peripheral end of which frictionally and sealingly engages the upper circular rim 358 of bowl 344 thereby preventing leakage of cleaning solution. The flange 356 acts to bias piston 352 upward thereby urging nose 354 into sealing engagement with valve seat 342 preventing the flow of cleaning solution from bowl 344 into discharge port 346 and tube 328.

The solution release valve 340 is operated by pressing downward upon the elastomeric release valve member 350 by a push rod 360 thereby deflecting the center of flange 356 downward urging nose 354 downward and away from valve seat 342 permitting the passage of cleaning solution therethrough, into discharge port 346 and tube 328. Energy stored within flange 356, as a result of being deflected downward will, upon release of the force applied to push rod 360, return the valve to its normally closed position as illustrated in FIG. 29A. Such an arrangement is similar to that disclosed in U.S. Pat. No. 5,500,977; the disclosure of which is incorporated by reference.

Figure 3B:
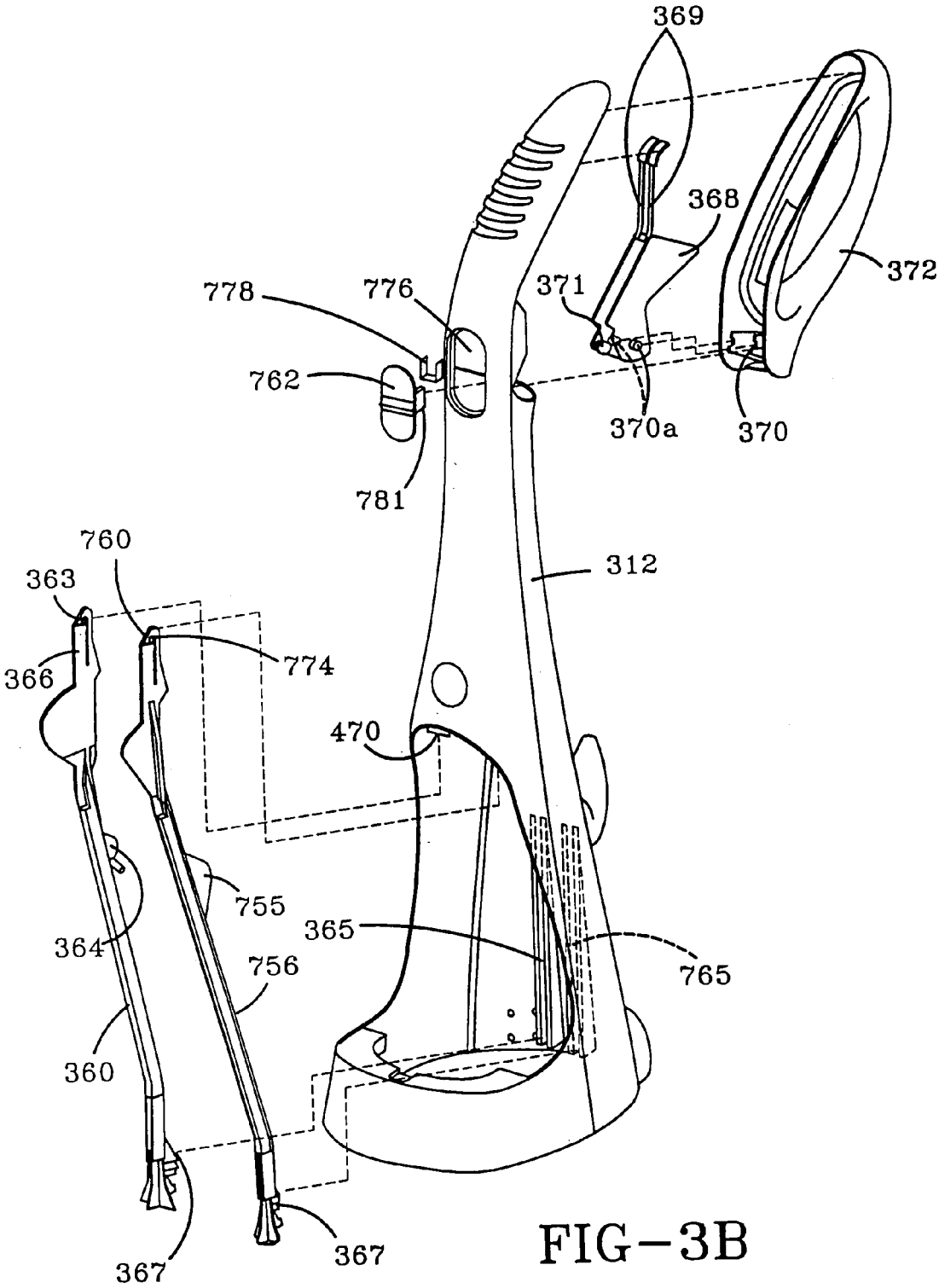
FIG. 3B is an exploded view of the upper handle portion of the handle assembly of the hard floor cleaning unit of FIG. 1.
Figure 3C:
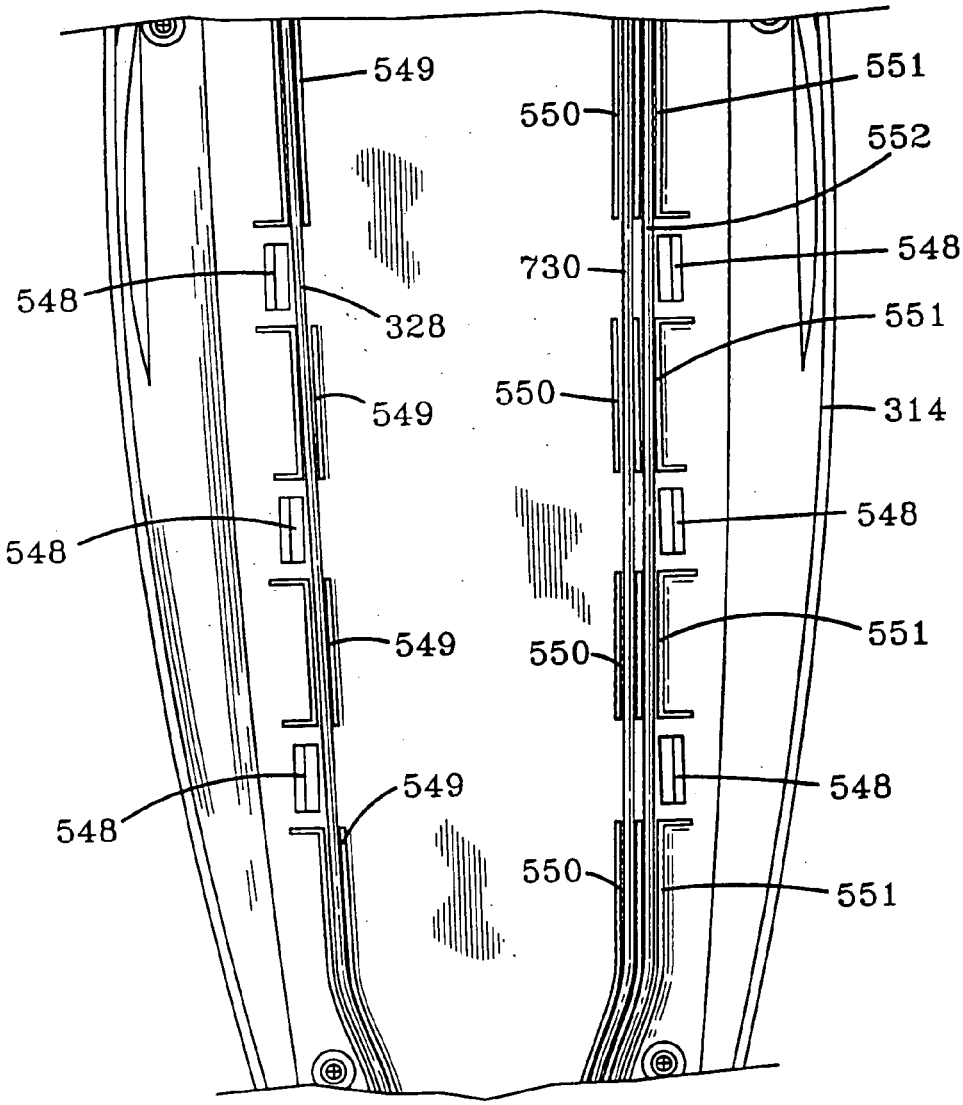
FIG. 3C is an elevational view taken along line 3C—3C of FIG. 3A.

Referring now to FIGS. 3B and 5, extending upward through handle assembly 42 is the articulated push rod 360. Push rod 360 is positioned within the handle assembly 42 by means of integrally molded spacers 364 dimensioned and located as necessary. Integrally formed lateral hook arms 367 on the push rod 360 slidingly engage a guide channel 365 integrally formed in the inner side of the upper handle 312 and extending longitudinally with respect to the upper handle 312. This arrangement aids in guiding the push rod 360 directly over the valve member 350 (FIG. 29A) as it moves longitudinally. The upper end 366 of push rod 360 is pivotally attached to trigger 368. Specifically, a lateral pin 371 integrally molded on the trigger pivotally snaps into a detent 363 (FIG. 3B) formed in the upper end 366. The trigger 368 is pivotally attached to the handgrip 372 at a pivot 370. In particular as depicted in FIG. 3B, the pivot 370 of hand grip 372 snappingly receives lateral integrally molded pins 370A of trigger 368.

Integrally molded onto trigger 368 and extending upwardly are two elastic arms 369, one on each lateral side thereof. Elastic arms 369 produce a biasing force and urge trigger 368 and the attached articulated push rod 360 towards the valve closed mode as illustrated in FIG. 29A.

Elastic arms 369 are engineered to support the weight of the push rod 360 such that no force is applied to elastomeric valve member 350 (FIG. 29A). Upon the operator squeezing the trigger 368, elastic arms 369 yield thereby permitting counterclockwise rotation of trigger 368 about the pivot 370 with a resulting downward movement of the push rod 360. Turning to FIG. 29A, this action opens the solution release valve 340 causing gravitational flow of cleaning solution from the reservoir 334 to the tube 328. Upon release of the trigger 368 (FIG. 5), energy stored in the system returns the valve 340 to the closed mode.

As best illustrated in FIG. 3A, removably positioned over the top support shelf 318 of the lower body shell 314 and top side of the front cover 311 is a cleaning solution supply tank 43. As seen in FIG. 29, supply tank 43 basically comprises a deeply hollowed upper body 410 and a relatively planer bottom plate 412 which is adhesively secured, about its periphery, to the upper body 410. The bottom plate 412 is provided with suitable recessed areas 413 and 415. As seen in FIG. 3A, these recessed areas 413, 415 (FIG. 29) index upon and receive therein corresponding raised portions 313 and 315 on the top side of the front cover 311 of handle assembly 42, when supply tank 43 is placed thereon. In effect, the raised portions 313, 315 and reservoir 320 support the supply tank 43. A pair of recessed grip areas 476 formed on opposite sides of the outer wall of the upper body 410 have raised projections or bumps 478 formed thereon to aid in gripping the supply tank 43.

Referring to FIG. 29A, incorporated into bottom plate 412 of tank 43 is the supply valve 440 comprising valve seat 442 having an elongate plunger 444 extending coaxially upward therethrough. Plunger 444 having an outside diameter less than the inside diameter of valve seat 442 is provided with at least two flutes 446 (FIG. 29) to maintain alignment of plunger 444 within valve seat 442 as plunger 444 axially translates therein and permits the passage of fluid therethrough when plunger 444 is in the open position.

An open frame housing 454 is located atop valve seat 442 having a vertically extending bore 456 slidingly receiving therein the upper shank portion of plunger 444. An elastomeric circumferential seal 448 circumscribes plunger 444 for sealingly engaging valve seat 442. Seal 448 is urged against valve seat 442 by action of compression spring 452, circumscribing plunger 444, and positioned between frame 454 and seal 448. The supply valve 440 is normally in the closed position. However, as supply tank 43 is placed upon the support shelf 318 of handle 42, pin 338 of the cleaning solution supply reservoir 320 aligns with plunger 444 and is received within flutes 446, as best illustrated in FIG. 29A, thereby forcing plunger 444, upward compressing spring 452, and opening valve seat 442 permitting cleaning solution to flow from the supply tank 43 into reservoir 320. Upon removal of the supply tank 43 from support shelf 318 the energy stored within compression spring 452 closes valve seat 442. A supply tank seal 480 (FIG. 32) seals the supply valve 440 upon removal and placement of the supply tank 43 from the support shelf 318.

Referring now to FIG. 29, located at the top of the supply tank 43 is a fill opening 416 through which the supply tank 43 may be conveniently filled with cleaning solution. To assure that the ambient pressure within the supply tank 43 remains equal to atmospheric, as cleaning solution is drawn from the supply tank 43, an elastomeric umbrella valve 426 is provided in the top of cap 420 comprising a multiplicity of air breathing orifices. Referring to FIG. 5, as the ambient pressure within the supply tank 43 drops, by discharge of cleaning solution from therein, atmospheric pressure acting upon the top side of umbrella valve 426 causes the peripheral edge 428 to unseat from surface 432 of cap 420 thereby permitting the flow of atmospheric air into the supply tank 43 until the ambient pressure therein equals atmospheric. Once the pressure on both sides of the umbrella valve equalize, the energy stored by deflection of the umbrella valve causes the peripheral edge 428 (FIG. 29) to reseat itself against surface 432 thereby preventing leakage of cleaning solution through orifices during operation of the extractor.

Referring to FIG. 29, cap 420 and flat circular seal 418 sealingly close fill opening 416. Cap 420 incorporates an inverted cup portion 422 which serves as a convenient measuring cup for mixing an appropriate amount of concentrated cleaning solution with water in tank 43. When cap 420 is inverted and used as a measuring cup, liquid pressure against umbrella valve 426 further urges peripheral edge 428 against surface 432 (FIG. 5) thereby providing a leak free container. Such an arrangement is similar to that disclosed in U.S. Pat. No. 5,500,977; the disclosure of which is incorporated by reference.

The solution supply tank 43 includes a tank securement latch 462 of approximately similar construction and function as that of the recovery tank to provide a convenient means for removably securing the supply tank from the cavity 468 (FIG. 3A) of the upper handle portion 312 (FIG. 3A). Specifically, a retaining housing or slot 458 is mounted to the inner side of the front wall 460 of the supply tank 43 for slidably receiving and retaining a spring-loaded latch 462. A coiled spring 464, positioned between the bottom of the retaining housing 458 and latch 462, biases the latch 462 upwardly. Additionally, a u-shaped plastic spring 465, integrally formed with latch 462 and extending downwardly from the bottom end of the latch 462, aids in biasing the latch 462 upwardly. The upper end 466 of the latch 462 is beveled.

Thus with reference to FIG. 3A, upon insertion of the supply tank 43 assembly into the cavity 468, a downward extending rib 470 of the upper handle 312 just above the cavity 468 cams against the upper end 466 urging the latch 462 downward and thereby allowing the supply tank 43 to seat into the cavity 468. Once past the rib 470, the biasing force in the coiled spring 464 (FIG. 29) will urge the latch 462 upwardly behind the edge 470 thereby locking the supply tank 43 within the cavity 468. A lateral opening 472 formed in the inner side of the front wall 460 allows access to an arcuate laterally extending ledge 474 (also shown in FIG. 29) integrally formed on the front of the latch 462 and positioned near the center of the opening 472 for placement of a thumb or finger of a user. To remove the supply tank 43 from the cavity 468 in the upper handle 321, a user grasps the grip areas 476 with his fingers and pushes down on the ledge 474 of the latch 462 with his index finger until the upper end 466 of the latch 462 moves below the edge 470 to unlock the supply tank 43 from the cavity 468. Using the grip areas 476, the user then pulls the supply tank 43 out of the cavity 468. Alternatively, the u-shaped plastic spring 465 could be designed to alone bias the latch 462 upwardly.

Figure 30A:
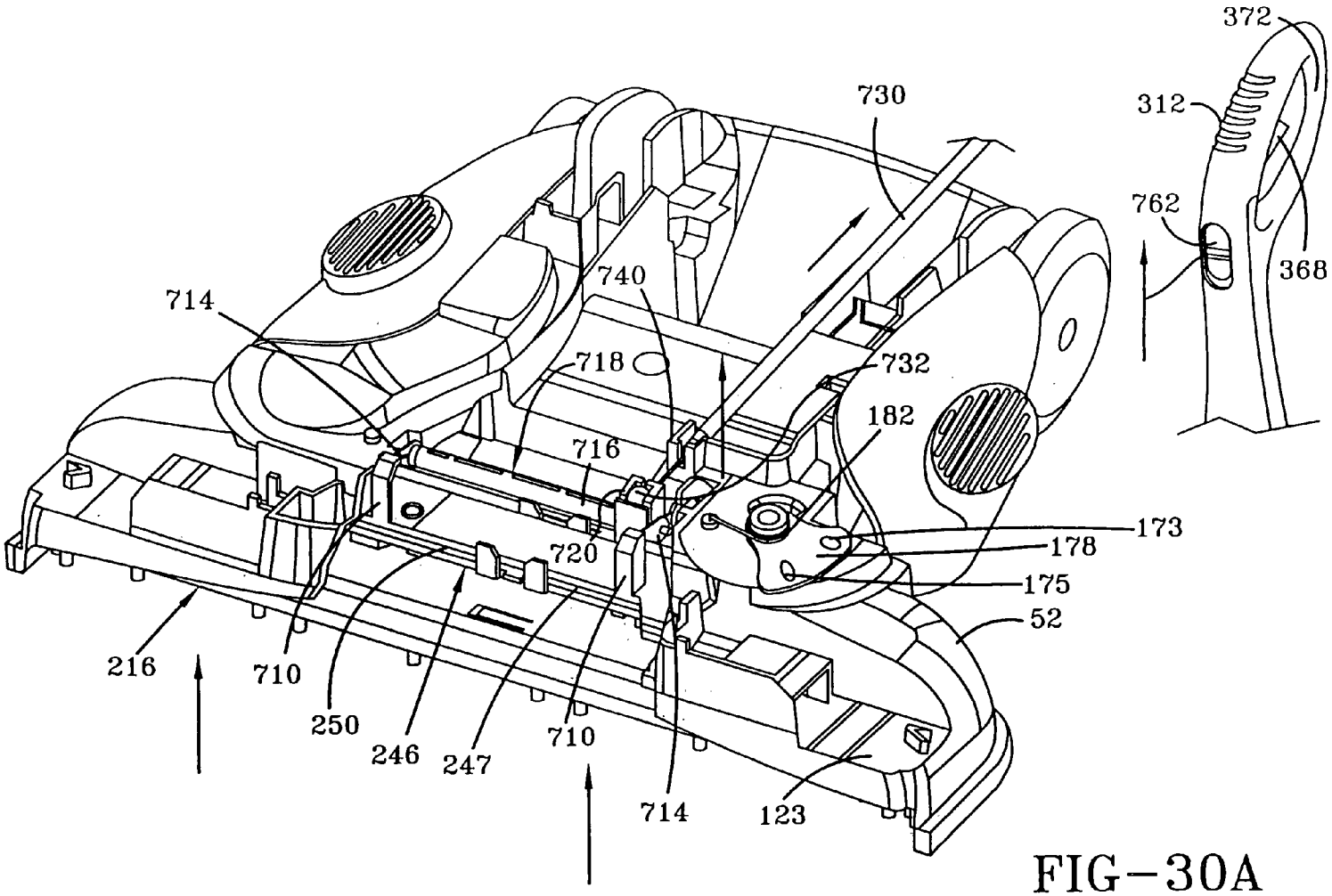
FIG. 30A is a perspective view of the base assembly of the hard floor cleaning unit of FIG. 1 with the nozzle assembly and cover removed and portions cutaway for illustrative purposes.
Figure 30B:
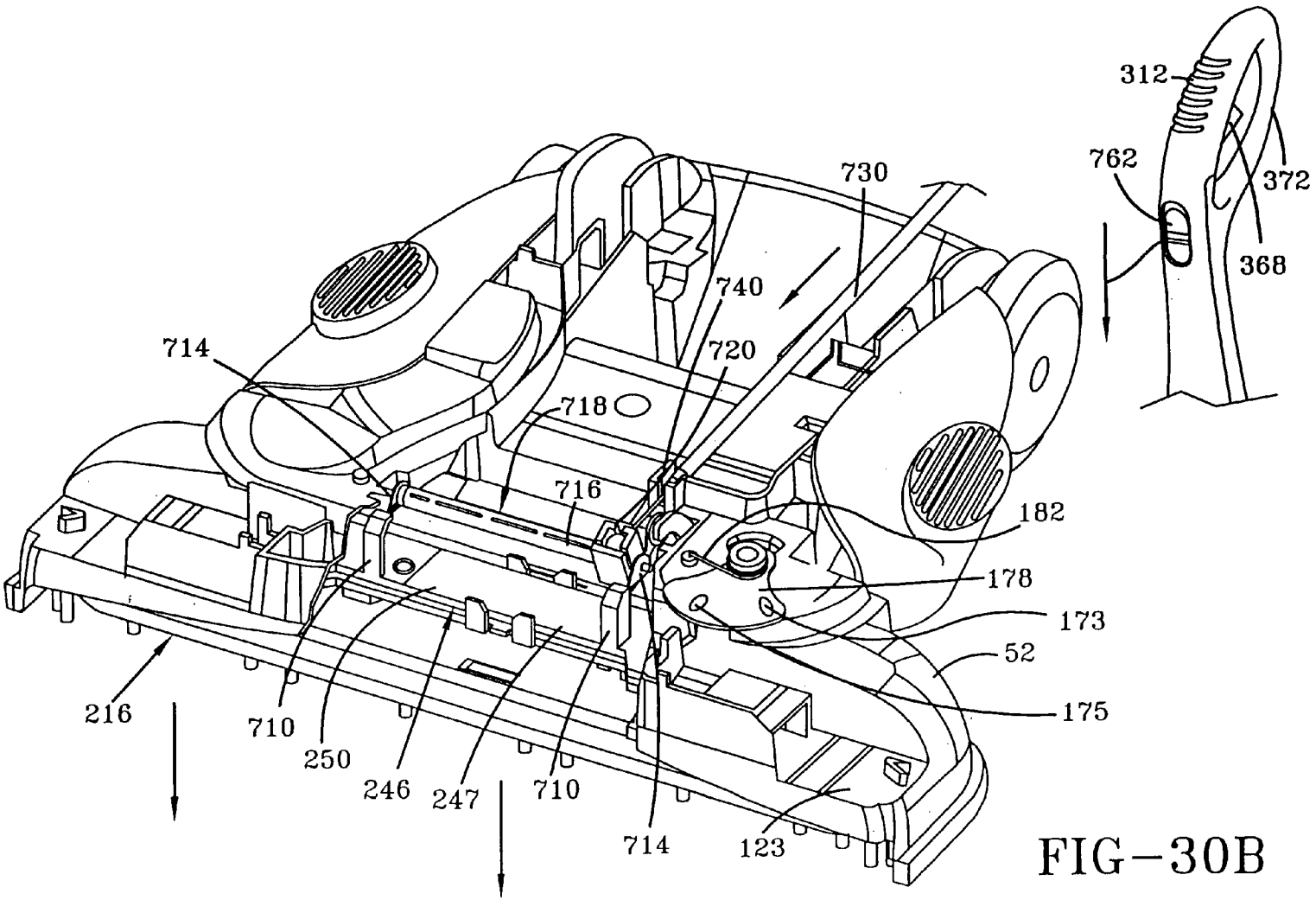
FIG. 30B is a view similar to FIG. 30A but with the brush block assembly lowered.

FIGS. 2A, 30A, 30B, 30C, 31, 31A, 31B, and 32 illustrate the brush lifting mechanism, which will be herein described. Referring to FIGS. 2A, 30A, 30B, a pair of hooks 710 integrally molded with the upper plate 250 of the distributor 246 extends from its upper surface 247, as previously mentioned. The hooks 710 hang onto forwardly extending arms 714 integrally molded on a rod portion 716 of a brush lifting lever 718. A ring member 719 is integrally molded on the rod portion 716 and extends rearwardly. The rod portion 716 is rotatingly positioned in a complimentary recess in the top portion of the frame 52 such that rotating the lever 718 clockwise when viewed from the left side raises the arms 714 and hence brush block assembly 216, as seen in FIG. 30A, and rotating the lever 718 counter clockwise lowers the arms 714 and brush block assembly 216 as seen in FIG. 30B.

As best depicted in FIG. 2A, integrally molded or attached to the upper surface 247 of the upper plate 250 are upwardly extending guide members 718 which, along with the arms 714, slidingly interface with the frame 52 to guide and minimize lateral movement of the distributor 246 as it is raised and lowered, thereby preventing the hooks 710 from unhooking off the arms 714. Inner upstanding walls 708 (FIG. 17A) of the frame 52 positioned outwardly adjacent the hooks 710 also aid in performing this function. A pocket portion 720 having an arcuately shaped bottom defining opposite front and rear gripping members 722, 724 slidably engages around to the rod portion 716.

Figure 31:
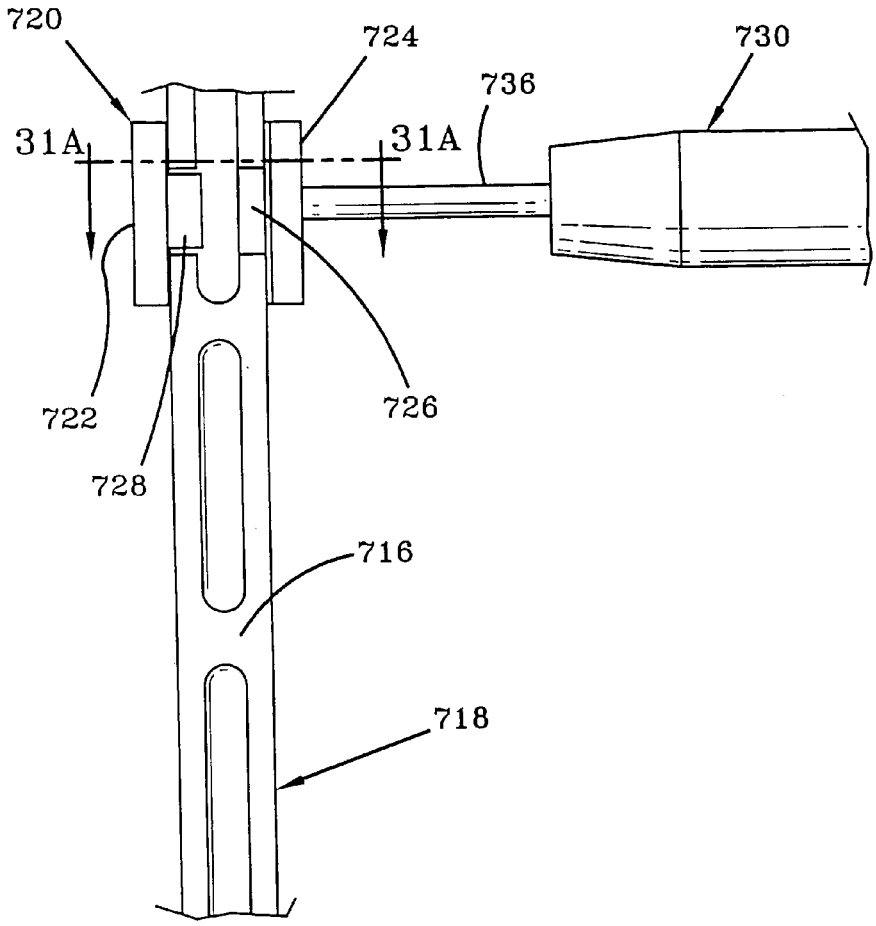
FIG. 31 is an elevational view taken along line 31—31 of FIG. 30C.

As depicted in FIG. 31, a transverse groove 726 is formed across the lower end of the rod portion 716. The groove 726 slidably receives a tongue 728 integrally molded and extending rearwardly from the front gripping member 722 of the pocket portion 720. When the brush block assembly 216 (FIG. 30B) is raised, the pocket portion 720 moves rearwardly so that the tongue 728 engages the front edge of the groove 726 to rotate the rod portion 716 clockwise (when viewed from the left side). This action moves the arms 714, hooks 710, and brush block assembly 216 upward as depicted in FIG. 30B. To lower the brush block assembly 216, the pocket portion 720 is moved forward, which allows the weight of the brush block assembly 216 to rotate the rod portion 720 counterclockwise and hence lower the brush block assembly 216 for scrubbing as depicted in FIG. 30A. Hence, the rod portion 716 and tongue 726 are rotated in the position shown in FIG. 31B.

Figure 30C:
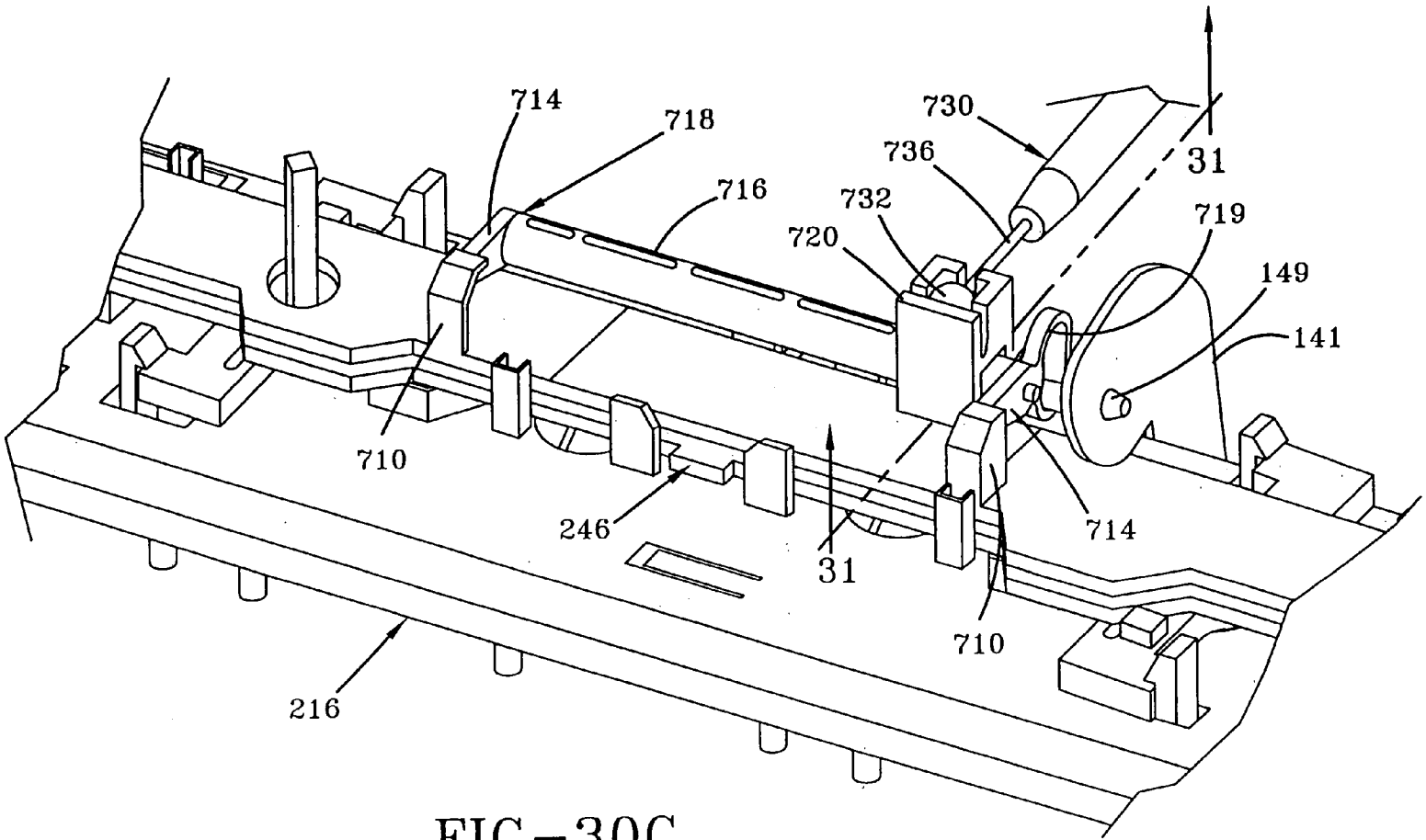
FIG. 30C is an enlarged view of the cut away portion of FIG. 30A, but with the brush block assembly locked in the raised position.
Figure 30D:
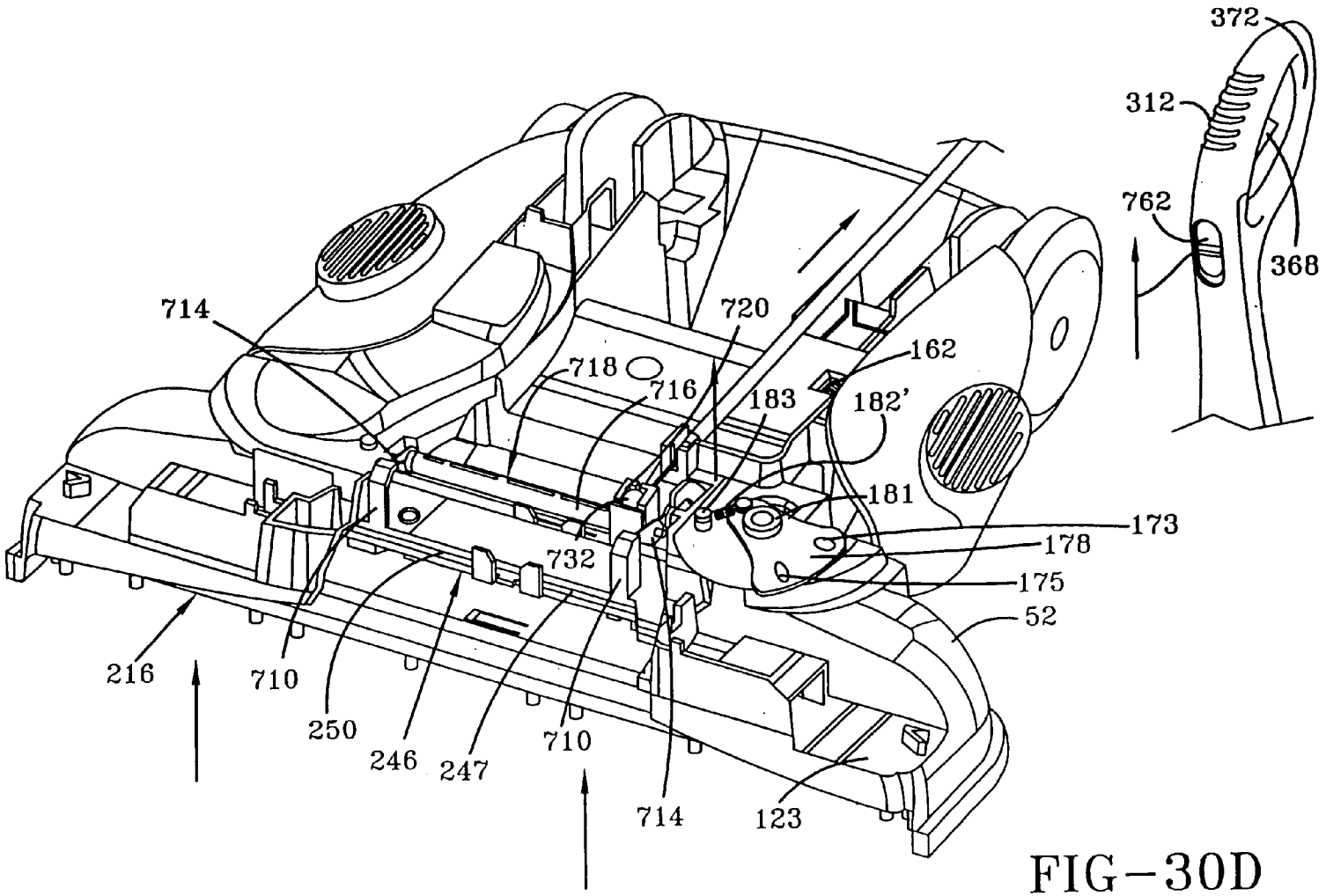
FIG. 30D is a view similar to FIG. 30A but with a compression spring being used to bias the indicator plate instead of a torsion spring.
Figure 31A:
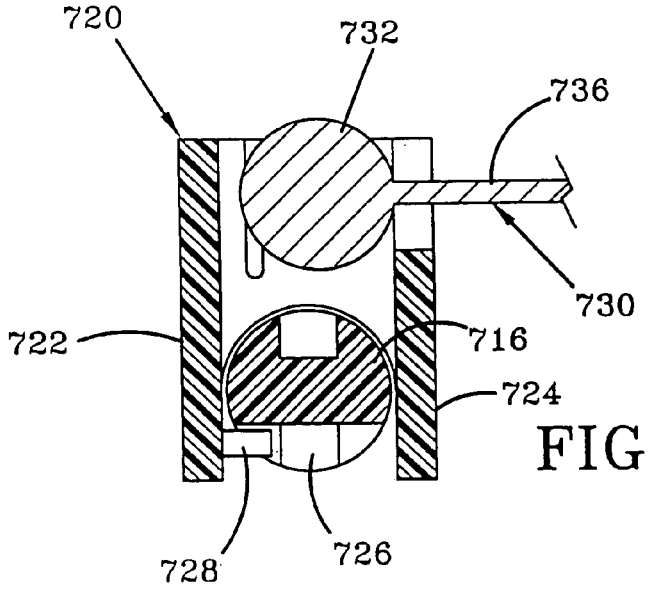
FIG. 31A is a sectional view taken along line 31A—31A of FIG. 31.
Figure 31B:
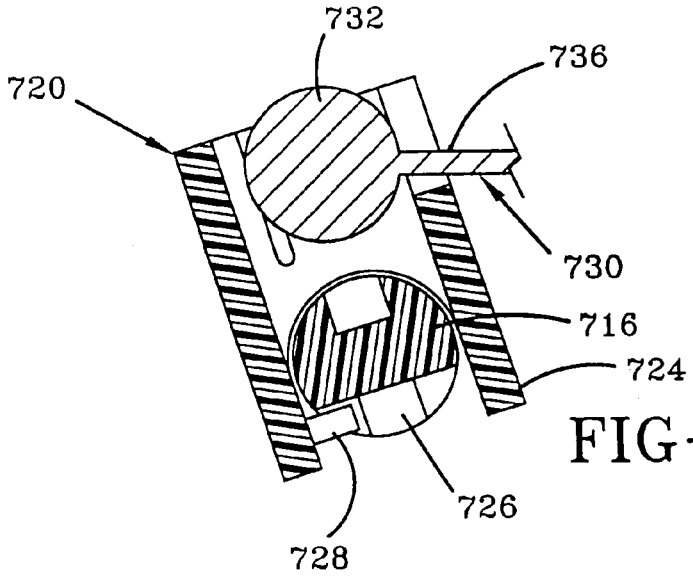
FIG. 31B is a view similar to FIG. 31A but with the brush lifting lever, pocket portion, cable and other related elements in a position that lowers the brush block assembly.

When the nozzle assembly 62 is raised off the floor as depicted in FIG. 18, the brush assembly 216 is locked in its raised position, thereby prevented from being lowered. To accomplish this action as depicted in FIG. 30C, a snap pin 149 extends through the ring member 719 and aperture 141 (FIG. 23) of the upwardly extending arm 141 of the wheel carriage (FIG. 23) pivotally securing them together. Thus, when the lifting lever 718 is raised with respect to the wheel carriage 136, the arm 141 lowers the ring member 719 of the lifting lever 718, thereby rotating the rod portion 716 clockwise and lifting the brush block assembly 216. At this position as depicted in FIG. 30C, the pin 149 holds down the ring member 719 preventing it from pivoting upwardly, and thereby preventing the brush block assembly 216 from lowering. At this position as depicted in FIG. 31A, the pocket portion 720 is free to pivot forwardly, since the tongue 728 can slide along the length of the groove 726. In effect, the cooperation of the tongue 728 and groove 726 acts as a lost motion mechanism to keep the brush block assembly raised and also to avoid stressing the wire portion 376 of the cable 730 in the event the pocket portion 720 is moved forward from, for example, a user sliding a brush slide button 762 (FIG. 30B) down to the wet scrub position as will be explained in further detail below.

As shown in FIG. 2A, the cable 730 and related elements are used to move the pocket portion 720 forward and rearward to lower and raise the brush block assembly 216, and in combination with a microswitch 534 (FIG. 3A) to energize and denergize the brush motor 508 (FIG. 24) when the brush block assembly 216 is lowered and raised, respectively. In particular, a ball 732 at the lower end of the cable 730 is securely seated in the pocket portion 720 by a projection 734 (FIG. 2C) formed on the underside of the hood 172 (FIG. 2C) bearing against it. The cable 730 includes a Bowden-type wire portion 736 slidably received in a shell 738. As depicted in FIGS. 30A and 30B, the cable 730 is seated in a raised channel 740 formed in the upper surface of the upper portion of the frame 52 rearwardly adjacent the pocket portion 720 to minimize lateral movement of the cable 730.

Figure 32:
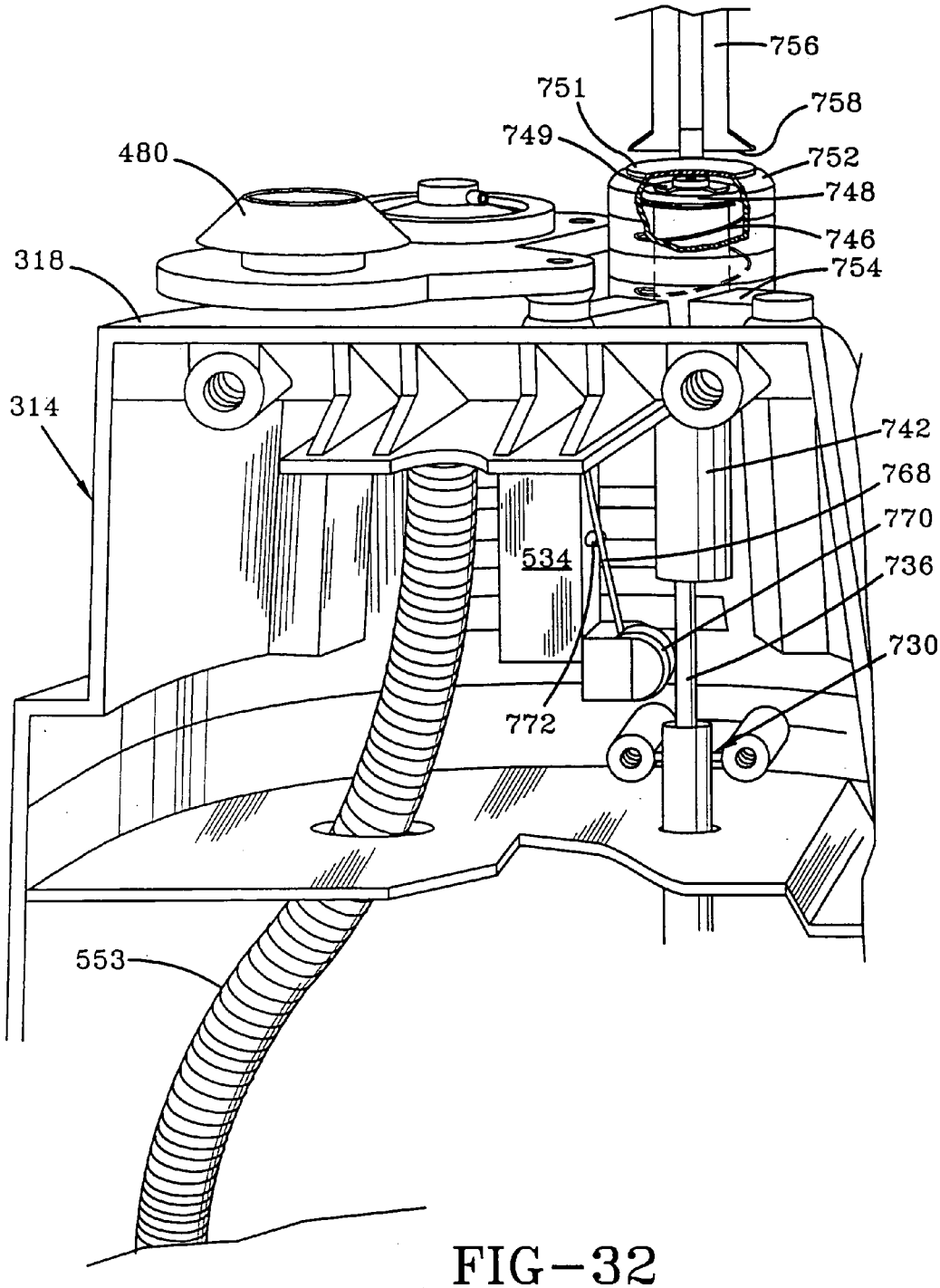
FIG. 32 is a partial front sectional view of the upper portion of the lower body shell of the hard floor cleaning unit of FIG. 1 with portions removed for illustrative purposes.

As depicted in FIG. 32, the cable 730 is routed to the lower body shell 314, such that the wire portion 736 of the cable 730 extends into a cylindrical cap 742 and attaches to an upper enclosed end portion of the cap 742 by, for example, molding or die casting it to the cap 742. The cylindrical cap 742 slidingly extends through an opening in the top support shelf 318 of the lower body shell 314 and through a coiled spring 746. A washer 748 is inserted around the cap 742 and covers the spring 746. An elastic e-shaped ring 749 is inserted into an annular groove formed circumferentially around the cap 742 just above the washer 748, to keep the spring 746 from urging the washer 748 out of the cap 742. A rubber boot 752 mounted to the top support shelf 318 of the lower body shell 314 via mounting piece 754, covers the cap 742, spring 746, washer 748 and ring member 719, thereby sealing them from moisture. An articulated push rod 756 has a lower end 758 abutting the top 751 of the boot 752.

The microswitch 534 is mounted in the lower body shell 314 inwardly adjacent the cap 742 below the top support shelf 318 via a switch cover 766 (FIG. 3A), capturing it in place. The microswitch 534 is electrically connected through the power switch assembly 682 (FIG. 3A) to the power supply (not shown) and to the power cord 552 (FIG. 24) of the brush motor 508 (FIG. 24) to energize and deenergize the motor 508. An elastic lever arm 786 is snap connected to the microswitch 534 and abuts a spring-loaded push button 772 on the microswitch 534. A roller 770 is rotatably connected at the distal end of the lever arm 768.

Figure 33:
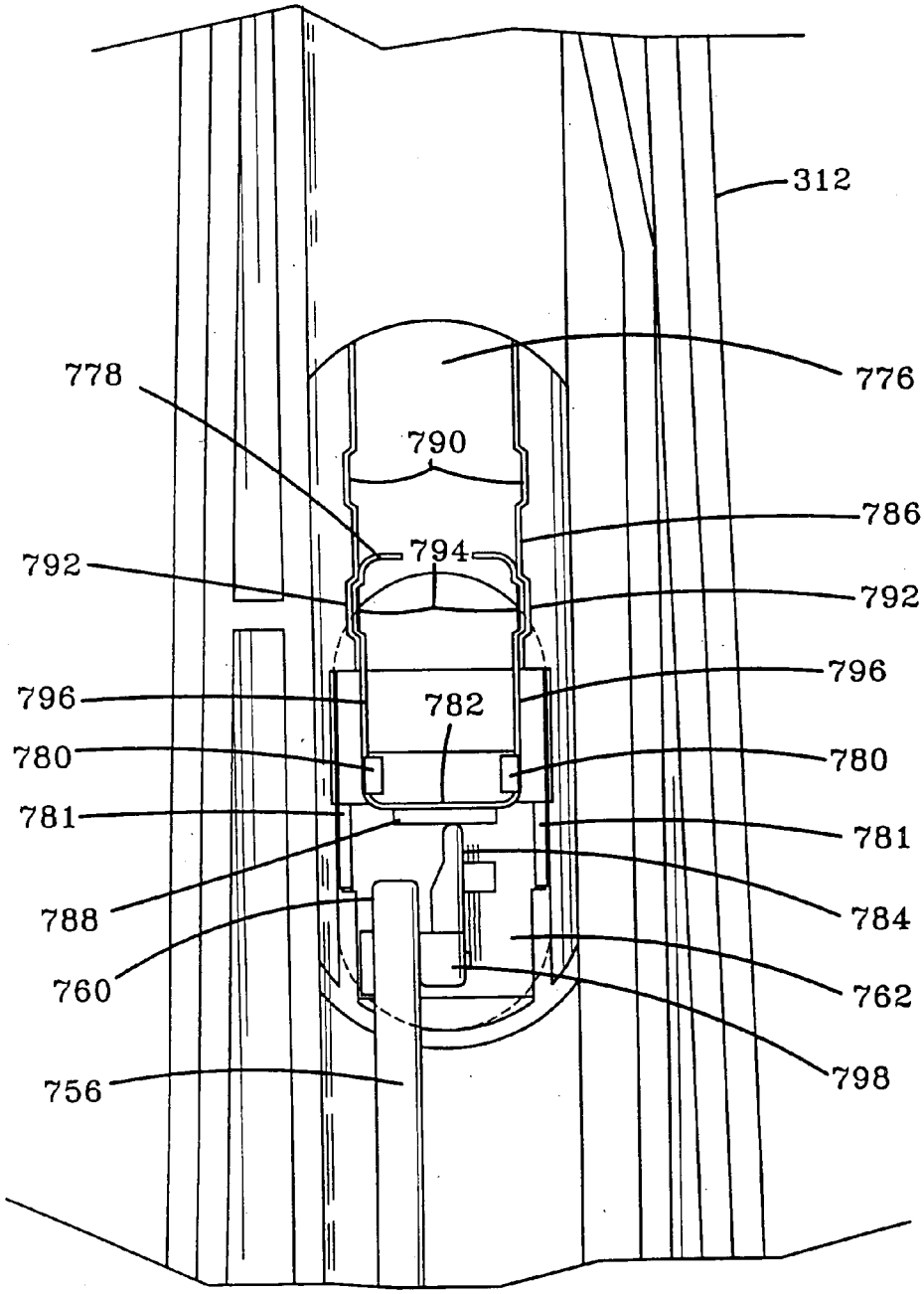
FIG. 33 is a partial sectional view taken along line 33—33 of FIG. 1.

Referring to FIG. 33, the slide button 762 slides up and down along an elongated groove 776 formed near the lower end of the handgrip 372 (FIG. 3B) to move the push rod 756. In particular, the slide button 762 includes a pair of rearward depending outwardly flared legs 781 that slidingly receive opposite side edges of an inner frame 786 surrounding the groove and integrally formed with the upper handle 312. A u-shaped spring 778 is fitted around and under rearward depending tabs 780 of the slide button 762. The middle portion 782 of the u-shaped spring 778 bears against a lateral rear rib 788 of the slide button 762. Upper and lower pairs of notches or detents 790, 792 are formed on opposite sides of the inner frame 786 for receiving complimentary outer offset portions 794 formed on opposite legs 796 of the u-shaped spring 778.

Figure 33A:
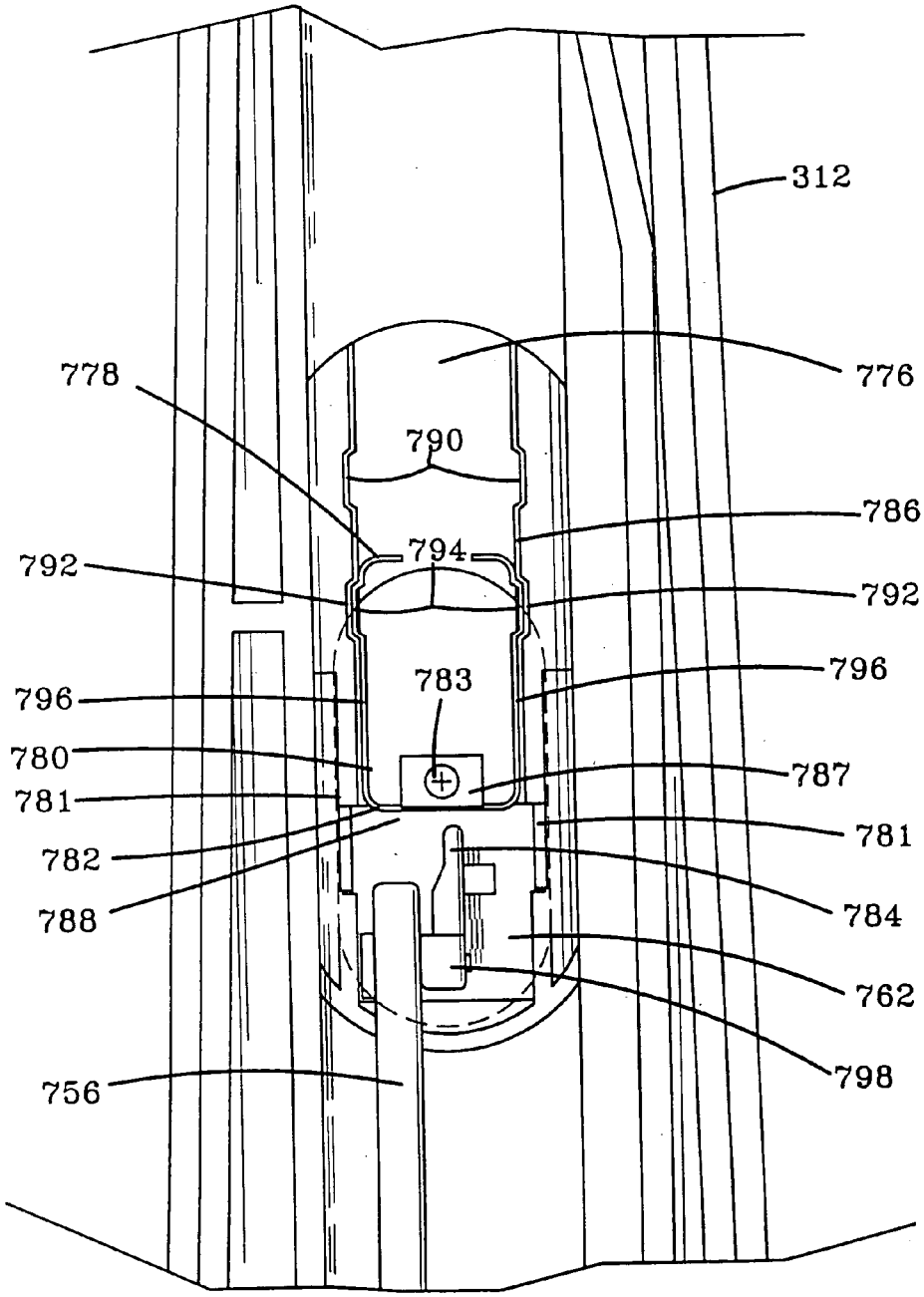
FIG. 33A is view similar to FIG. 33 but showing different means to secure the spring to the slide button.

Thus, pushing the slide button 762 down to its lower position with respect to the handle urges the offset portions 794 to seat into the lower pair of detents 792 and pushing the slide button 762 upwardly to its upper position urges the offset portions 794 to seat into the upper pair detents 790. A nose member 784 is attached to the rear surface of the slide button 762 below the rib 788. A laterally extending arm member 798 is integrally formed with the nose member 784 and pivotally snaps into a detent 774 (FIG. 3B) formed in the upper end 760 of the push rod 756. Alternatively, as depicted in FIG. 33A, the spring is supported and mounted to the slide button via a screw 783 inserted through a tab 787, attached on the middle portion 782 of the spring 778, and screwed to the rear side of the slide button 762.

Figure 32A:
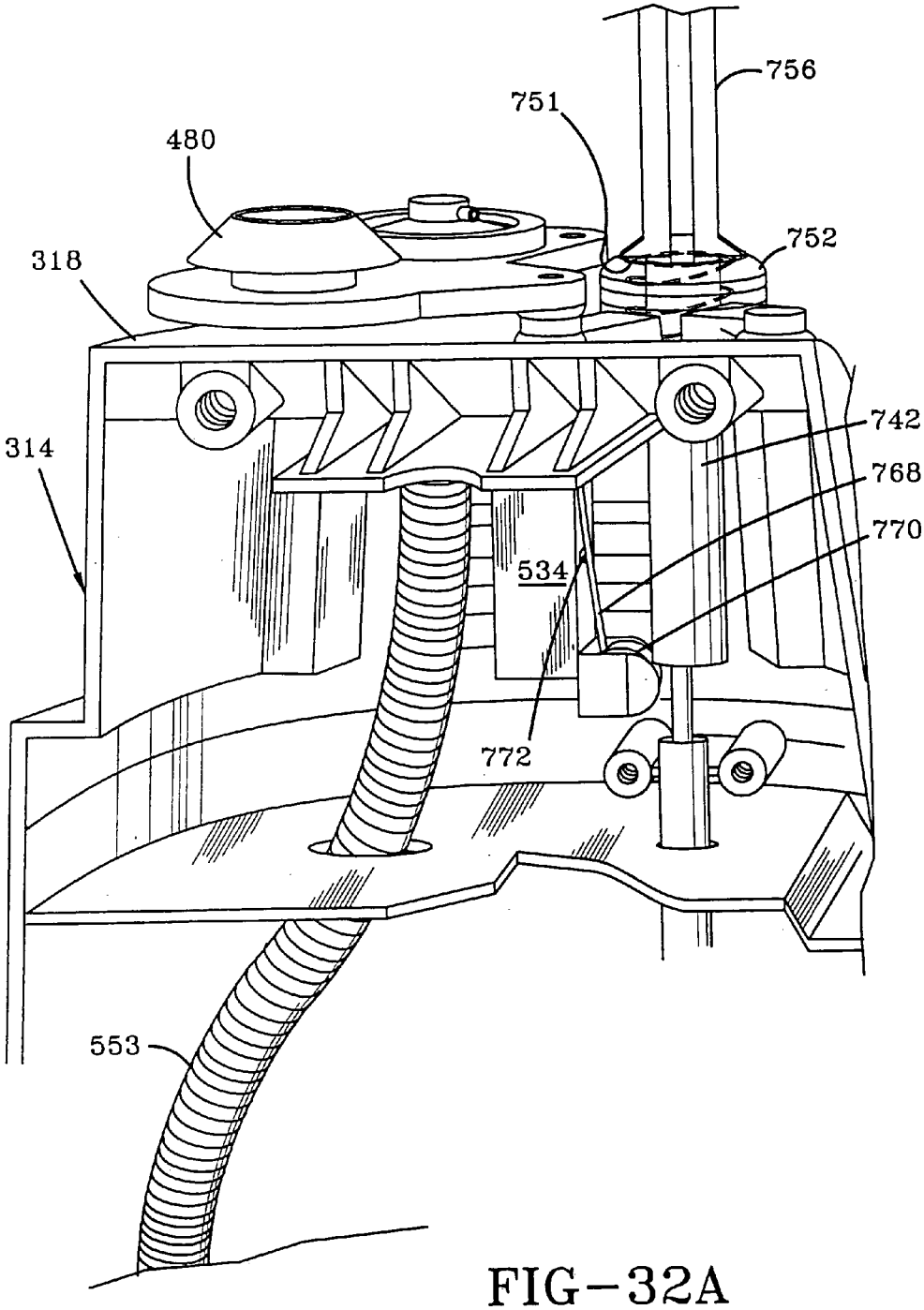
FIG. 32A is a view similar to FIG. 32 but with the cap in a position to causes depression of the push button microswitch to energize the brush motor.

Thus, pushing down on the slide button 762 will move the push rod 756 downward which in turn pushes on the cap 752 moving it and the wire 736 of the cable 730 downwardly. This causes two actions. One being that the ball portion 732 moves the pocket portion 724 forward rotating the brush lifting lever 718 about a quarter turn counterclockwise thereby lowering the brush block assembly 216 as depicted in FIG. 30B. The other being that the cap 742, as seen in FIG. 32A cams against the roller 770 of the lever arm 768 of the microswitch 534, moving the lever arm 768 such that it presses down on the push button 772 of a microswitch 534 to energize the brush motor 508 (FIG. 24) and rotate the brushes 226 (FIG. 19) for scrubbing. When the slide button 762 is slid back upwardly, the ball portion 732 moves rearward rotating the brush lifting lever 718 clockwise back a quarter turn thereby lifting the brush block assembly 716. Also, as seen in FIG. 32, the cap 742 moves up away from the roller 770, thereby releasing the lever arm 768 from pressing down on the push button 772 of the microswitch 534. Thus, the brush motor 508 (FIG. 24) is deenergized and the brushes 226 are not rotated when lifted. Alternatively, the unit could be designed to operate the brushes 226 when suction is not applied to the floor.

With reference to FIG. 1, to operate the hard floor cleaner unit 40 in the dry mode to vacuum dust, dirt and other particulates on the floor, the user depresses the right pedal 206 to lower the handle assembly 42. In the event that the handle is already lowered, but the nozzle assembly 62 is lowered, the user depresses the left pedal to raise the nozzle assembly 62 off the floor. Then, the slide button 704 on the power switch assembly 682 is slid down to activate the suction motor assembly 632 (FIG. 27) to provide suction. The user grasps the handgrip 372 and moves the hard floor cleaner unit 40 over the floor to clean it. After vacuuming the floor in the dry mode (or whenever vacuuming in the wet mode is desired), the user then depresses the left pedal 158 to lower the nozzle assembly 62 on the floor in contact with it in the wet mode to collect and pick up particles on the hard floor.

Referring to FIG. 30B, if scrubbing of the floor is desired, the user slides the slide button 762 on the hand grip 372 downward to the on position which lowers the brush block assembly 216 on the floor and energizes the brush motor 508 (FIG. 24) to rotate the brushes 226 (FIG. 19) to scrub the floor. Squeezing the trigger 368 on the handgrip 372 distributes cleaning solution through the brushes 226 (FIG. 19) and to the floor for cleaning. For hardwood floors, a cleaning solution specifically design to protect the wood can be used. It should be noted that the nozzle assembly 62 could be removed, as previously mentioned, if scrubbing of the floor is desired with no suction applied to it. Referring back to FIG. 1, after cleaning the hard floor, the user slides the slide button 704 of the power switch assembly 682 up to turn off the unit 40. To store the unit 40, the handle assembly 42 is pivoted in the upright position, which in turn raises the nozzle assembly 62 off the floor as depicted in the phantom lines of FIG. 4.

Figure 34:
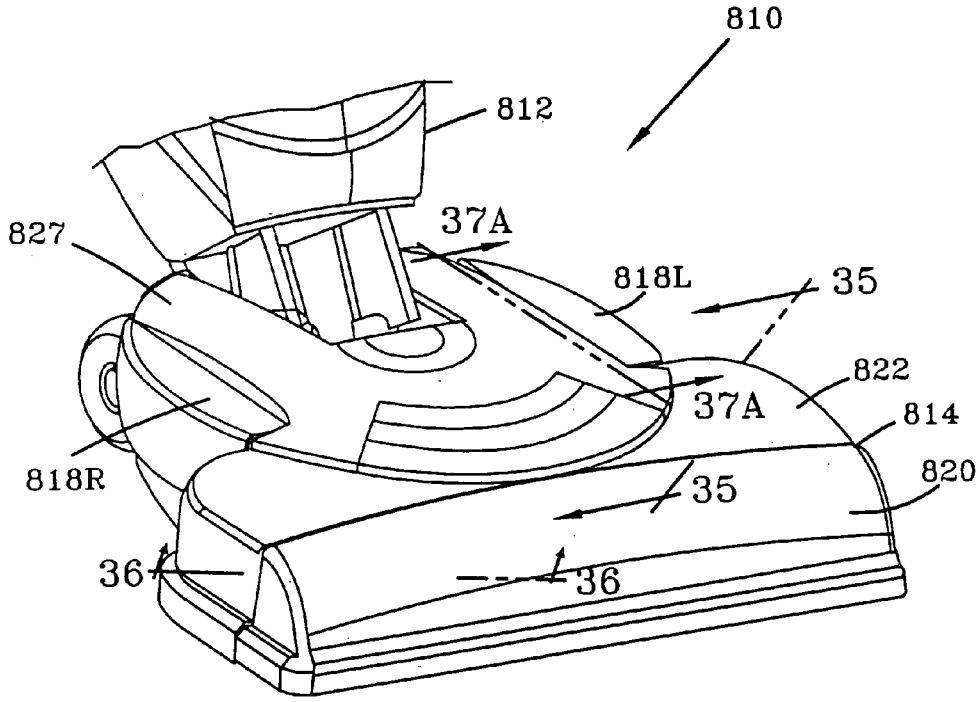
FIG. 34 is fragmentary perspective view of a hard floor cleaning unit according to another embodiment of the present invention.
Figure 34A:
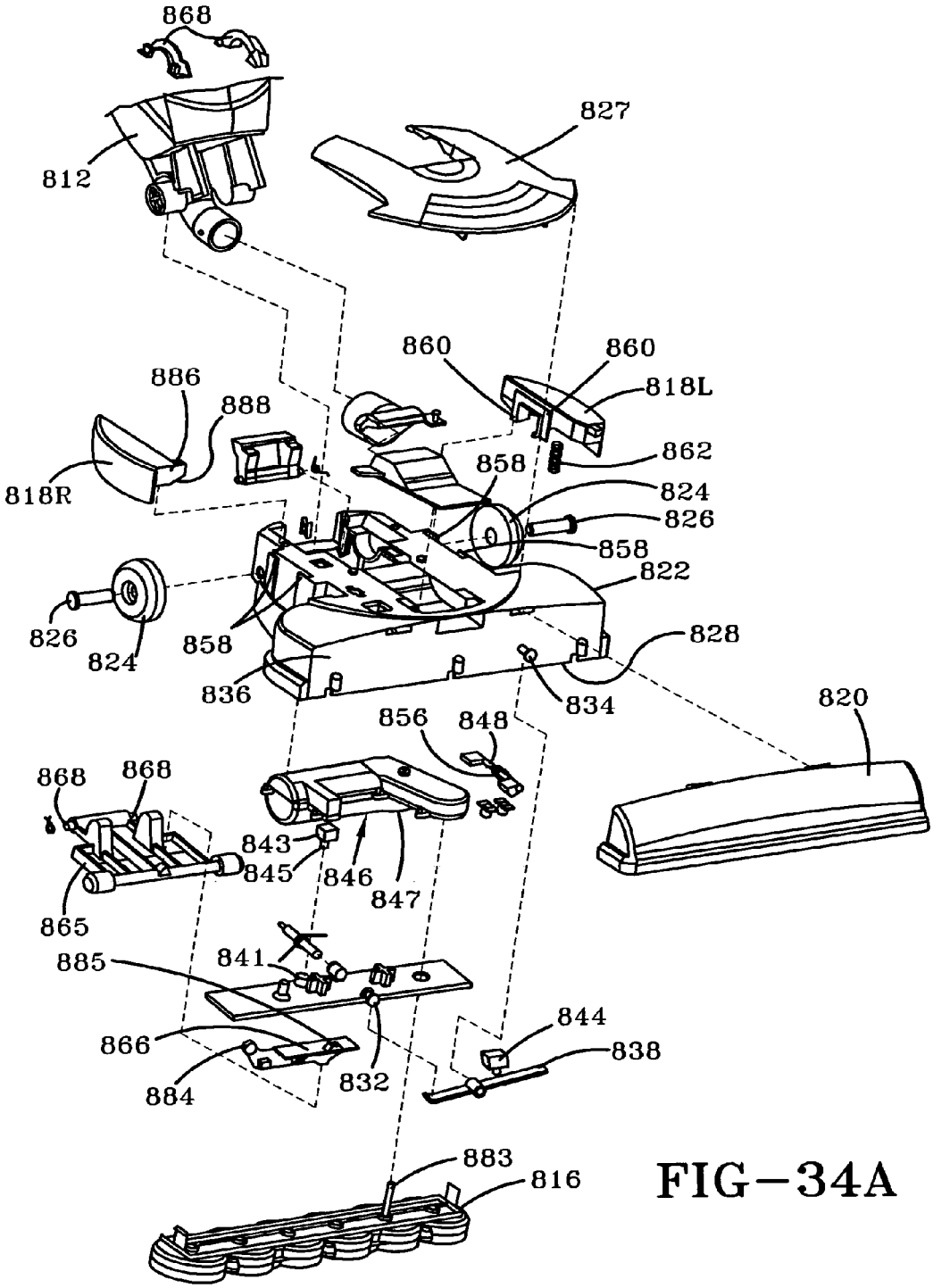
FIG. 34A is an exploded view of the hard floor cleaning unit of FIG. 34.

FIGS. 34, 35, 36A, 36B, and 37 illustrates another embodiment of the nozzle lifting mechanism and brush lifting mechanism for a hard floor cleaning unit 810. Referring to FIG. 34, the cleaning unit 810 comprises an upright handle assembly 812 pivotally connected to the rear portion of a base assembly 814 that moves and cleans along a surface. The handle assembly 812 is generally similar to that of the previous embodiment except that the brush block assembly 816 (FIG. 35) is activated and lifted by a foot pedal 818L on the base assembly 814, which will be further explained. As depicted in FIG. 34A, the base assembly 810 includes a nozzle assembly 820 removably connected to the frame 814, which is covered by a hood 827. Rear wheels 824 are rotatably connected to axles 826 journaled into the frame 822. Left and right pedals 818L, 818R include downward depending leg portions 860 that slideably engage vertical channels 858 formed in the side of the frame 822. A brush block assembly 816 fits into a complimentary cavity 828 of the frame 822 rearwardly adjacent the nozzle assembly 820. A distributor plate 830 is removably secured on the brush block assembly 816. Attached to the front end of the distributor plate 830 is a lateral pin 832 extending forwardly. A pin 834 is also attached to the inside of the front wall 836 of the frame 822 and laterally extends rearward.

Figure 35:
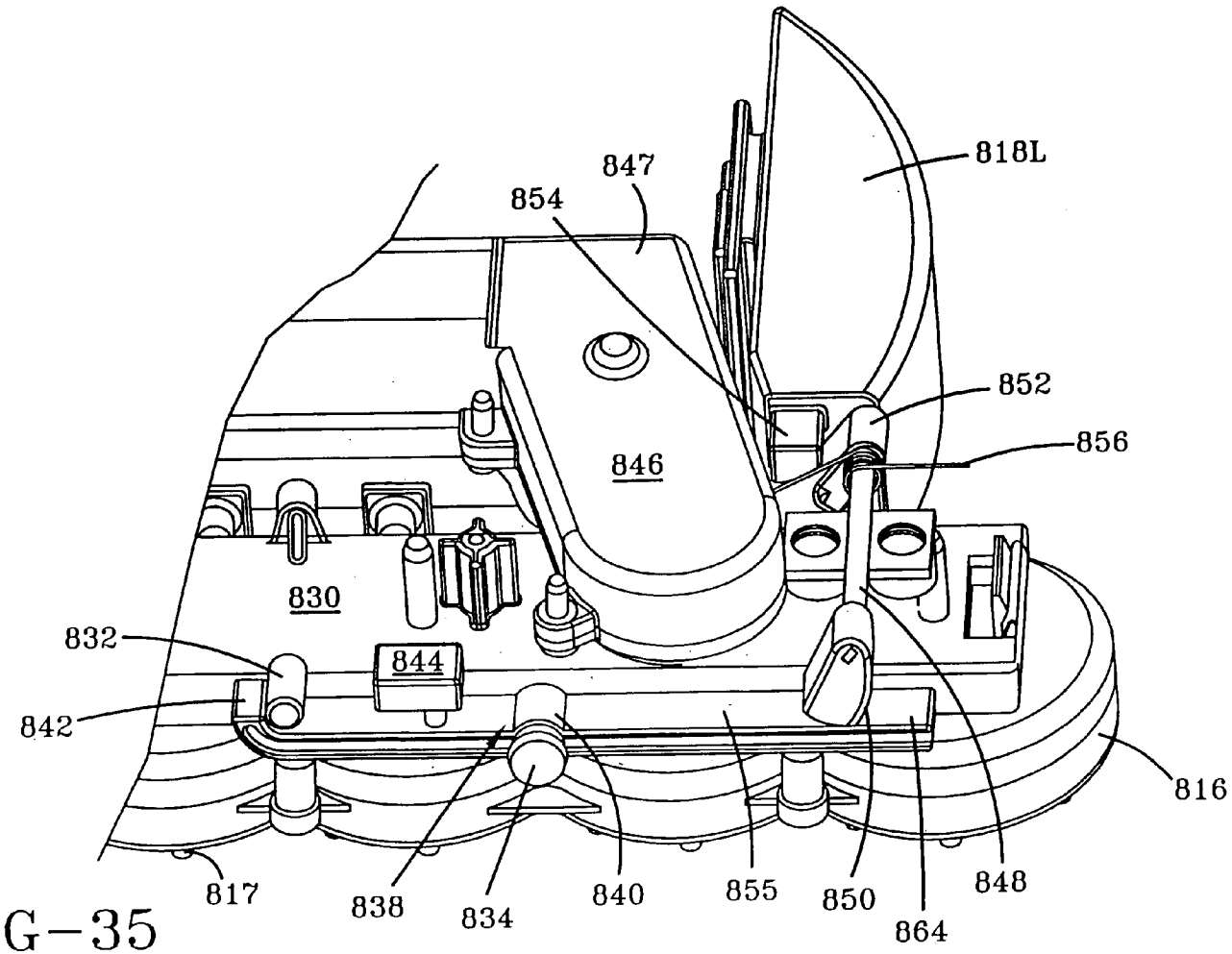
FIG. 35 is perspective view taken along line 35—35 of FIG. 34 with the frame, nozzle assembly, and cover removed for illustrative purposes.

Referring to FIG. 35, a lever 838 is pivotally connected to the pin 834. In particular, the pin 834 extends into a sleeve 840 formed in the lever 838. The right end of the lever 838 defines a hook portion 842 that is positioned just under the pin 832 of the distributor plate 830. A brush motor 846 with cover 847 is mounted to the underside of the frame 822 and includes a drive slot (not shown), which receives a drive shaft 883 (FIG. 34A) of the brush block 816 for driving the brushes 817 for rotation. A microswitch 844 is mounted to the inside of the front wall 836 of the frame 822 above the lever 838 and is electrically connected between a power source (not shown) and the brush motor 846. In this position, the lever 838 is spaced from the spring-loaded push button 855 of a microswitch 844, which is in a normally close circuit condition.

A shaft member 848 oriented perpendicular with respect to the lever 838 is rotatably connected to the cleaning unit 810. A pair of front and rear ears 850, 852 are integrally formed on opposite ends of the shaft member 848 and extend inwardly. The front ear 850 bears upon the left end of the lever 838 and the rear ear 852 is positioned just under a forwardly extending projection 854 formed on a left pedal 818L. The shaft member 848 extends through a torsion spring 856, secured to the frame 822 that biases the ears 850, 852 upwardly. Depressing the left pedal 818L downwardly will cause the projection 854 to cam on the rear ear 852 rotating it downwardly, thereby also causing the front ear 850 to rotate downwardly and cam down on the left portion 864 of the lever 838. This action pivots the lever 838 clockwise thereby moving the hook portion 842 and brush block assembly 816 upwardly. In addition, the lever 838 presses the push button 855 on the microswitch 844, which opens the circuit in the microswitch 844, thereby breaking the electrical connection between the brush motor 846 and power supply. Hence, the brush motor 846 deenergizes and turns off the brush block assembly 816.

Pushing the pedal 818L again and then removing the pushing force moves the pedal 818L upward such that the projection 854 moves away from the rear ear 852 of the shaft member 848, thereby allowing the shaft member 848 to rotate the front ear 850 upwardly from the biasing force of the spring 856. The upward rotation of the front ear 850 away from the left end of the lever 838 allows the right end of the lever 838 to pivot downward from the weight of the brush block assembly 816, thereby lowering the brush block assembly 816. The lever 838 then moves away from the push button 855 of the microswitch 844, thereby closing the circuit in the microswitch 844, which in turn energizes the brush motor 846 to rotate the brushes 817 on the brush block assembly 816 for scrubbing. Additionally with reference to FIG. 34A, as a backup to the microswitch 844, a second microswitch 843, electrically connected between the power source and brush motor 846, could be mounted on the cover 847 of brush motor 846 and positioned over the distributor plate 830 such that a raised portion 841 on the distributor plate 830 presses the switch button 845 to open circuit and deenergize the brush motor 846 upon the brush block assembly 816 being raised.

Figure 36:
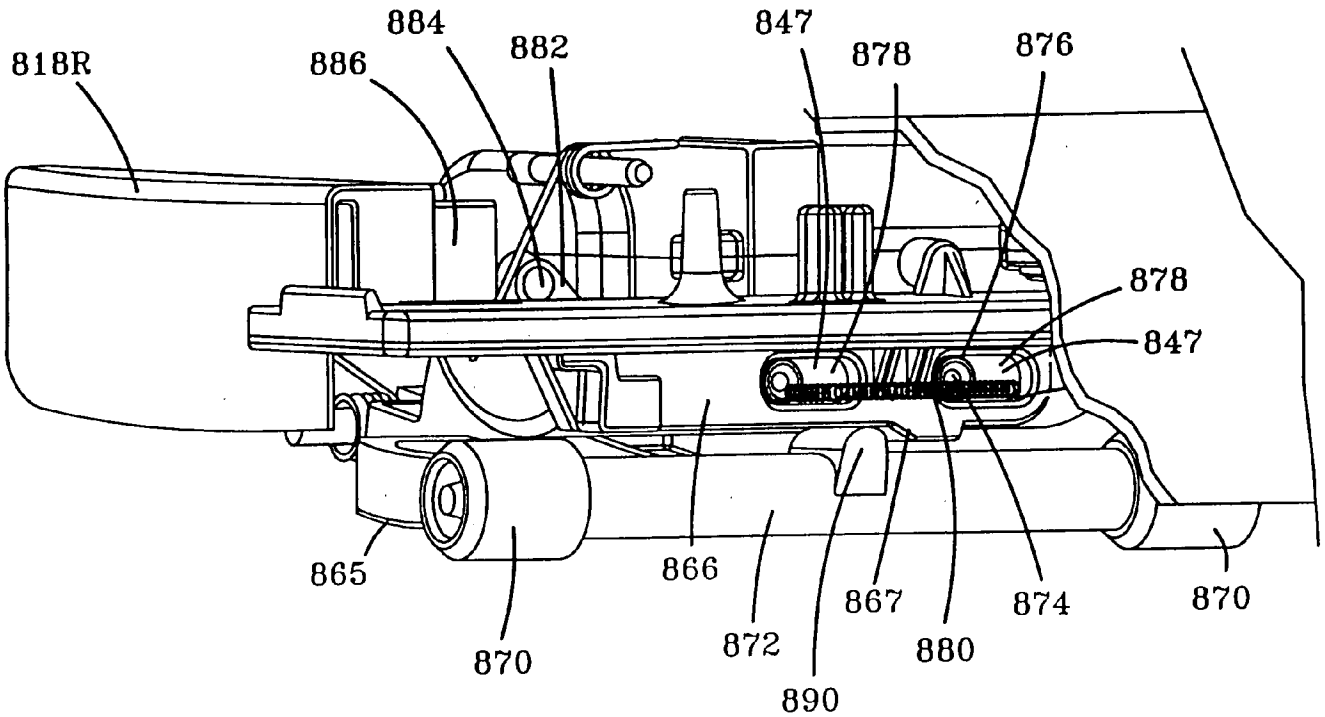
FIG. 36 is a partial elevational view taken along line 36—36 of FIG. 34 with the nozzle assembly removed and portions of the frame cut away for illustrative purposes.

Referring to FIG. 36, a mechanism for lifting the nozzle assembly 820 is disclosed. A wheel carriage 865 is pivotally connected to the underside of the frame 822. In particular, a rear pair of trunnions 868 (FIG. 34A) located on opposite sides of the wheel carriage 865 journals through the frame 822. A pair of wheels 870 is rotatably connected on opposite ends of a stationary axle 872 located on the front end of the wheel carriage 822 for supporting the frame 822. An inverted unshaped raised cam follower 890 is formed on the upper side of the axle 872 and rides along the bottom side of a slide block 866. The slide block 866 is slidably mounted to the brush motor cover 847 by screws 874 extending through respective washers 876 and then into a pair of elongated longitudinal slots 878. The washers 876 are secured to the screws, by for example, welding them thereto. The washers 876 radially extend beyond opposite longitudinal ends of the slots 878 to secure the slide block 866 to the motor cover 847. Thus, the slide block 866 slides along the longitudinal axis of the slots 878, yet is secured to the base assembly 814.

A compression spring 880 is connected between the screw 874 closer to the right pedal 818R and portion of the slide block 866 underneath the slot 878 further away from the right pedal 818R. A ramp portion 867 is integrally formed on the bottom side of the slide block 866 and extends downwardly. An upwardly extending arm 882 is integrally molded on the left end of the slide block. The arm 882 is angled outwardly and is positioned under an inwardly extending projection 886 of the right pedal 818R. The arm 882 includes a roller 884 rotatably connected to it at the upper end of the arm 882. The projection 886 has a beveled edge 888 (FIG. 34A) formed on its bottom right corner.

When the nozzle assembly 820 is in the raised position, the ramp portion 867 abuts against the cam follower 890, thereby raising the frame 822 (FIG. 34A) and hence nozzle assembly 820 (FIG. 34A) with respect to the wheel carriage 866 and floor. Upon depression of the right pedal 818R, the beveled edge 888 9 FIG. 34A) of the projection 886 cams against the roller 884 which causes the slide block 866 to move inwardly until the cam follower 890 moves away from the ramp portion 867, thereby lowering the frame 822 (FIG. 34A) and nozzle assembly 820. Upon depression of the pedal 818R again, the projection 886 moves upwardly away from the arm 884. This action allows the spring 880 to urge the slide block 866 to slide outwardly such that the cam follower 890 cams against the ramp portion 867, thereby raising the frame 822 (FIG. 34A) and nozzle assembly 820 from the floor. Additionally, a raised stop member 885 (FIG. 34A) of the slide block 866 abuts against the distributor thereby raising the brush assembly 816 and preventing it from lowering.

Figure 37A:
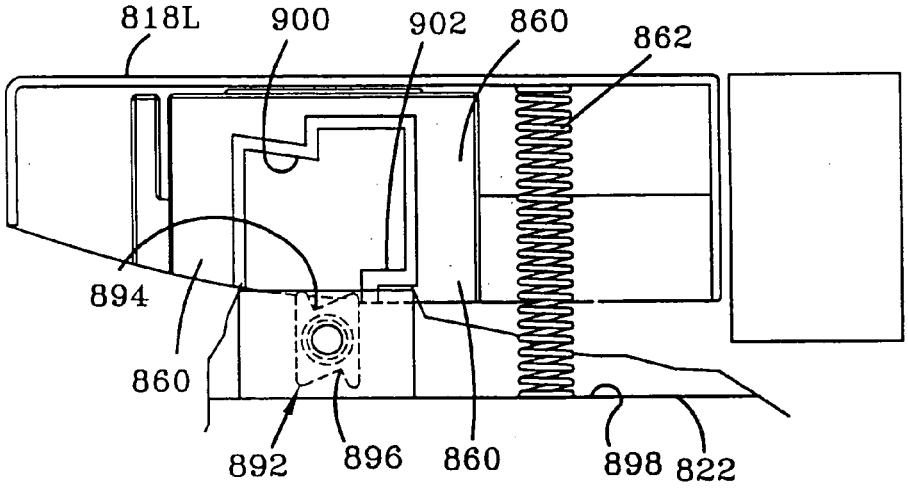
FIG. 37A is a sectional view taken along line 37A—37A of FIG. 35.
Figure 37B:
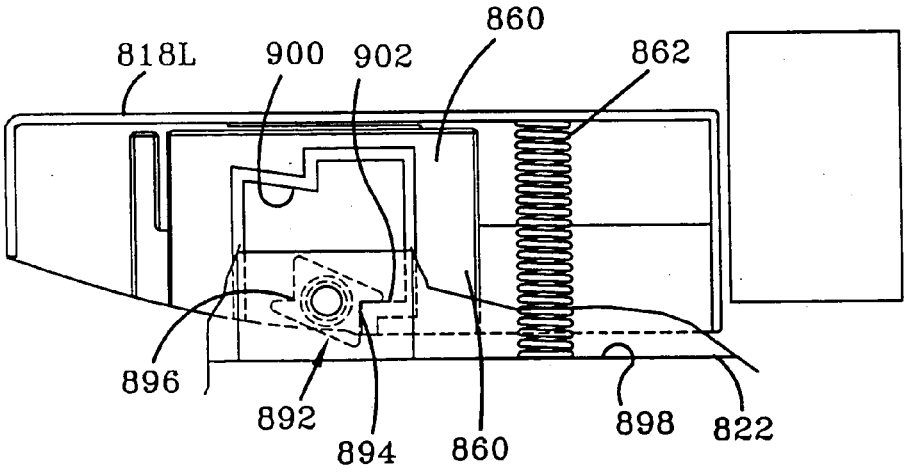
FIG. 37B is a view similar to FIG. 37A but with the pedal depressed.

Turning to FIGS. 37A and 37B, the pedals 818R, 818L contain a push—push mechanism, which allows the right pedal 818R to raise or lower the nozzle assembly (FIG. 34A) upon depression, and allows the left pedal 818L to raise or lower the brush block assembly 816 (FIG. 34A) upon depression. Both the pedals and their push—push mechanisms are generally similar in design and function so only the left pedal 818L and its push—push mechanism will be herein described. Thus, the elements described below for the left pedal 818L and its push—push mechanism are also used for the right pedal 818R and its push—push mechanism. The push—push type mechanism acts upon each of the pedals 818R, 818L to lock and unlock it when it is pushed.

In particular, a coiled spring 862 attached to the underside of the pedal 818L depends downwardly and abuts a bottom ledge 898 of the frame 822. A rotor 892 having first and second notches 894, 896 is rotatably connected to the portion of the side of the frame 822 between the channels 858. When the pedal 818L is depressed, an upper rib 900 on the pedal 818L engages the first notch 894 to rotate the rotor 892. The rotor 892 is rotated until a second notch 896 engages a bottom rib 902. When the pedal 818L is released, the coiled compression spring 862 moves the pedal 818L up slightly so that the bottom rib 902 rotates the rotor 892 so that the upper rib 900 is aligned with the outer side of the rotor 892 between the notches 894, 896. In this position as depicted in 37B, the engagement of the bottom rib 902 with the second notch 894 prevents further rotation of the rotor 892 and thus locks the pedal 818L. Depressing the pedal 818L again moves the bottom rib 902 out of the way of the second notch 170 and causes the upper rib 900 to engage the outer side 904 of the rotor 892 rotating it such that the second notch 896 rotates past the bottom rib 902. At this position, there is no interference to prevent the pedal 818L from moving back to its original position.

Thus, upon releasing the pedal 818L, the coiled compression spring 862 moves the pedal 818L upwardly. It should be apparent that upon depressing the pedal 818L again to raise either the nozzle assembly 820 or brush block assembly 816, the upper rib 900 now engages the second notch 896 and the first notch 894 engages the upper rib 900 but in all other aspects the raising and lowering operation will be similar, since the notches 894, 896 are similarly shaped.

Figure 38:
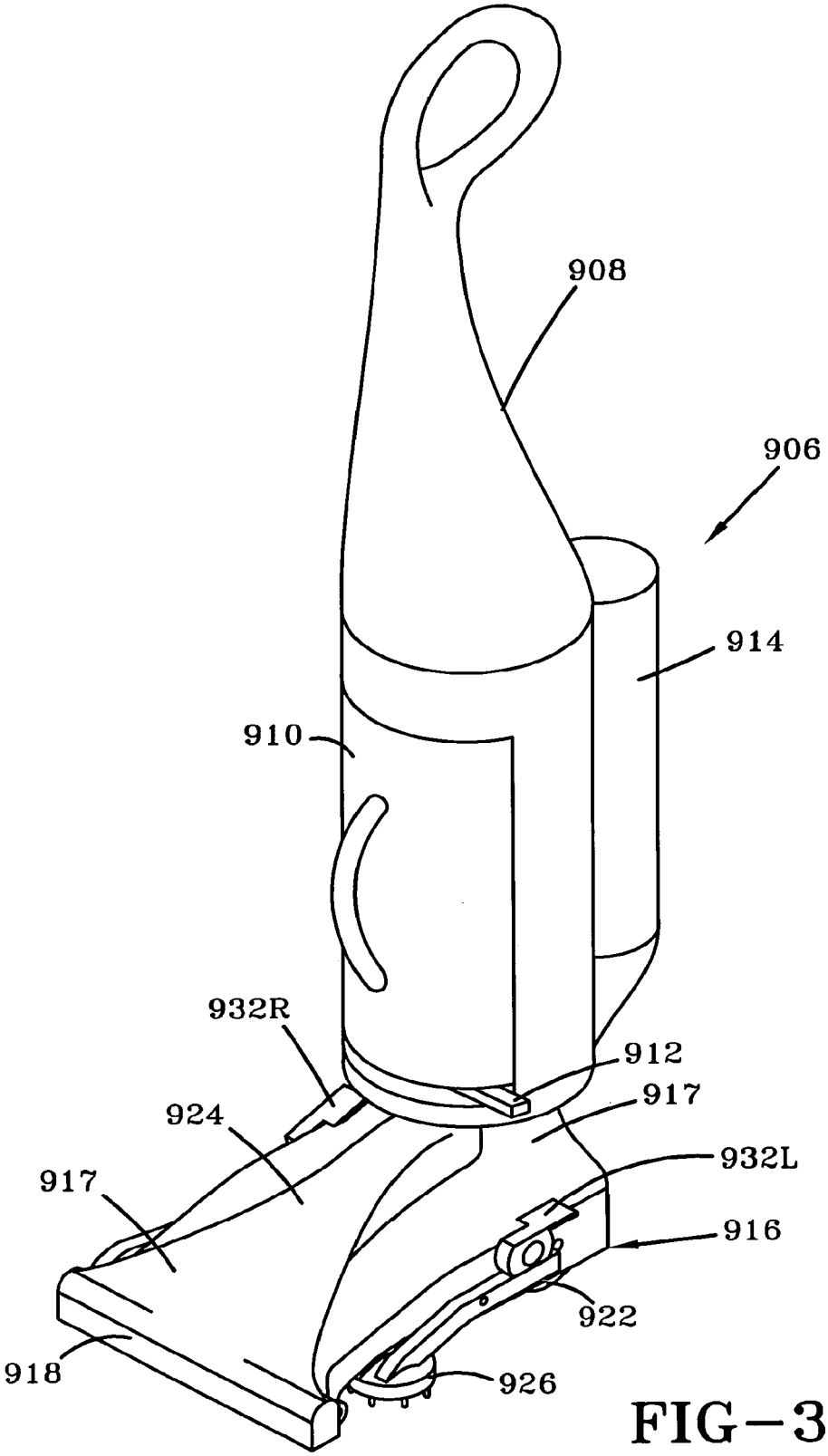
FIG. 38 is a perspective view of still another embodiment of the hard floor cleaning unit according to the present invention.
Figure 39A:
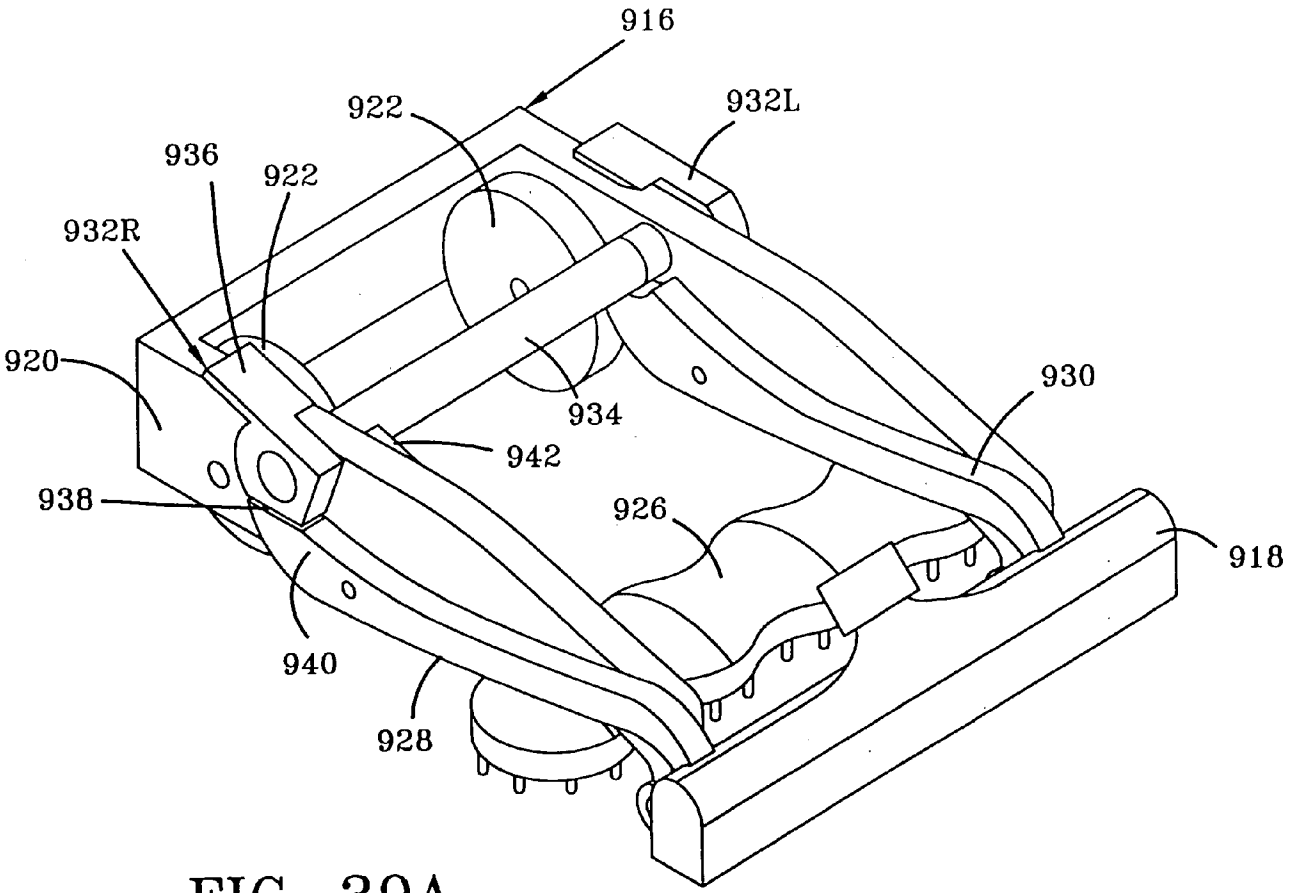
FIG. 39A is a right perspective view of the base assembly of the hard floor cleaning unit of FIG. 38 with the cover and central duct removed for illustrative purposes.
Figure 39B:
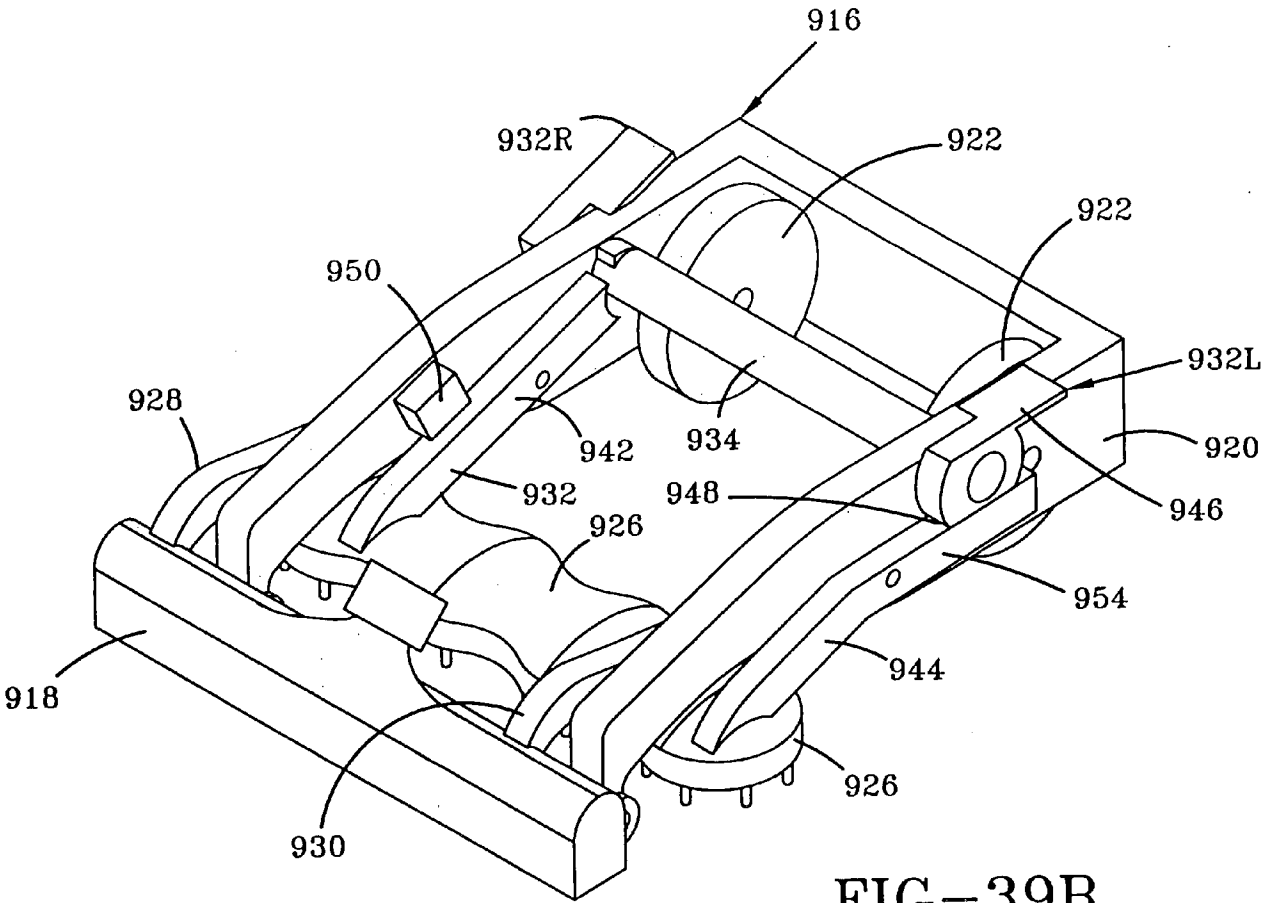
FIG. 39B is a left perspective view of the base assembly of the hard floor cleaning unit of FIG. 38 with the cover and central duct removed for illustrative purposes.

FIGS. 38, 39A and 39B illustrate still another embodiment of a nozzle lifting mechanism and a brush lifting mechanism on a hard floor cleaning unit 906. Turning to FIG. 38, the cleaning unit 906 comprises an upright handle assembly 908 pivotally connected to the rear portion of a base assembly 916 that moves and cleans along a surface. Wheels 922 are rotatably connected to the base assembly 916. The handle assembly 908 includes a recovery tank 910 removably mounted in a complementary cavity. A latch (not shown) releasably locks the recovery tank 910 to the handle assembly 908. A supply tank 914 is removably mounted to the handle assembly 908 and located rearwardly adjacent the recovery tank 910. The base assembly 916 includes a nozzle assembly 918 fluidly connected to the recovery tank 910 via a central duct 924 attached thereto. A brush assembly 926 is secured to the base assembly 916 rearwardly adjacent the nozzle assembly 918. The base assembly 916 further includes a hood or cover 917 covering it. As is commonly known, cleaning liquid from the supply tank 914 is distributed onto the floor and scrubbed thereon by the brush assembly 926. A suitable suction source (not shown) draws the dirt and/or cleaning liquid from the floor through the nozzle assembly 918 and into the recovery tank 910.

As depicted in FIGS. 39A and 39B, a pair of right and left lever arms 928, 930 are attached to the nozzle assembly 918 and extend rearward. The right lever arm 928 is located outwardly adjacent the right side of the frame 920 and pivotally connected to the frame 920. The left lever arm 930 is located inwardly adjacent the left side of the frame 920 and pivotally connected to frame 920. The pivotal connections allow the nozzle assembly 918 to raise and lower. A right pedal 932R is pivotally connected to an axle 934 journaled into the frame 920. The right pedal 932R has a top portion 936 that extends rearward and a bottom portion 938 that bears against the top surface of the rear portion 940 of the right lever arm 928. Thus, when the top portion 936 of the pedal 932R is depressed, the bottom portion 938 rotates and cams against the rear portion 940 of the right lever arm 928 causing it to pivot downwardly, thereby raising the nozzle assembly 918. Referring to FIG. 39B, a brush assembly 926 is secured to the frame 920 and is located rearwardly adjacent the nozzle assembly 918. A pair of right and left lever arms 942, 944 is attached to the brush assembly 926 and extends rearward.

The right lever arm 942 is located inwardly adjacent the right side of the frame 920 and pivotally connected to the frame 920. The left lever arm 944 is located outwardly adjacent the left side of the frame 920 and pivotally connected to it. The pivotal connections allow the brush assembly 926 to raise and lower. A left pedal 932L is pivotally connected to the axle 934. The left pedal 932L has a top portion 946 that extends rearward and a bottom portion 948 that bears against the top surface of the rear portion 954 of the left lever arm 944. Thus, when the top portion 946 of the left pedal 932L is depressed, the bottom portion 948 rotates and cams against the rear portion 954 of the left lever arm 944 causing it to pivot downwardly, thereby raising the brush assembly 926. The right side of the frame 920 includes an inwardly extending stop projection 950 that overlies the right lever arm 928 of the brush assembly 926 that limits the upward movement of the brush assembly 926.

The present invention has been described by way of example using the illustrated embodiment. Upon reviewing the detailed description and the appended drawings, various modifications and variations of the preferred embodiment will become apparent to one of ordinary skill in the art. All such obvious modifications and variations are intended to be included in the scope of the present invention and of the claims appended hereto.

In view of the above, it is intended that the present invention not be limited by the preceding disclosure of a preferred embodiment, but rather be limited only by the appended claims.

What is claimed is:

1. A floor care appliance, comprising:

a base for movement over a surface to be cleaned;

at least one rotary agitator for loosening dirt on the surface;

a housing attached to the base;

a liquid recovery tank mounted on the housing;

a cleaning solution tank mounted on the housing located above the liquid recovery tank; and a motor-fan assembly located between said liquid recovery tank and said cleaning solution tank;

wherein said liquid recovery tank and said cleaning solution tank are located in cavities in the housing and wherein said liquid recovery tank and said cleaning solution tank have sidewalls that are integrally formed such that the sidewalls are flush with the sidewalls of the housing.

2. The floor care appliance of claim 1, wherein said housing is pivotally attached to said base.

3. The floor care appliance of claim 1, wherein said at least one agitator is located in said base for agitating the surface to be cleaned.

4. The floor care appliance of claim 3, wherein said at least one rotary agitator is rotated by an electric motor.

5. The floor care appliance of claim 1, further comprising an on/off switch for selectively energizing and de-energizing said motor-fan assembly.

6. The floor care appliance of claim 1, further comprising a trigger located on the housing for dispensing cleaning solution from said cleaning solution tank onto the surface to be cleaned.

7. The floor care appliance of claim 6, further comprising an actuator rod operatively connected to said trigger for dispensing cleaning solution.

* * * * *